US012490829B1

(12) United States Patent
Stager

(10) Patent No.: US 12,490,829 B1
(45) Date of Patent: Dec. 9, 2025

(54) STOP-SNAP-SLIDE CHANNEL AND USES THEREFOR

(71) Applicant: Mark Phillip Stager, Sandy, OR (US)

(72) Inventor: Mark Phillip Stager, Sandy, OR (US)

( * ) Notice: Subject to any disclaimer, the term of this patent is extended or adjusted under 35 U.S.C. 154(b) by 0 days.

(21) Appl. No.: 18/972,769

(22) Filed: Dec. 6, 2024

(51) Int. Cl.
*A47B 81/04* (2006.01)
*A47B 57/54* (2006.01)
*A47B 57/58* (2006.01)

(52) U.S. Cl.
CPC ..... *A47B 57/586* (2013.01); *A47B 57/545* (2013.01); *A47B 81/04* (2013.01)

(58) Field of Classification Search
CPC ... A47B 57/586; A47B 57/581; A47B 57/583; A47B 57/58; A47B 57/265; A47B 57/545; A47B 65/15; A47B 65/20; A47B 81/04; A47B 46/005
See application file for complete search history.

(56) References Cited

U.S. PATENT DOCUMENTS 518,573 A * 4/1894 Parker ..... A47B 57/583 211/184
628,943 A * 7/1899 Kasik ..... G11B 33/0483 211/40
851,571 A * 4/1907 Timberlake ..... A47F 7/0064 211/41.7
RE12,711 E * 10/1907 Twitchell ..... 211/41.7
910,057 A 1/1909 Greener
1,120,941 A * 12/1914 Jones ..... B42F 17/02 211/40
1,608,088 A 11/1926 Duncan
1,660,823 A * 2/1928 Thometz ..... B42F 17/02 211/51
1,667,266 A 4/1928 Papp
2,134,606 A * 10/1938 Hackworth ..... A47B 57/583 108/27
2,516,088 A 7/1950 Einhorn
2,620,929 A * 12/1952 Sportsman ..... A47B 65/15 211/69.5
2,634,865 A 4/1953 Geheb
(Continued)

FOREIGN PATENT DOCUMENTS

CA 2468504 A1 * 12/2005
WO WO-8102829 A1 * 10/1981 ..... A47B 45/00

OTHER PUBLICATIONS

All Glass Parts Inc.; "Hold-Open Washer Speed Release (Aluminum Finish)"; at least as early as Nov. 8, 2024; 2 pages; published online at: https://www.allglassparts.com/hold-open-washer-speed-release-aluminum-finish-8-906-r/.
(Continued)

*Primary Examiner* — Stanton L Krycinski
(74) *Attorney, Agent, or Firm* — Law Office of Karen Dana Oster, LLC

(57) ABSTRACT

A stop-snap-slide channel system having at least one rail and at least one component, each at least one component has at least one stop-snap-slide channel defined therein. An adjustable storage rack has at least one rail and at least one support, each support has at least one stop-snap-slide channel. Each stop-snap-slide channel includes at least one stop sub-channel and at least one slide sub-channel, the at least one stop sub-channel partially overlaps the at least one slide sub-channel.

20 Claims, 41 Drawing Sheets

(56) References Cited

U.S. PATENT DOCUMENTS

| | | | | | |
|---|---|---|---|---|---|
| 2,914,183 | A * | 11/1959 | Vuici | A47B 57/583 | 108/27 |
| 3,171,542 | A * | 3/1965 | Jacobs | A47B 65/20 | 211/184 |
| 3,596,392 | A | 8/1971 | Vani | | |
| 4,023,682 | A * | 5/1977 | Niece | A47B 57/581 | 211/44 |
| 4,162,013 | A * | 7/1979 | Tucker | A47B 65/10 | 211/184 |
| 4,196,812 | A * | 4/1980 | McInnis | A47B 81/067 | 211/40 |
| 4,343,450 | A * | 8/1982 | Anderson | A47F 7/0064 | 248/460 |
| D282,323 | S | 1/1986 | Fetty | | |
| 4,592,471 | A | 6/1986 | Bross | | |
| 4,776,469 | A | 10/1988 | Geleziunas | | |
| 4,915,433 | A | 4/1990 | Schafer | | |
| D311,651 | S | 10/1990 | Fetty | | |
| 5,000,326 | A | 3/1991 | Vaughn | | |
| 5,035,332 | A * | 7/1991 | Stravitz | G11B 23/0236 | 211/184 |
| 5,117,984 | A * | 6/1992 | Kennedy | G11B 33/0483 | 211/40 |
| 5,207,334 | A | 5/1993 | Lear | | |
| 5,660,284 | A | 8/1997 | Vaughn | | |
| 5,683,010 | A | 11/1997 | Boyajian, Jr. | | |
| 6,142,323 | A * | 11/2000 | Veil, Sr | A47B 96/04 | 211/184 |
| D450,540 | S | 11/2001 | Romero | | |
| 6,334,540 | B1 * | 1/2002 | Plutsky | A47F 5/083 | 211/59.1 |
| 6,460,710 | B1 * | 10/2002 | Dardashti | A47B 57/26 | 211/187 |
| D481,264 | S | 10/2003 | Morgan | | |
| 6,672,550 | B1 | 1/2004 | Borodulin | | |
| 6,913,156 | B1 * | 7/2005 | Wolff | A47B 88/969 | 211/184 |
| D523,327 | S | 6/2006 | Clarke | | |
| 7,104,409 | B2 | 9/2006 | Morgan | | |
| 7,152,746 | B2 * | 12/2006 | Henk | G11B 33/0433 | 211/175 |
| 7,367,261 | B2 * | 5/2008 | Gaskill | A47J 37/048 | 99/441 |
| 8,517,323 | B1 | 8/2013 | Gregory | | |
| 8,579,121 | B2 * | 11/2013 | Eng | A47L 19/04 | 211/41.9 |
| D701,069 | S | 3/2014 | Miller | | |
| D705,575 | S | 5/2014 | Snider | | |
| D725,792 | S | 3/2015 | Cullen et al. | | |
| D729,021 | S | 5/2015 | Goodman et al. | | |
| D747,155 | S | 1/2016 | Goodman et al. | | |
| D776,983 | S | 1/2017 | Bruce | | |
| D798,637 | S | 10/2017 | Min | | |
| D826,660 | S | 8/2018 | Klein et al. | | |
| D835,439 | S | 12/2018 | Tsai | | |
| D843,792 | S | 3/2019 | Hsu | | |
| 10,226,862 | B2 * | 3/2019 | Blake | A47F 5/0807 | |
| D846,319 | S | 4/2019 | Min | | |
| D873,057 | S | 1/2020 | Tuang | | |
| D891,832 | S | 8/2020 | Min | | |
| D915,118 | S | 4/2021 | Savioli | | |
| 2002/0074464 | A1 | 6/2002 | Borodulin | | |
| 2004/0113032 | A1 | 6/2004 | Parenteau | | |
| 2004/0187698 | A1 | 9/2004 | Parenteau | | |
| 2006/0261021 | A1 | 11/2006 | Stagnaro | | |
| 2008/0078895 | A1 | 4/2008 | Hebert | | |
| 2008/0314846 | A1 | 12/2008 | Klein | | |
| 2008/0314850 | A1 | 12/2008 | Haarmann | | |
| 2009/0057246 | A1 | 3/2009 | Kraft | | |
| 2009/0057247 | A1 | 3/2009 | Kraft | | |
| 2012/0267330 | A1 | 10/2012 | Borodulin | | |
| 2014/0197121 | A1 | 7/2014 | Knight | | |
| 2015/0250357 | A1 | 9/2015 | Zhitnitsky | | |
| 2016/0015176 | A1 | 1/2016 | Cano et al. | | |
| 2017/0055703 | A1 | 3/2017 | Corless | | |
| 2018/0223532 | A1 | 8/2018 | Bennett | | |

OTHER PUBLICATIONS amazon.com; "2-Pack—Simple Houseware Cabinet Door/Wall Mount Pot Lid Organizer Rack"; first available Aug. 6, 2016; 4 pages, published online at: https://www.amazon.com/Pack-SimpleHouseware-Cabinet-Organizer-Chrome/dp/B01K07N018?th=1.

Amazon.com; "BesChase Pots and Pans Organizer, Expandable Pot Rack with 12 Adjustable Dividers, Pot Pan Lid Organizer Holder for Cabinet Countertop Cupboard Kitchen Storage HKA0001 Black"; first available Nov. 8, 2021; 6 pages; published online at: https://a.co/d/6xDY3bY.

Amazon.com; "Evelots 6 Pot Lid Organizer for Cabinet or Pantry Wall—Cupboard Door Pots and Pans Organizer—Glass or Metal Pan Covers Cabinet Organizer—Rack Hanger Dividers"; first available Apr. 24, 2015; 5 pages; published online at: https://www.amazon.com/Evelots-Storage-Cabinet-Door-Wall-Organizer-6-Covers-Chrome/dp/B07V6KB3KJ.

Amazon.com; "Jaq Pot Lid Organizer 13.5" Kitchenware Dividers Holder for Plates, Pans, Cutting Boards, Muffin Tins, Baking Sheets in Cabinets Shelf Countertop Pantry (Black, 8-Slot)"; first available Aug. 11, 2022; 4 pages; published online at: https://www.amazon.com/JAQ-Organizer-Kitchenware-Dividers-Countertop/dp/B0B58K1D2W.

Amazon.com; "Landmore Pot Lid Organizer, Pot Lid Holder Organizer Multifunction 2 Layer Pot Lid Stand, Drain Not Wet Countertop Pot Lids Rack for Pot Lid Rest Cutting Board"; first available Mar. 31, 2022; 3 pages; published online at: https://www.amazon.com/Organizer-Landmore-Multifunction-Countertop-Cutting/dp/B09WYG1RQN.

Amazon.com; "Mlesi Expandable Pot and Pan Organizer Rack, 12+ Pot lid Organizer Holder, Bakeware Adustable Rack, Kitchen Cabinet Organizer for Bakeware Cutting Boards, Black"; first available May 9, 2021; 3 pages; published online at: https://www.amazon.com/Mlesi-Expandable-Organizers-Adjustable-Compartments/dp/B094GXY6GK?th=1.

Amazon.com; "Puricon Rubber, Metal, Iron (3 Set) Pot Rack Pan Lid Organizer with 15 Adjustable Dividers, Skillet Griddle Cutting Board Baking Holder, Cookware for Kitchen Cabinet Cupboard Pantry Storage - Bronze", first available Aug. 18, 2021; 5 pages; published online at: https://www.amazon.com/Puricon-Organizer-Adjustable-Dividers-Bundle/dp/B0CDP7WG99.

Amazon.com; "Roohua Pot Rack-Expandable Pan Organizer for Cabinet, Pot Lid Holder with 10 Adjustable Compartment for Kitchen Cabinet Cookware Baking Frying Rack—Bronze"; first available Jul. 18, 2021; 4 pages; published online at: https://www.amazon.com/Organizer-Expandable-Adjustable-Compartment-Cookware/dp/B096XFTZ7L.

Amazon.com; "S&T Inc. Pot Lid Holder and Spoon Rest for Kitchen Counter, Pot Lid Rack and Cooking Utensils Rest, 3.1 Inch ×8.3 Inch ×5.9 Inch, Black"; first available Aug. 22, 2022; 4 pages; published online at: https://www.amazon.com/INC-Kitchen-Counter-Cooking-Utensils/dp/B0BBJPNZM6.

Amazon.com; "Spectrum Diversified Euro Kitchen Organizer for Plates, Cutting Boards, Bakeware Cooling Racks, Pot & Pans, Serving Trays, Reusable Containers, and Lids, Satin Nickel 13.5 ×4.5 ×4.25"; at least as early as Nov. 27, 2023; 4 pages, published online at: https://www.amazon.com/Spectrum-Diversified-Organizer-Holder-Square/dp/B0019HQH32?th=1.

Amazon.com; "Sunfcon Pot Pan Lids Holder Cutting Board Rack Chopping Board Organizer Stand Spoon Rest w Drip Tray Kitchen Countertop, Black"; first available May 30, 2022; 5 pages; published online at: https://www.amazon.com/SUNFCON-Cutting-Chopping-Organizer-Countertop/dp/B0B2P29436?th=1.

Amazon.com; "Trivae Unique Patented Pan Lid, Utensil and Pot Holder, Dish/Cake Serving Stand and Trivet in One for the Kitchen Lover"; at least as early as Nov. 27, 2023; 4 pages; published online at: https://www.amazon.com/Trivae-Unique-Patented-Utensil-Serving/dp/B01HE52FI8.

(56) References Cited

OTHER PUBLICATIONS

Amazon.com; "YouCopia StoreMore Adjustable Pot Lid Organizer, Standard, White"; first available Feb. 11, 2019; 6 pages; published online at: https://www.amazon.com/YouCopia-50159-StoreMore-Adjustable-Organizer/dp/B07NMTHPXK?th=1.

Amazon.com; "Yqh The-Cabinet Pot Lid Organizer, Door Mounted Pot Cover Rack, Pot Lid Storage, Cabinet Hanging Type Pot Lid Rack, 304 Stainless Steel Pot Cover Support in Kitchen, Cabinet and Food Cabinet"; first available Oct. 1, 2019; 2 pages; published online at: https://www.amazon.com/Cabinet-Organizer-Mounted-Storage-Cabinet-Hanging/dp/B07YLM7JZB.

Amazon.com; "Y.Z.Bros Pot Lid Organizer, Kitchen Plate Rack Holder Rest, Storage Cutting Boards, Bakeware, Pot & Pans, Serving Trays, Reusable Containers in Cabinet Pantry, Stainless Steel"; first available Mar. 17, 2020; 4 pages; published online at: https://www.amazon.com/Organizer-Bakeware-Reusable-Containers-Stainless/dp/B085ZYQ75J?th=1.

Ikea.com; "Variera Pot lid organizer, stainless steel"; at least as early as Dec. 6, 2023; 2 pages; published online: https://www.ikea.com/ca/en/p/variera-pot-lid-organizer-stainless-steel-70154800/.

Mcmaster-Carr; "Quick-Lock Threaded Through-Hole Knobs"; at least as early as Apr. 11, 2024; 1 page; published online: https://www.mcmaster.com/products/quick-lock-knobs/knobs~/.

Pinterest.com; "Rubbermaid Slide-Out Vertical Lid and Pan Organizer (FG1H3300CSHM)"; at least as early as May 16, 2023; 8 pages; published online at: pinterest.com/pin/262334747014881298.

Storm Door Parts Warehouse; "Hold Open Washer"; at least as early as Nov. 8, 2024; 2 pages; published online at: https://stormdoorpartswarehouse.com/hold-open-washer/.

Uline.com; "Adjustable Open Wire Shelving"; manual; at least as early as Dec. 5, 2024; 2 pages; manual available online at: https://www.manualslib.com/manual/1851264/U-Line-Adjustable-Open-Wire-Shelving.html.

Walmart.com; Kitchen Details Lid Organizer, Gray (Dims: 13.1 ×5.5 ×3.5 inch); 1 page; published online at: https://www.walmart.com/ip/Kitchen-Details-Lid-Organizer-Gray-Dims-13-1-x-5-5-x-3-5-inch/45653265.

Woodworkerexpress.com; "Rev-A-Shelf 5CW2-1222-CR—12in Two-Tier Cookware Organizer"; at least as early as Dec. 6, 2023; 3 pages; published online at: https://www.woodworkerexpress.com/20-3-4-w-chrome-wire-2-tier-cookware-organizer-20-3-4-w-x-22-d-x-18-1-8-h-minimim-opening-20-1-2.html.

* cited by examiner

STOP-SNAP-SLIDE CHANNEL AND USES THEREFOR

TECHNICAL FIELD

The present disclosure describes systems (including apparatuses and/or methods) that generally relate to the technical field of stop-snap-slide channels for use, for example, in adjustable storage racks.

BACKGROUND

Adjustability is important in many devices. Adjustability is often accomplished by having a component with an aperture that can slide on a pole or rail. Some of these sliding components are only incrementally adjustable in that they can only stop at predetermined locations (e.g., old fashioned tent poles). Some of these sliding components require additional structure or complex mechanisms (e.g., an adjustable bicycle seat that is secured at a desired height using a clamp). Shelves and racks are often adjustable, but the adjustability is incremental, requires additional structure, and/or requires complex mechanisms.

Almost everyone can relate to having too many "possessions" ("stuff") and too little space. Even when all the possessions fit in a particular storage space (e.g., drawers or shelves), it is often hard to access and/or reach all the possessions. For this reason, organizing and storage devices are sold for almost every storage space and almost every type and size of possessions.

Kitchens, which often have limited storage space, are particularly problematic because of the diversity of kitchenware items (a type of possessions) that need to be stored. A typical kitchen might have a collection of kitchenware that includes, for example, tools, utensils, appliances, dishes, bakeware, and cookware used in food preparation, food serving, food storage, and/or food consumption. A typical kitchen might have a collection of cookware that includes pots, pans, bowls, and other containers, all in a variety of sizes. And some types of cookware will have associated appropriately-sized lids. The phrase "cookware items" will be used to jointly refer to cookware, lids, and/or other similar kitchenware.

For kitchens with sufficient storage space for all the cookware items, the cookware items might be stored side by side in the storage spaces. There may be sufficient storage because the kitchen is very large. Alternatively, there may be sufficient storage because the cook has only a small quantity of cookware items.

Some kitchens have limited storage space. And some cooks have seemingly too much cookware for their kitchen's storage space. It is extremely frustrating for cooks who have kitchens without sufficient storage space for all their cookware items, particularly if creating additional storage capacity appears to have reached its limits.

In a worst-case scenario for cooks who have kitchens without sufficient storage space, the cookware items are simply shoved into storage spaces leaving cooks to rummage through a jumble of kitchenware to locate the desired cookware item. This non-organization is frustrating for everyone.

Some of the cookware items can be stored in a nested configuration (e.g., smaller items positioned within larger items). Removing a cookware item from a nested configuration usually requires removing the entire nested configuration from the storage space, sorting through the entire nested configuration, selecting the desired cookware item and removing it from the nested configuration, reassembling the remaining nested configuration, and replacing the remaining nested configuration within the storage space. Replacing a cookware item into a nested configuration usually requires removing the partial nested configuration from the storage space, sorting through the partial nested configuration to gain access to the proper position of the nested configuration, replacing the previously removed cookware item into the nested configuration, reassembling the entire nested configuration, and replacing the entire nested configuration within the storage space. For pots and pans, the nesting configuration may result in scratches in the interior surface of the pots and pans. This nested organization, though useful and effective, is frustrating for everyone.

While some of the cookware and/or lids may be stored in a nested configuration, many cookware items cannot be nested. For these there are many commercially available storage racks. The following is a sample of published patent applications and issued patents that describe various types of storage racks:

- U.S. Pat. No. 5,660,284 to Vaughn directed to a storage rack for container lids;
- U.S. Pat. No. 7,104,409 to Morgan directed to an adjustable storage rack for pots, pans, and lids;
- U.S. Design Pat. No. D826,660 to Klein et al. directed to a roll-out cookware organizer;
- U.S. Design Pat. No. D873,057 to Tuang directed to a pan rack;
- U.S. Patent Application Publication No. 2010/0072146 to Smith directed to an adjustable storage rack for cooking utensils; and.
- U.S. Patent Application Publication No. 2017/0055703 to Corless directed to a slidable kitchen organizer apparatus and method of use.

Other commonly used types of stands are a wire rack with legs and supports such as those shown in U.S. Pat. Nos. 2,190,065, 2,891,676, 3,013,670, 3,164,108, 4,592,471, 4,756,582, and 4,943,029.

The prior art, therefore, has failed to provide a storage rack or holder for cooking containers and their lids and covers that may be easily assembled by the purchaser or by a consumer, that may be positioned in convenient orientations both horizontally and vertically and which can be easily adjusted as needed to hold and store a number of containers and lids of various shapes and dimensions. Consequently, there is a need for such a rack in the home kitchen to allow storage areas to be organized effectively and efficiently to reduce clutter and provide the time savings which result when storage spaces are organized.

Accordingly, the novel storage rack has been developed to hold pots, pans, skillets, and lids which resolves the problems of counter and cabinet space, cluttered storage, mislaid lids, matching lids to containers, allowing containers and lids to be consolidated and hidden from sight in a cabinet or enclosed area, as well as to be easily cleaned.

SUMMARY

The present disclosure describes systems (including apparatuses and/or methods) that generally relate to the technical field of stop-snap-slide channels for use, for example, in adjustable storage racks.

Described herein is a stop-snap-slide channel system that includes at least one rail and at least one component. Each at least one component has at least one stop-snap-slide channel defined therein. Each stop-snap-slide channel preferably includes: (i) at least one stop sub-channel; (ii) at least one slide sub-channel (the at least one stop sub-channel partially overlaps the at least one slide sub-channel); (iii) at least one snap ridge extends into each stop-snap-slide channel and partially dividing the at least one stop sub-channel from the at least one slide sub-channel; and (iv) a passage from the at least one stop sub-channel to the at least one slide sub-channel, the passage allowing the at least one rail to pass between the at least one stop sub-channel and the at least one slide sub-channel.

In some preferred systems, each at least one component is held in position in relation to at least one rail when the at least one rail is positioned within the at least one stop sub-channel, and each at least one component is slidable in relation to the at least one rail when the at least one rail is positioned within the at least one slide sub-channel.

In some preferred systems, each at least one rail has an outer perimeter surface. Each at least one stop sub-channel has an inner perimeter surface, the inner perimeter surface of the at least one stop sub-channel is partially nearly congruent with the outer perimeter surface of the at least one rail. Each at least one slide sub-channel has an inner perimeter surface, the inner perimeter surface of the at least one slide sub-channel is partially nearly incongruent with the outer perimeter surface of the at least one rail.

In some preferred systems, the passage is defined between two snap ridges. In some preferred systems, there is a plurality of rails and/or a plurality of components.

In some preferred systems, the at least one component is at least one support, at least one plug, at least one dual-purpose support, at least one non-spanning support, at least one hook support, and/or at least one shelf support.

In some preferred systems, the at least one slide sub-channel has a rail access passageway.

In some preferred systems, the at least one stop sub-channel and the at least one slide sub-channel have an angled relationship.

In some preferred systems, the at least one stop sub-channel and the at least one slide sub-channel have a parallel relationship.

Described herein is an adjustable storage rack that includes at least one rail and at least one support. Each support preferably has at least one stop-snap-slide channel. Each stop-snap-slide channel preferably has at least one stop sub-channel and at least one slide sub-channel, the at least one stop sub-channel partially overlapping the at least one slide sub-channel. Preferably, at least one snap ridge extends into each stop-snap-slide channel and partially divides the at least one stop sub-channel from the at least one slide sub-channel. Preferably, there is a passage from the at least one stop sub-channel to the at least one slide sub-channel that allows the at least one rail to pass between the at least one stop sub-channel and the at least one slide sub-channel.

In some preferred adjustable storage racks, each at least one support is held in position in relation to the at least one rail when the at least one rail is positioned within the at least one stop sub-channel, each at least one support is slidable in relation to the at least one rail when the at least one rail is positioned within the at least one slide sub-channel.

In some preferred adjustable storage racks, each at least one rail has an outer perimeter surface. Each at least one stop sub-channel has an inner perimeter surface, the inner perimeter surface of the at least one stop sub-channel being partially nearly congruent with the outer perimeter surface of the at least one rail. Each at least one slide sub-channel has an inner perimeter surface, the inner perimeter surface of the at least one slide sub-channel being partially nearly incongruent with the outer perimeter surface of the at least one rail.

In some preferred adjustable storage racks, the passage is defined between two snap ridges. In some preferred systems, there is a plurality of rails and/or a plurality of components.

In some preferred adjustable storage racks, the at least one support is at least one plug, at least one dual-purpose support, at least one non-spanning support, at least one hook support, and/or at least one shelf support.

In some preferred adjustable storage racks, the at least one slide sub-channel has a rail access passageway.

In some preferred adjustable storage racks, the at least one stop sub-channel and the at least one slide sub-channel have an angled relationship.

In some preferred adjustable storage racks, the at least one stop sub-channel and the at least one slide sub-channel have a parallel relationship.

Objectives, features, combinations, and advantages described and implied herein will be more readily understood upon consideration of the following detailed description of the invention, taken in conjunction with the accompanying drawings. The subject matter described herein is also particularly pointed out and distinctly claimed in the concluding portion of this specification.

DESCRIPTION OF THE DRAWINGS

The accompanying drawings illustrate various exemplary stop-snap-slide channels using, as examples, adjustable storage racks, components of various exemplary storage racks, and/or provide teachings by which the various exemplary storage racks are more readily understood.

The figures are not necessarily to scale. Certain features or components herein may be shown in somewhat schematic form and some details of conventional elements may not be shown or described in the interest of clarity and conciseness. The figures are hereby incorporated in and constitute a part of this specification.

DETAILED DESCRIPTION

The present disclosure describes stop-snap-slide channel systems (including apparatuses and/or methods) using, for illustration purposes, adjustable storage racks as an example thereof. A stop-snap-slide channel is an extremely versatile concept by which a component (e.g., a support, shelf, or plug) with at least one stop-snap-slide channel therethrough can selectively be held in position (stop) in relation to a rail or slide in relation to the rail. As the component with the stop-snap-slide channel defined therein can be almost any type of component that can slide on a rail, the description herein focuses on examples of systems that include at least one rail and components with at least one stop-snap-slide channel that can slide on the rail.

Figure 70:
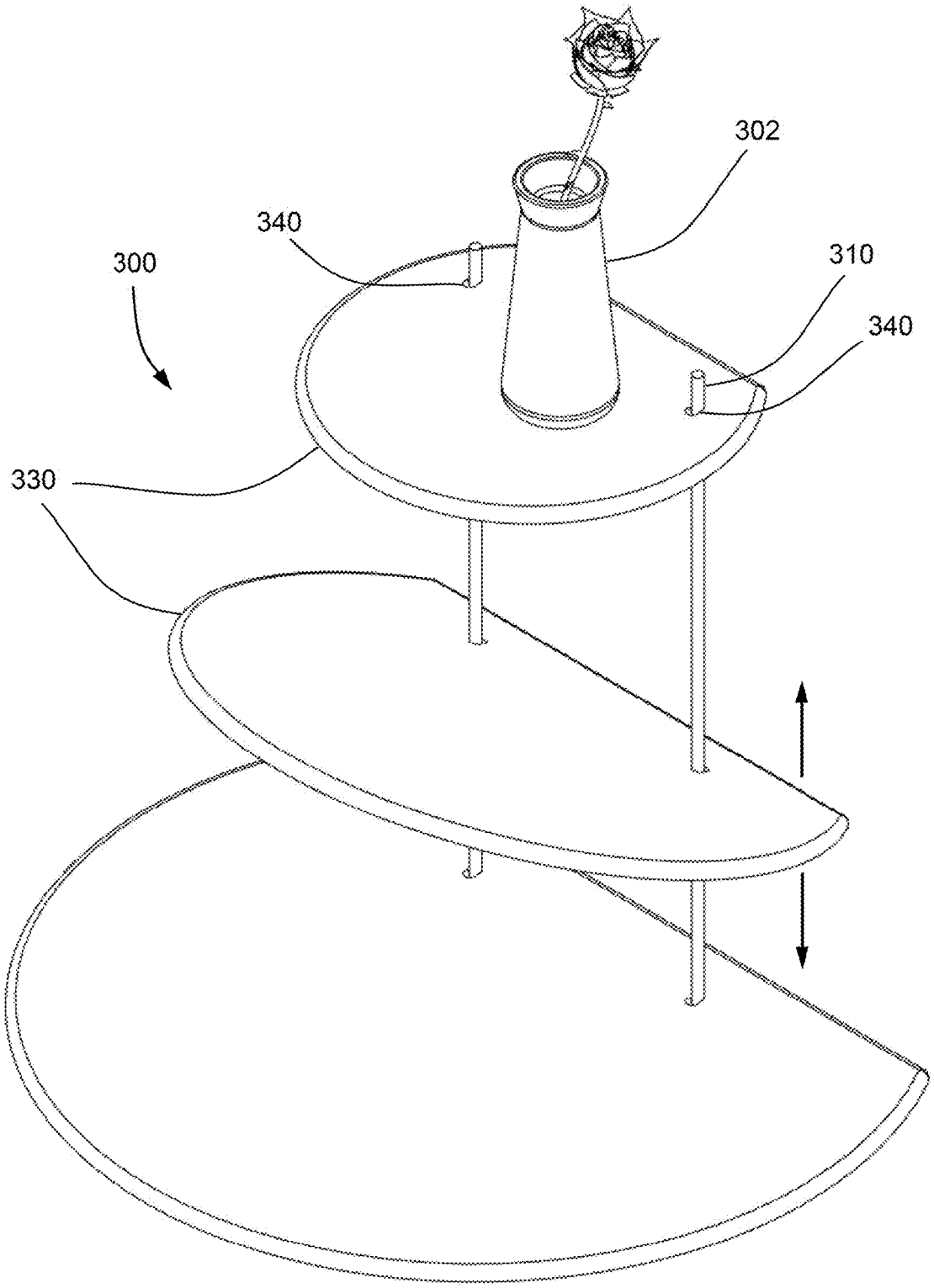
FIG. 70 is a perspective view of an exemplary preferred storage rack with exemplary preferred shelf supports (the shelves) for holding exemplary rackable items (items that can be placed on the shelves), the shelf supports adjustably positionable on rails.
Figure 71:
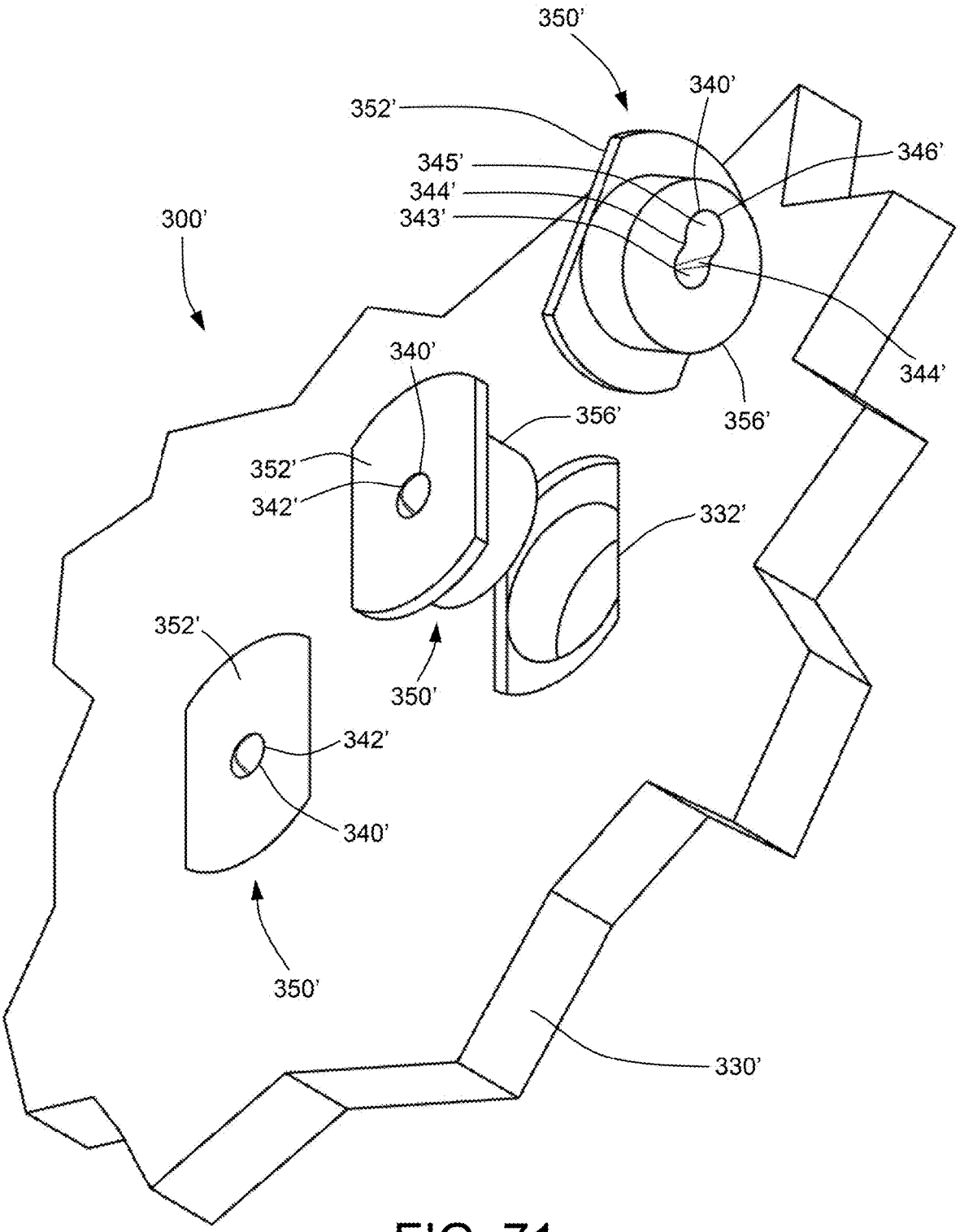
FIG. 71 is a detailed view taken from the bottom of a section of an exemplary component (e.g., a shelf support) with exemplary preferred plugs, each plug having a stop-snap-slide channel, the right plug rotated to show the second end of the stop-snap-slide channel, the middle plug positioned above a plug bore in the shelf support, and the left plug embedded in the shelf support.

The present disclosure describes exemplary systems (including apparatuses and/or methods) related to adjustable storage racks 100 (FIGS. 1-40), 200 (FIGS. 41-51), 200' (FIGS. 52-55), 200" (FIGS. 56-60), 300 (FIG. 70), 300' (FIG. 71). The adjustable storage racks each have at least one rail 110, 210, 210', 210", 310 and at least one support 120, 130, 150, 160, 170, 230, 230', 230", 250, 330. Each support has at least one stop-snap-slide channel 140, 240, 240', 240", 260, 340. Each stop-snap-slide channel includes at least one stop sub-channel 263 143, 243, 243', 243", 263, 343 partially overlapping with at least one slide sub-channel 145, 245, 245', 245", 265, 345. At least one snap ridge 144, 244, 244', 244", 264, 344 extends through the stop-snap-slide channel and partially divides the stop sub-channel from the slide sub-channel. It should be noted that there is a passage (defined between the snap ridges) from the stop sub-channel to the slide sub-channel to allow the rail to pass therebetween.

In use, the supports 120, 130, 150, 160, 170, 230, 230', 230", 250, 330, 330' have at least one stop orientation and at least one slide orientation. In a stop orientation, the supports 120, 130, 150, 160, 170, 230, 230', 230", 250, 330, 330' are relatively fixed in relation to the rails 110, 210, 210', 210", 310, 310'. (The "tightness" or "grip" necessary would be determined by the intended purpose of the adjustable storage racks 100, 200, 200', 200", 300, 300'.) In a slide orientation, the supports 120, 130, 150, 160, 170, 230, 230', 230", 250, 330, 330' are able to move relatively easily (slide) in relation to the rails 110, 210, 210', 210", 310, 310'. (The "slideability" necessary would be determined by the intended purpose of the adjustable storage racks 100, 200, 200', 200", 300, 300'.) Directional force (which can also be thought of as force or pressure) may be applied to the support (or the rail) to push or pull the rail past the snap ridge 144, 244, 244', 244", 264, 344, 344' to either transition the support from the stop orientation to the slide orientation or to transition the support from the slide orientation to the stop orientation. The amount of force necessary to transition would be determined by the intended use and affected by the material from which the supports are made and the size of the snap ridges.

In the stop orientation, the at least one rail 110, 210, 210', 210", 310, 310" is positioned in the stop sub-channel 143, 243, 243', 243", 263, 343, 343'. The outer perimeter surface of the rail and the inner perimeter surface of the stop sub-channel are preferably "partially nearly congruent." As an example, the outer perimeter surface of the rail and the inner perimeter surface of the stop sub-channel preferably partially have nearly the same cross-sectional shape and size. (Although preferred relative cross-sectional sizes and shapes are shown as being substantially similar, it would be possible, for example, for the shapes to be slightly different.) This allows the outer perimeter surface of the rail to fit relatively tightly within the inner perimeter surface of the stop sub-channel such that there is significant friction therebetween to prevent relative motion therebetween. Put yet another way, the inner perimeter surface of the stop sub-channel grips the outer perimeter surface of the rail. As mentioned, the "tightness" or "grip" necessary would be determined by the intended purpose of the adjustable storage racks 100, 200, 200', 200", 300, 300'.

In the slide orientation, the at least one rail 110, 210, 210', 210", 310, 310' is positioned in the slide sub-channel 145, 245, 245', 245", 265, 345, 345'. The outer perimeter surface of the rail is smaller (or a different shape) than the inner perimeter surface of the slide sub-channel to allow relative movement therebetween. As an example, there is a gap between the outer perimeter surface of the rail and the inner perimeter surface of the slide sub-channel. This allows the outer perimeter surface of the rail to fit relatively loosely within the inner perimeter surface of the slide sub-channel such that there is relatively minimal friction therebetween to allow relative motion therebetween. Put yet another way, the inner perimeter surface of the slide sub-channel does not grip the outer perimeter surface of the rail. As mentioned, the "slideability" necessary would be determined by the intended purpose of the adjustable storage racks 100, 200, 200', 200", 300, 300'.

Exemplary adjustable storage racks may be better understood with reference to the drawings, but these adjustable storage racks are not intended to be of a limiting nature. The same reference numbers are used throughout the drawings and description in this document to refer to the same or like parts. Some reference numbers (e.g., reference numbers ending with a prime symbol (') or a double prime symbol (")) refer to variations. Unless otherwise specified, all the variations may be referred to jointly by the general reference number (without the prime or double prime). Unless specified otherwise, the shown shapes and relative dimensions are preferred, but are not meant to be limiting unless specifically claimed, in which case they may limit the scope of that particular claim.

Before describing the adjustable storage racks and the figures, some of the terminology should be clarified. Please note that the terms and phrases may have additional definitions and/or examples throughout the specification. Where otherwise not specifically defined, words, phrases, and acronyms are given their ordinary meaning in the art. The following paragraphs provide basic parameters for interpreting terms and phrases used herein.

The term "possessions" and the phrase "rackable items" are defined to mean almost any type of "stuff." Kitchenware items and cookware items are used as examples of possessions and rackable items. Some rackable items may be hangable items.

The term "rail" is meant to mean an elongate member having a first end, a second end, and a length between the first end and the second end. The at least one rails 110, 210, 210', 210", 310, 310' are shown as having substantially consistent cross-sections (defined by an outer perimeter surface) along their length, although some variations are possible and, in some situations, could be beneficial (e.g., if there is a portion along the length where a support should not be positioned). Although the shown lengths have a fixed length, the lengths could be adjustable (e.g., portions of the length could be removed or additional lengths could be added). The rail may be other elongate structure such as a track or a pole.

The term "support" (and variations thereof) is used as a noun herein to refer to the supports 120, 130, 150, 160, 170, 230, 230', 230", 250, 330, 330' of the adjustable storage racks 100, 200, 200', 200", 300, 300'. Although "support" can also be used as a verb, in most situations the term "hold" (and variations thereof) is used herein as the verb to avoid confusion. It should be noted, however, that the supports 120, 130, 150, 160, 170, 230, 230', 230", 250, 330, 330' do, in fact, "support" rackable items. It should be noted that alternative stop-snap-slide channel systems could be defined in components other than supports.

The terms "overlapping" (and variations thereof) and "intersecting" (and variations thereof) are used to describe the relationship between the at least one stop sub-channel and the at least one slide sub-channel. The term "overlapping" means "extending over and covering a part of." The term "intersecting," for purposes of this specification, means "meeting and crossing at a point" and "sharing a common area." As used herein, the term "intersecting" implies that the intersection (and overlap) of the stop sub-channel and the slide sub-channel is at an angle (an "angled relationship") in which the sub-channels are not parallel to each other. Based on the definitions above, sub-channels described as overlapping can both intersect and overlap (e.g., the sub-channels 143, 145, 243, 245 of FIGS. 13 and 48) or, if the overlapping sub-channels are parallel, they only overlap (e.g., the sub-channels 243', 245', 243", 245" of FIGS. 54-55 and 58-60). Although not shown, intersecting sub-channels could extend beyond the meeting point or common area (e.g., forming an "X" shape) to provide additional surface area that could, for example, increase the "stop" (grip) of the stop sub-channel. Based on the definitions above, the sub-channels 243', 245', 243", 245" of FIGS. 54-55 and 58-60 overlap, but do not intersect because the sub-channels are parallel to each other. Put another way, FIGS. 54-55 and 58-60 show sub-channels 243', 245', 243", 245" that are parallel to each other, but are rotated such that they "overlap" in that parts of the sub-channels extend over or cover each other.

The phrase "intended purpose" is meant to take into consideration factors including, but not limited to, the type of possessions (including size(s), shape(s), weight(s) of the possessions) to be stored on the adjustable storage racks, the storage space (e.g., cabinet, drawers, shelves), the user (e.g., men, women, children), the cost of the materials and manufacturing, and/or other relevant factors. For example, storage racks to be used with kitchenware may need to be made from material that would not cause problems with food (e.g., food grade), but storage racks to be used with industrial tools might need industrial lubricant to keep the supports sliding on the rails under extreme conditions. Industrial lubricant would not be suitable for use with the kitchenware storage racks. In most cases, the kitchenware storage racks would not need to be as heavy-duty as the industrial tool storage racks. Storage racks to be used by children for toys might only be suitable for holding up to 10 or 20 pounds (children's toys are lighter than industrial tools) and/or would be easier to transition between the stop orientation and the slide orientation because children may not have the strength of adults (although the easier transitioning might not be necessary if the children were not supposed to handle the transitioning).

The term "congruent" is used to mean having the same shape and size (or having the same cross-sectional shape and size). The phrase "nearly congruent" is used to mean having almost (nearly) the same shape and size (or having nearly the same cross-sectional shape and size). As an example, an inner perimeter surface of the stop sub-channel that is nearly congruent with the outer perimeter surface of the rail is just slightly larger than the outer perimeter surface of the rail, but still provides a grip therearound to prevent movement therebetween. A nearly congruent inner perimeter surface of the stop sub-channel could also have a slightly different shape than the outer perimeter surface of the rail. The phrase "partially congruent" is used to mean having some portion (a majority, but not all) of the same shape and size. As an example, an inner perimeter surface of the stop sub-channel that is partially congruent with the rail does not completely surround the outer perimeter surface of the rail because of the passthrough defined between the snap ridges. The phrase "partially nearly congruent" is used to mean having some portion (a majority, but not all) of almost the same shape and size (or having almost the same cross-sectional shape and size). For example, the outer perimeter surface of the rail and the inner perimeter surface of the stop sub-channel are preferably partially nearly congruent in that the outer perimeter surface of the rail is just shy of the same size and shape of the inner perimeter surface of the stop sub-channel, and the inner perimeter surface of the stop sub-channel extends partially (but not completely) around the rail when the rail is positioned within the stop sub-channel. This allows the outer perimeter surface of the rail to fit relatively tightly within the inner perimeter surface of the stop sub-channel such that there is significant friction therebetween to prevent relative motion therebetween. Put yet another way, the inner perimeter surface of the stop sub-channel grips the outer perimeter surface of the rail.

The term "incongruent" is used to mean having a different shape and/or size (or having a different cross-sectional shape and/or size). The phrase "nearly incongruent" is used to mean having almost (nearly) a different shape and/or size (or having an almost different cross-sectional shape and/or size). As an example, an inner perimeter surface of the slide sub-channel that is nearly incongruent with the outer perimeter surface of the rail could have some portions that are congruent with the outer perimeter surface of the rail, but the majority would be incongruent. The phrase "partially incongruent" is used to mean having some portion (a majority, but not all) of a different shape and/or size. As an example, an inner perimeter surface of the slide sub-channel that is partially incongruent with the rail does not completely surround the outer perimeter surface of the rail because of the passthrough defined between the snap ridges. The phrase "partially nearly incongruent" is used to mean having some portion (a majority, but not all) of almost a different shape and/or size (or having almost a different cross-sectional shape and/or size). For example, the outer perimeter surface of the rail and the inner perimeter surface of the slide sub-channel are preferably partially nearly incongruent in that there is a gap therebetween to allow sliding therebetween, and/or the inner perimeter surface of the slide sub-channel extends partially (but not completely) around the rail when the rail is positioned within the slide sub-channel. This allows the outer perimeter surface of the rail to slide within the inner perimeter surface of the slide sub-channel with relatively little friction therebetween.

The term "associated" is defined to mean integral or original, retrofitted, attached, connected (including functionally connected), positioned near, and/or accessible by.

It should be noted that relative terms are meant to help in the understanding of the technology and are not meant to limit the scope of the invention. Similarly, unless specifically stated otherwise, the terms "first," "second," "third," and "fourth" are meant solely for purposes of designation and not for order or limitation. For example, the "exemplary preferred first hook support" has no order relationship with the "exemplary preferred fourth hook support."

It should be noted that some terms used in this specification are meant to be relative. For example, the term "top" is meant to be relative to the term "bottom," and the term "upper" is meant to be relative to the term "lower." The term "front" is meant to be relative to the term "rear" (and "back"), and the term "side" is meant to describe a "face" or "view" that connects the "front" and the "rear." As an example, regarding the description of the dual-purpose supports 120, 130, the front may be described as having upper side portions 122, 132 angled forward (upper side portions 122 are shown as projecting toward the viewer in FIG. 18, and upper side portions 132 are shown as projecting toward the viewer in FIG. 11) and the rear may be described as having upper side portions 122, 132 angled backward (upper side portions 132 are shown as projecting away from the viewer in FIG. 12, and upper side portions 122 would be the same). The designation of "front" and "rear," however, could be reversed. Rotation of the system or component that would change the designation might change the terminology, but not the concept.

Terms such as "may," "might," "can," and "could" are used to indicate alternatives and optional features and only should be construed as a limitation if specifically included in the claims. Claims not including a specific limitation should not be construed to include that limitation.

Unless specifically stated otherwise, the term "exemplary" is meant to indicate an example, representation, and/or illustration of a type. The term "exemplary" does not necessarily mean the best or most desired of the type. For example, an "exemplary support" may be replaced by a different support or modified support (e.g., made wider/narrower, rounding/angling edges, or changing the shape of the sub-channels to work with rails having alternative cross-sections) could be just as desirable.

It should be noted that, unless otherwise specified, the term "or" is used in its nonexclusive form (e.g., "A or B" includes, but is not limited to, A, B, A and B, or any combination thereof). It should be noted that, unless otherwise specified, "and/or" is used similarly (e.g., "A and/or B" includes, but is not limited to, A, B, A and B, or any combination thereof). It should be noted that, unless otherwise specified, the terms "includes," "has," and "contains" (and variations of these terms) mean "comprises" (e.g., a device that "includes," "has," or "contains" A and B, comprises A and B, but optionally may contain C or additional components other than A and B).

It should be noted that, unless otherwise specified, the singular forms "a," "an," and "the" refer to one or more than one, unless the context clearly dictates otherwise. Similarly, unless specifically limited, the use of singular language (e.g., "component" or "step") may include plurals (e.g., "components" or "steps"), unless the context clearly dictates otherwise.

FIGS. 1-40:

FIGS. 1-40 show an exemplary preferred storage rack 100 in various configurations as well as components thereof. The storage rack 100 is shown with two rails 110 and a plurality of dual-purpose supports 120, 130. The rails 110 are shown with a circular cross-section. The shown dual-purpose supports 120, 130 each have stop-snap-slide channels 140 through which the rails 110 are positioned. The stop-snap-slide channels 140 include a stop sub-channel 143 and a slide sub-channel 145 that at least partially longitudinally overlap and intersect at an angle. As shown, the outer perimeter surface of the rail 110 and the inner perimeter surface of the stop sub-channel 143 are preferably partially nearly congruent such that when the rail 110 is positioned within the stop sub-channel 143 there is significant friction therebetween to prevent relative motion therebetween. As shown, the outer perimeter surface of the rail 110 and the inner perimeter surface of the slide sub-channel 145 are preferably partially nearly incongruent in that there is a gap therebetween to allow sliding therebetween. Put another way, using the stop-snap-slide channels 140, the dual-purpose supports 120, 130 can be held in position in relation to the rails 110 (when the rails 110 are in their respective stop sub-channels 143) or slide on the rails 110 (when the rails 110 are in their respective slide sub-channels 145).

Figure 1:
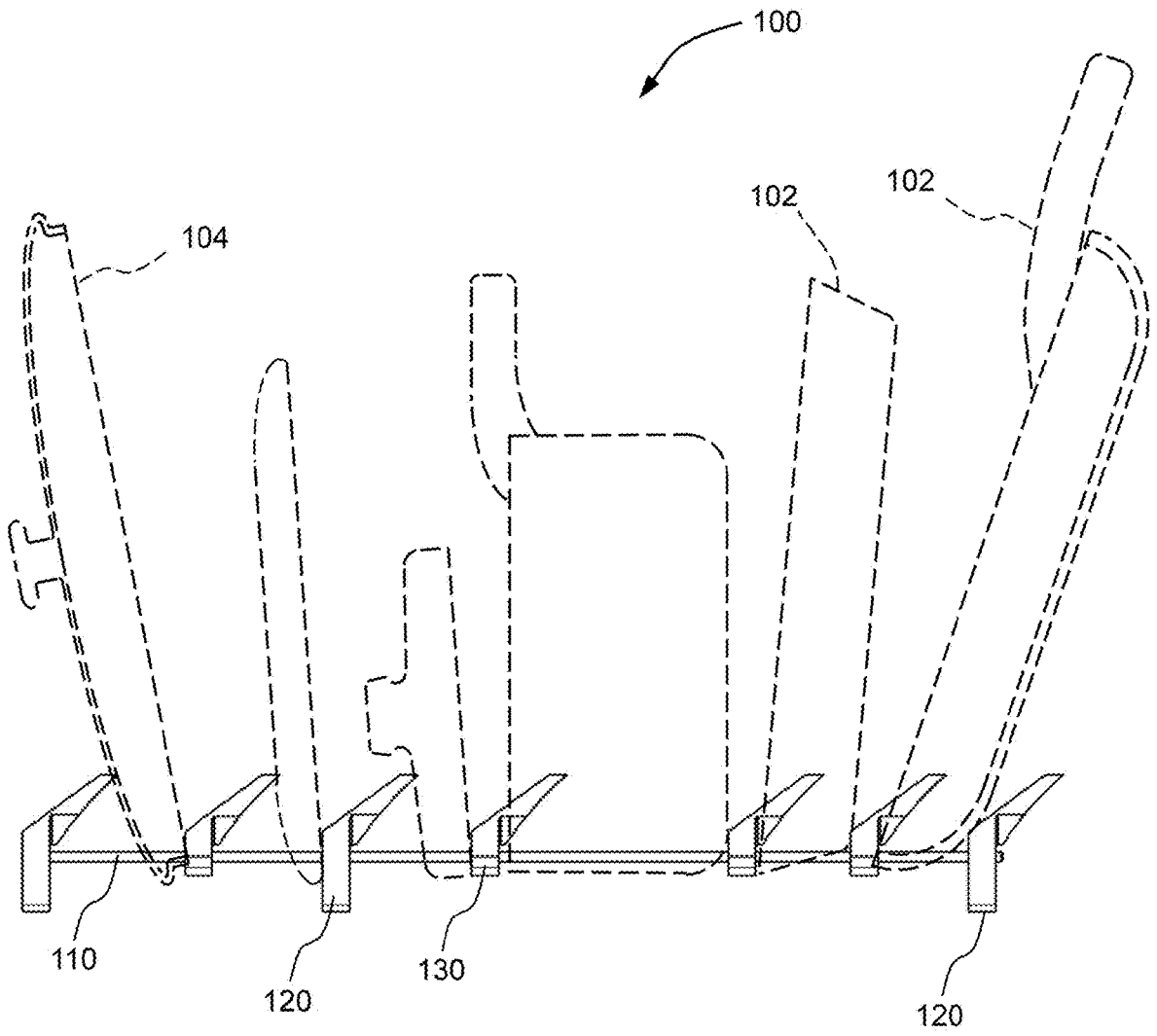
FIG. 1 is a side view of an exemplary preferred storage rack in an exemplary preferred first configuration, exemplary preferred dual-purpose supports holding exemplary rackable items (shown in dashed lines).
Figure 2:
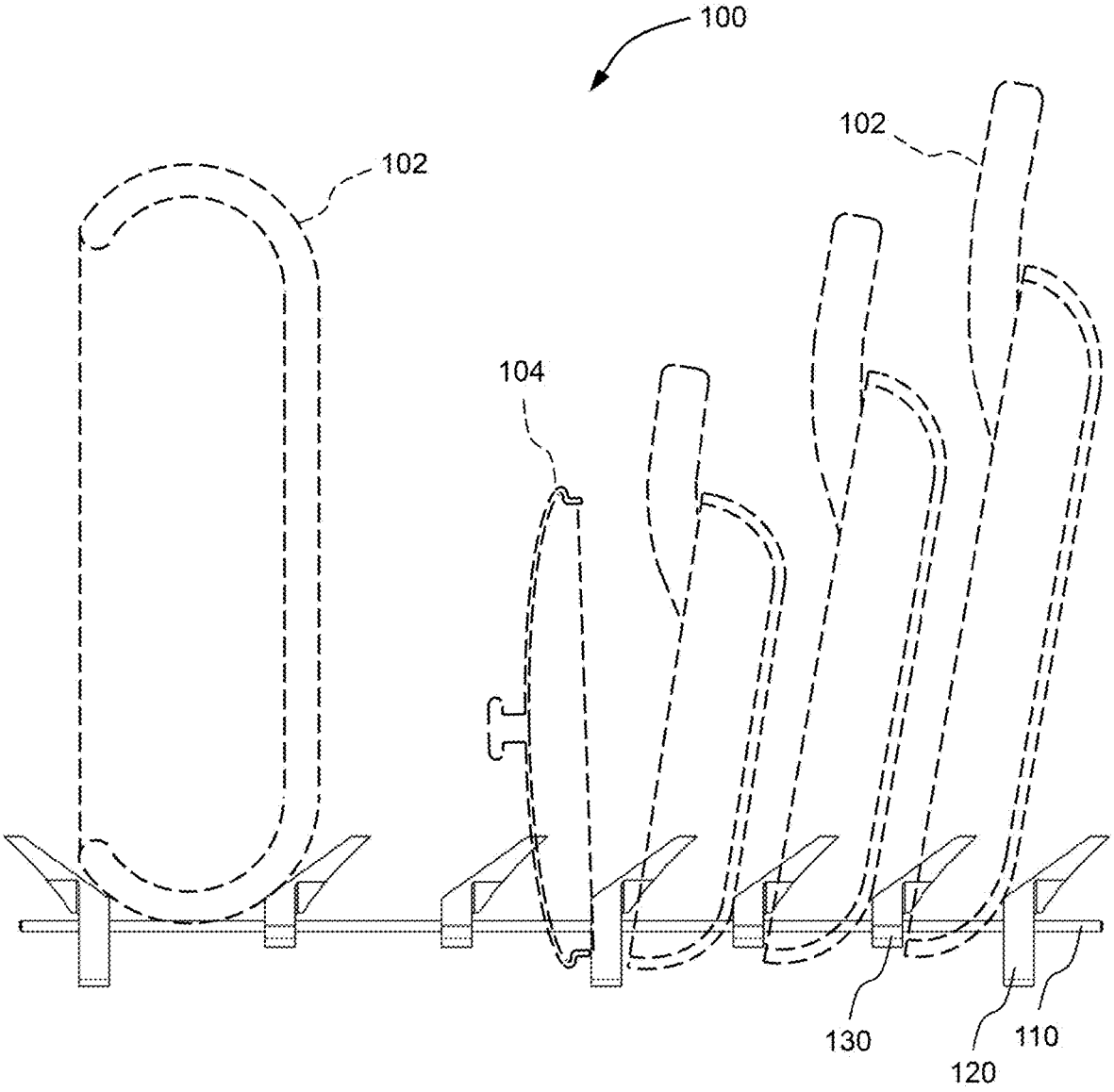
FIG. 2 is a side view of the exemplary preferred storage rack in an exemplary preferred second configuration, exemplary preferred dual-purpose supports holding exemplary rackable items (shown in dashed lines).
Figure 35:
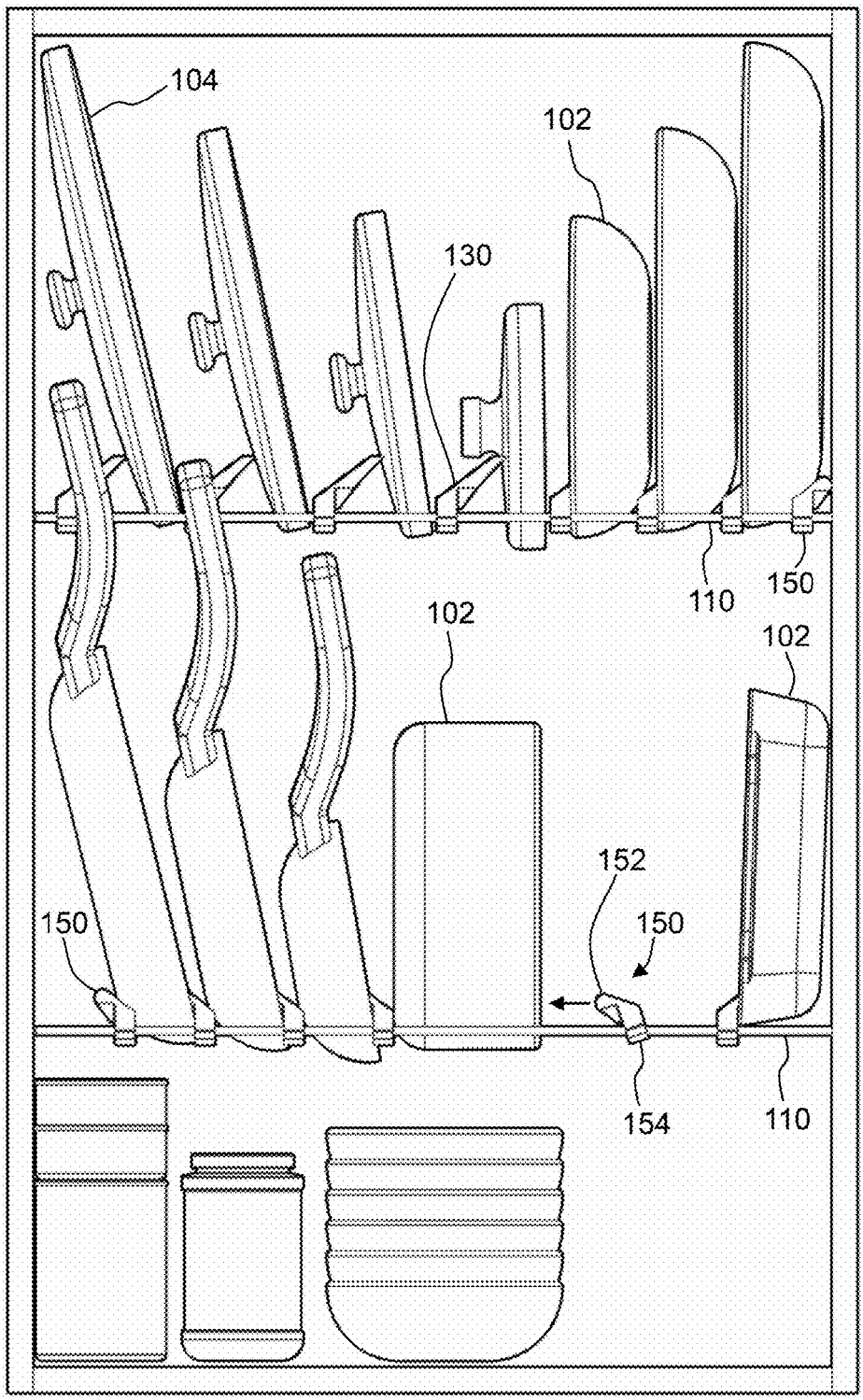
FIG. 35 is a side view of exemplary preferred storage racks in alternative exemplary preferred configurations in a cabinet, exemplary rackable items being held by exemplary preferred dual-purpose supports.
Figure 36:
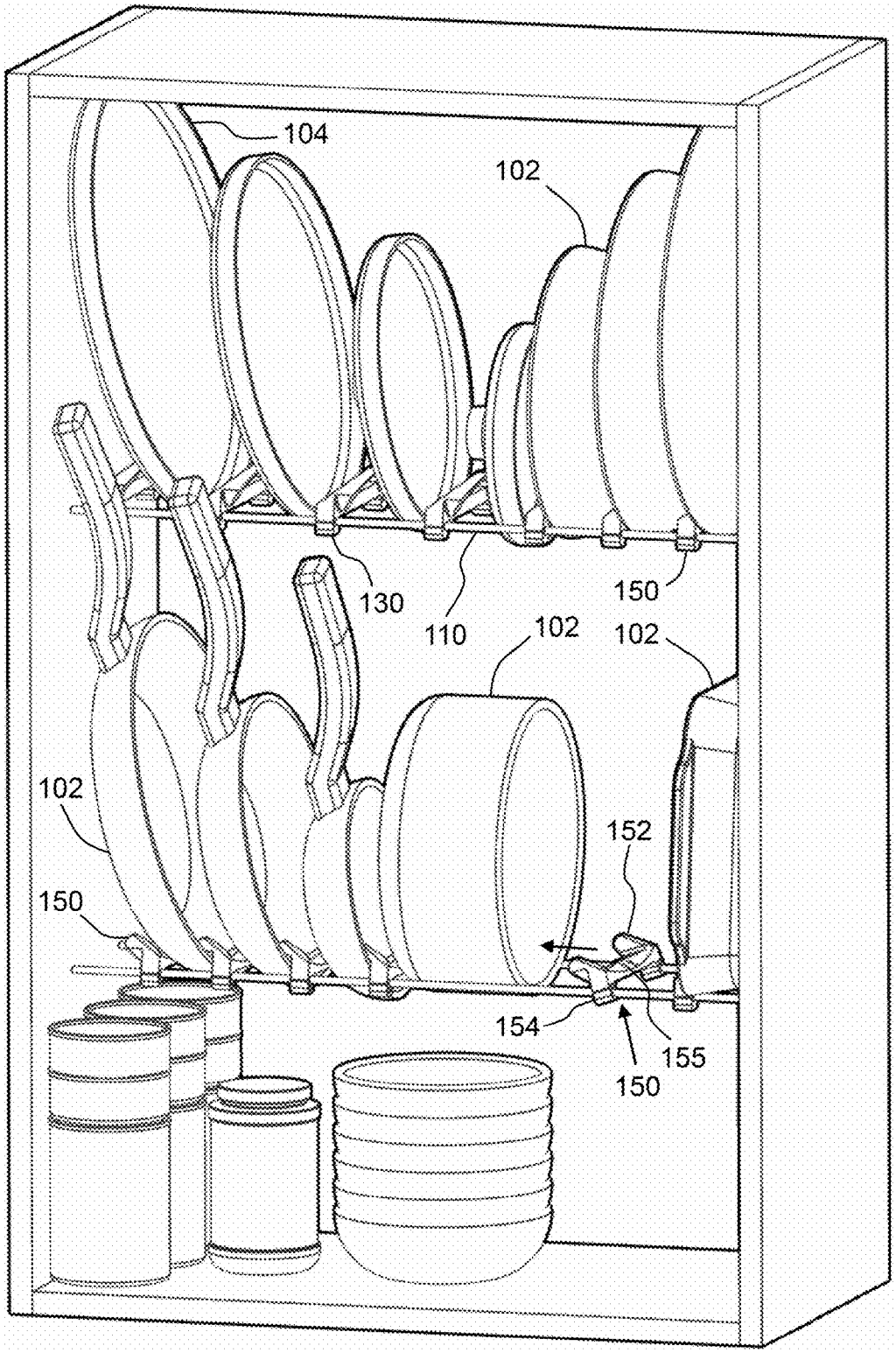
FIG. 36 is a perspective side view taken from a first side of exemplary preferred storage racks in alternative exemplary preferred configurations in a cabinet, exemplary rackable items being held by exemplary preferred dual-purpose supports.
Figure 37:
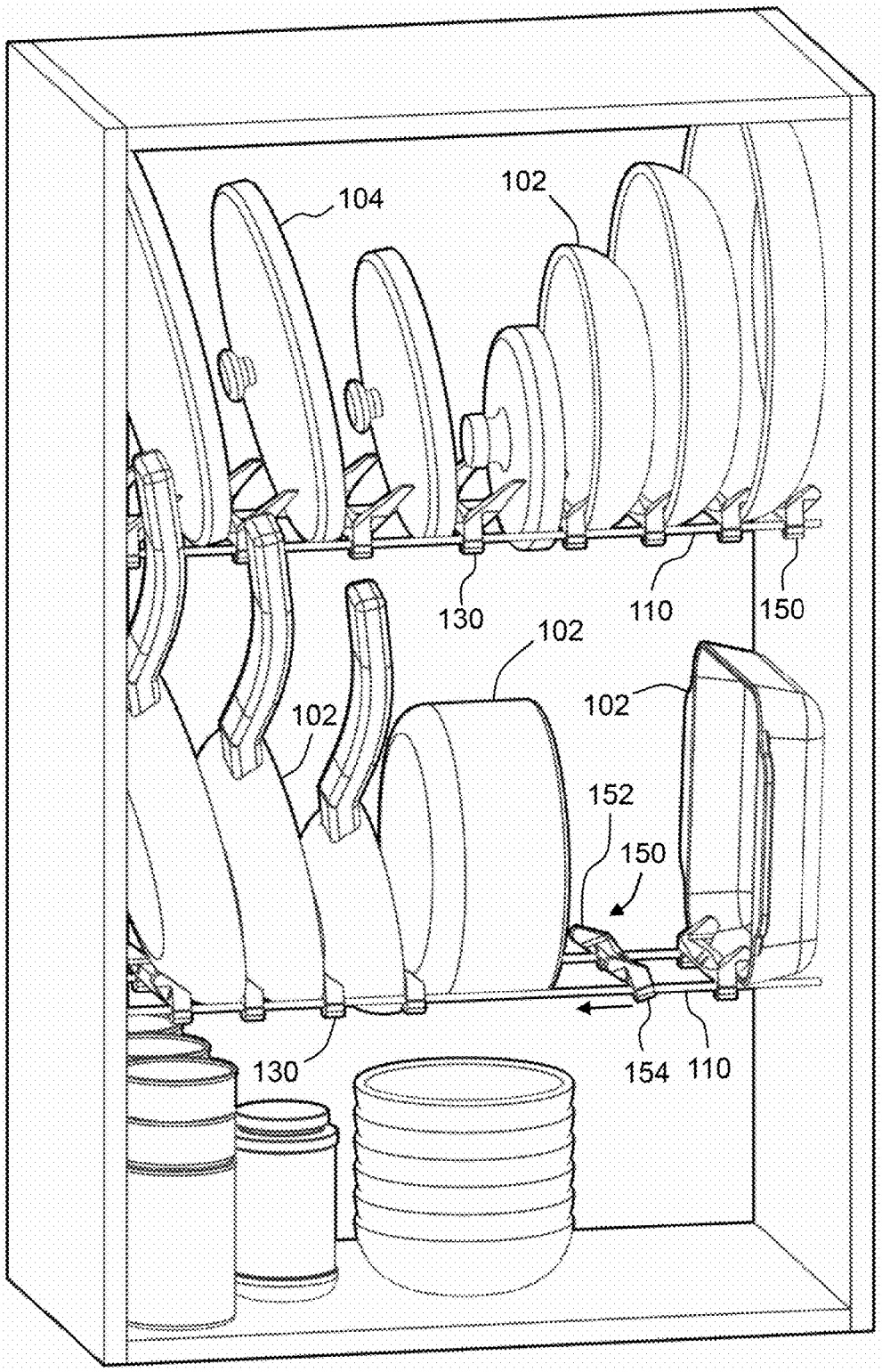
FIG. 37 is a perspective side view taken from a second side of exemplary preferred storage racks in alternative exemplary preferred configurations in a cabinet, exemplary rackable items being held by exemplary preferred dual-purpose supports.

The dual-purpose supports 120 and dual-purpose supports 130 are similar except that the dual-purpose supports 120 have elongated legs to raise the rails 110 above a supporting surface (e.g., a shelf) upon which the storage rack 100 is positioned. As shown in FIGS. 1-2, the dual-purpose supports 120 may be positioned near the ends of the rails 110, but may also be positioned at central locations thereof to provide additional structural support. Some storage racks may use only dual-purpose supports 130. As shown in FIGS. 35-37, if the rails 110 are suspended on both ends, the dual-purpose supports 120 may be omitted. Although not shown, some storage racks may use only dual-purpose supports 120. The shown quantities of dual-purpose supports 120, 130 are meant to be exemplary. Further, dual-purpose supports 120, 130 may be added or removed.

FIGS. 1-40 show dual-purpose supports 120, 130, 150 (FIGS. 35-37), 160 (FIGS. 38-40), 170 (FIGS. 38-40) that are able to hold (support) concave cookware items 102, 104 from either (or both) the front face or the rear face (the "dual-purpose"). The dual-purpose supports have upper portions (122, 132, 152 (FIG. 35), 162 (FIG. 40), 172 (FIG. 40)) that are at an angle relative to lower portions (124, 134, 154 (FIG. 35), 164 (FIG. 40), 174 (FIG. 40)). Preferred angles are approximately 30 degrees to 60 degrees, but could be at smaller or larger angles depending on the intended use. As shown in FIG. 1, some rackable items (e.g., relatively shallow cookware items 104, such as lids) can be held between the front of one support (at or near the top of the upper portion on the front face (bending forward)) and the rear of an adjacent support (the lower portion of the rear face (bending backward)). As also shown in FIGS. 1-2 (and in more detail in FIGS. 16-18), other rackable items (e.g., relatively deep cookware items 102, such as pots and pans) can be held between the rear of one support (e.g., against a rear face of the spanning member 125, 135 with optional bumper(s) 128, 138 thereon, the spanning member 125, 135 also referred to as a leaning brace) and the front of another support (e.g., against a front face at the movement-limiting notch 126, 136 (shown in detail in FIGS. 13-15) between the upper portion and the lower portion). As shown in FIG. 2, some relatively deep cookware items 102 can be held between the upper portions of the rear faces of two adjacent dual-purpose supports 120, 130. Although not shown, some cookware items 102, 104 can be held between the upper portions of the front faces of two adjacent dual-purpose supports 120, 130. As shown in FIGS. 1-2, the same dual-purpose supports 120, 130 can at least assist in holding one cookware item 102, 104 with its front face and another cookware item 102, 104 with its rear face.

FIGS. 1-2 show the exemplary preferred storage rack 100 in various configurations holding exemplary rackable items (shown as cookware items 102, 104 in dashed lines). The differences between the shown configurations are meant to be exemplary as there are limitless configurations. The configurations may be dictated by the specific rackable items that are meant to be held in the storage rack 100. Exemplary differences include, but are not limited to, different quantities of dual-purpose supports 120, 130 (e.g., more dual-purpose supports 120 if heavier rackable items are to be held in the storage rack 100), different spacing between the dual-purpose supports 120, 130, and different orientations of the dual-purpose supports 120, 130 (e.g., the dual-purpose supports 120, 130 can be reversed as shown in FIG. 2).

Figure 3:
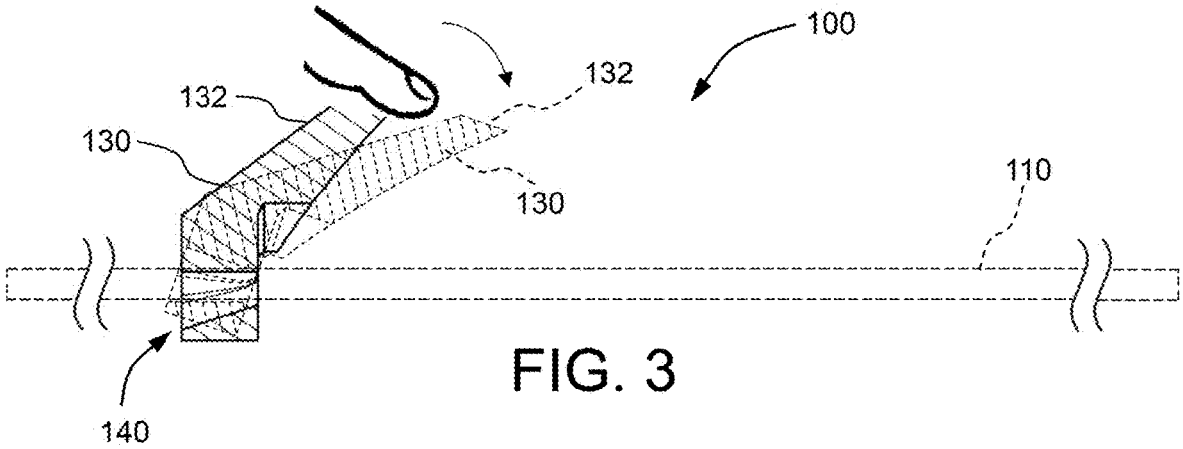
FIG. 3 is a partial cross-sectional side view of the exemplary preferred storage rack, the exemplary preferred dual-purpose support in a stop orientation (solid lines) and transitioning to a slide orientation (dashed lines).
Figure 4:
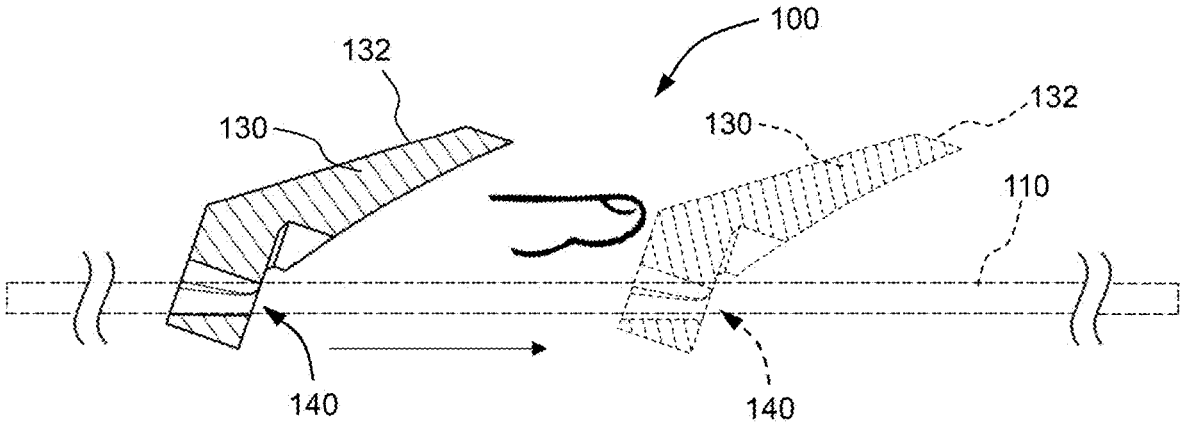
FIG. 4 is a partial cross-sectional side view of the exemplary preferred storage rack, the exemplary preferred dual-purpose support in a slide orientation sliding from a first location (solid lines) to a second location (dashed lines).
Figure 5:
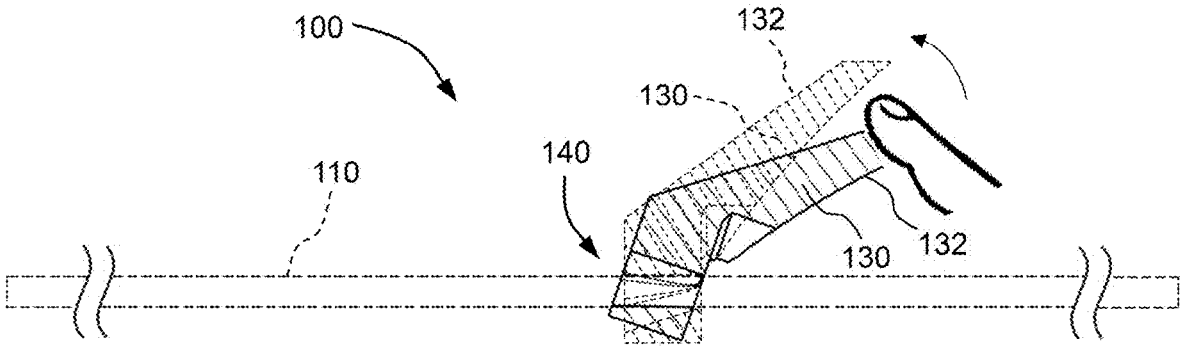
FIG. 5 is a partial cross-sectional side view of the exemplary preferred storage rack, the exemplary preferred dual-purpose support in a slide orientation (solid lines) and transitioning to a stop orientation (dashed lines).

FIGS. 3-5 show the movement of a dual-purpose support 130 along the rails 110. In particular, FIG. 3 shows the dual-purpose support 130 in a stop orientation (solid lines) and transitioning to a slide orientation (dashed lines), FIG. 4 shows the preferred dual-purpose support 130 in a slide orientation sliding from a first location (solid lines) to a second location (dashed lines), and FIG. 5 shows the dual-purpose support in a slide orientation (solid lines) and transitioning to a stop orientation (dashed lines). Each rail 110 is positioned within the stop-snap-slide channel 140. As shown in FIG. 3, a downward force (shown as being pushed generally downward by a finger) is placed on the upper side portion 132 of the dual-purpose support 130 to transition the dual-purpose support 130 from the stop orientation (solid lines) to the slide orientation (dashed lines). As shown in FIG. 4, a horizontal force (shown as being pushed horizontally by a finger) is placed on the dual-purpose support 130 (now in the slide orientation) to move (slide) the dual-purpose support 130 from the first location (solid lines) to the second location (dashed lines). As shown in FIG. 5, an upward force (shown as being pushed generally upward by a finger) is placed on the upper side portion 132 of the dual-purpose support 130 to transition the dual-purpose support 130 from the slide orientation (solid lines) to the stop orientation (dashed lines). It should be noted that in actual use the "force" (or pressure) may be applied differently than shown. For example, the force may be applied to both upper side portions 132 of the dual-purpose support 130. Another difference is that the "force" may be applied in reverse. For example, instead of using a finger to push generally downward, the downward force may be applied from the opposite side by pulling generally downward. Also, depending on hand strength, more than one finger may be required to provide the requisite force. Finally, the angle of the force may depend on the shape of the stop-snap-slide channel, and there may be a tolerance to allow the angle of force to vary.

Figure 6:
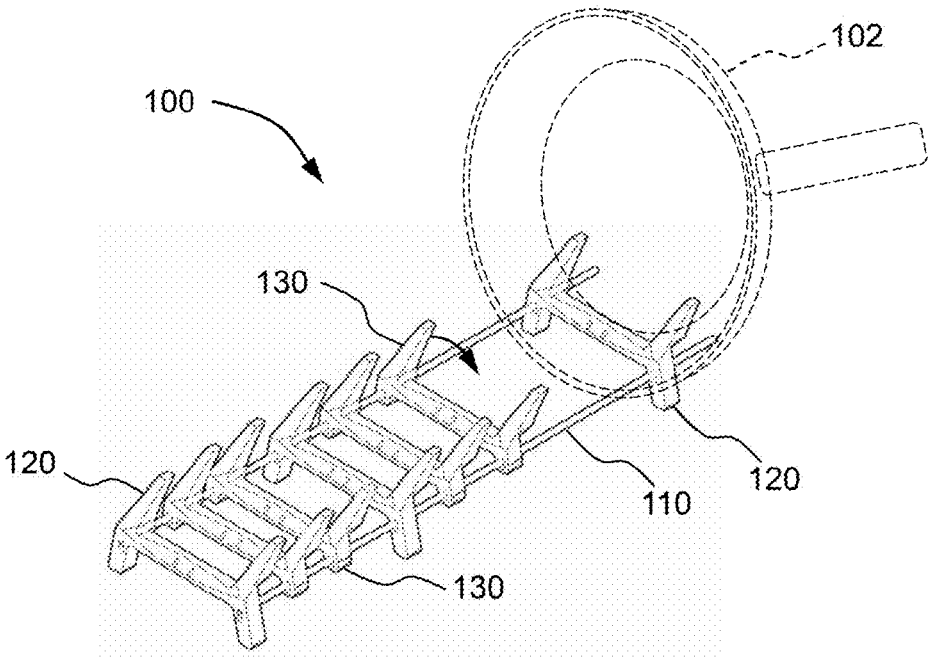
FIG. 6 is a rear-side perspective view of the exemplary preferred storage rack, the exemplary preferred dual-purpose support in a stop orientation with an arrow indicating the transition to a slide orientation (as shown in FIG. 3).
Figure 7:
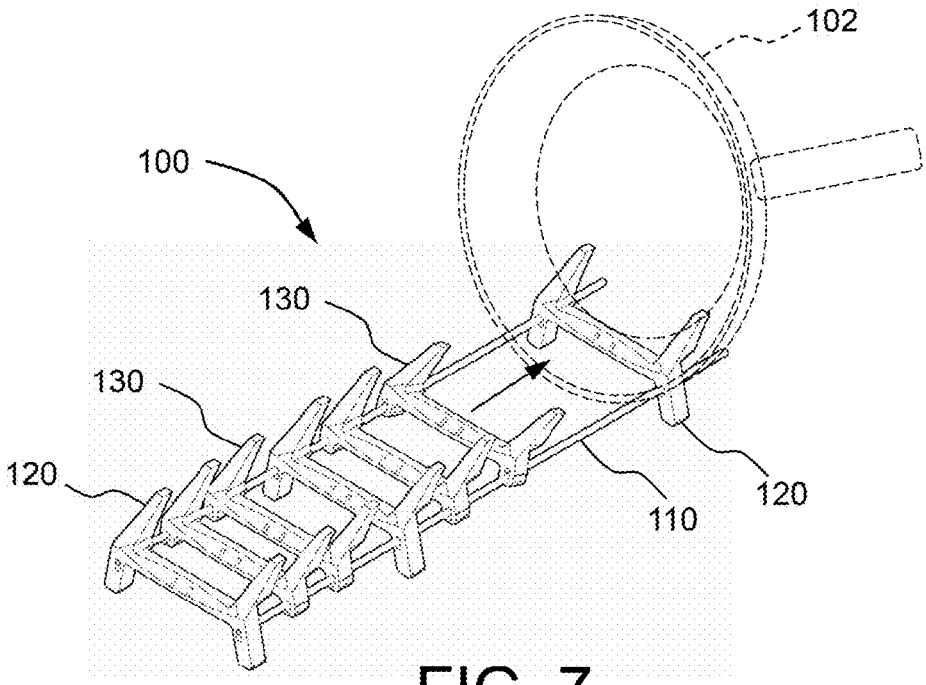
FIG. 7 is a rear-side perspective view of the exemplary preferred storage rack, the exemplary preferred dual-purpose support in a slide orientation in a first location (as shown in solid lines in FIG. 4) with an arrow indicating the direction of sliding.
Figure 8:
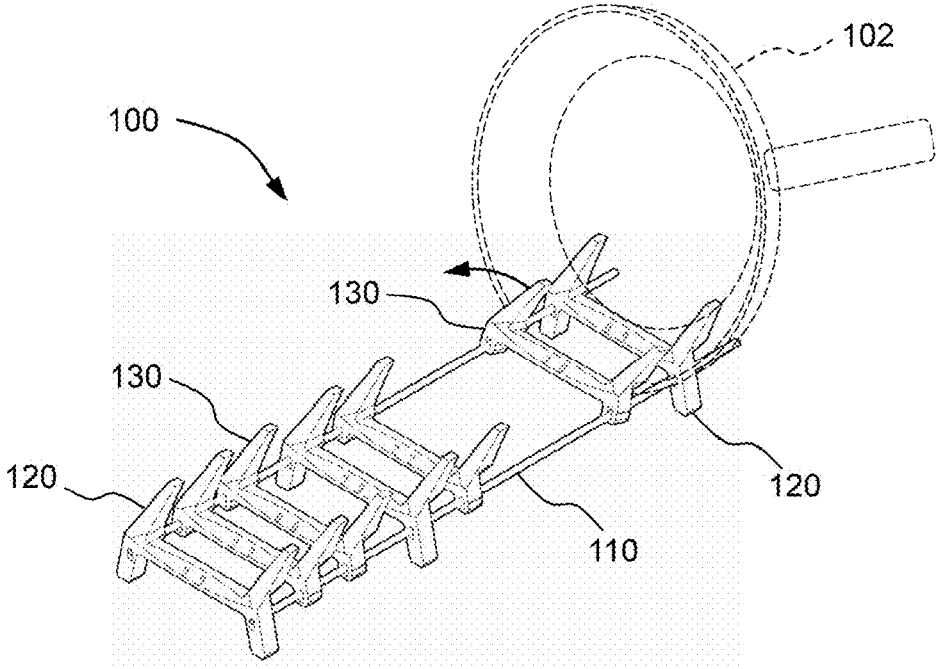
FIG. 8 is a rear-side perspective view of the exemplary preferred storage rack, the exemplary preferred dual-purpose support in a slide orientation in a second location (as shown in dashed lines in FIG. 4) with an arrow indicating the transition to a stop orientation.
Figure 9:
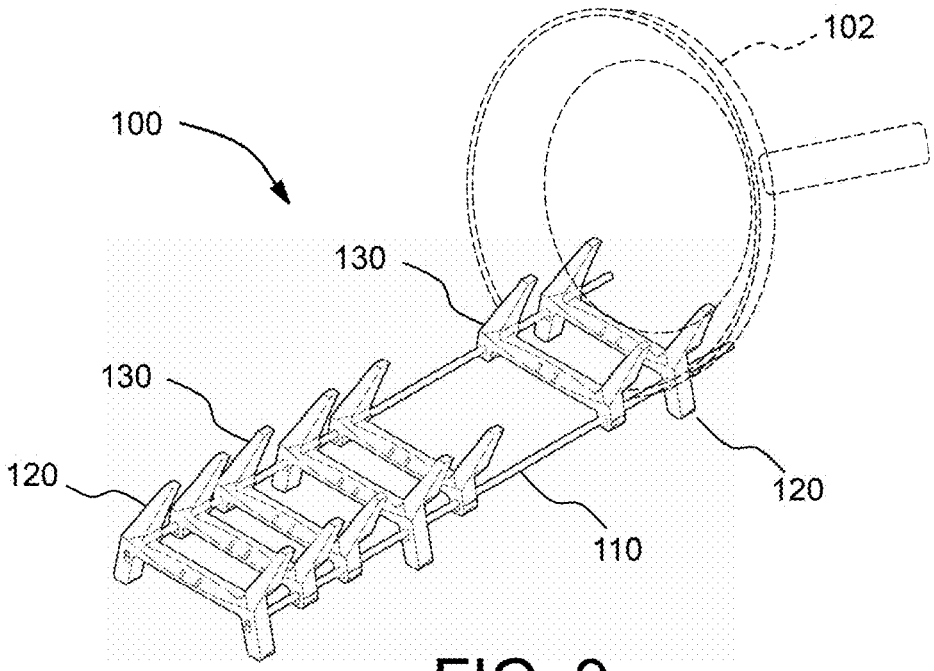
FIG. 9 is a rear-side perspective view of the exemplary preferred storage rack, the exemplary preferred dual-purpose support in a stop orientation in a second location (as shown in dashed lines in FIG. 5).

FIGS. 6-9 show the movement of a dual-purpose support 130 along the rails 110 to secure a cookware item (pan 102) in the storage rack 100. FIG. 6 shows the exemplary preferred dual-purpose support 130 in a stop orientation with an arrow indicating the transition to a slide orientation (as shown in FIG. 3). The pan 102 is shown as being temporarily held by the preferred dual-purpose support 120. FIG. 7 shows the exemplary preferred dual-purpose support 130 in a slide orientation in a first location (as shown in solid lines in FIG. 4) with an arrow indicating the direction of sliding. The presence of the pan 102 can be helpful in limiting how far the dual-purpose support 130 can slide and provides a guide to the exact placement of the dual-purpose support 130 to hold the pan 102. FIG. 8 shows the exemplary preferred dual-purpose support 130 in a slide orientation in a second location (as shown in dashed lines in FIG. 4) with an arrow indicating the transition to a stop orientation. FIG. 9 shows the exemplary preferred dual-purpose support in a stop orientation in a second location (as shown in dashed lines in FIG. 5). In FIG. 9, the pan 102 is now held in the storage rack 100 between the dual-purpose support 130 and the dual-purpose support 120.

Figure 14:
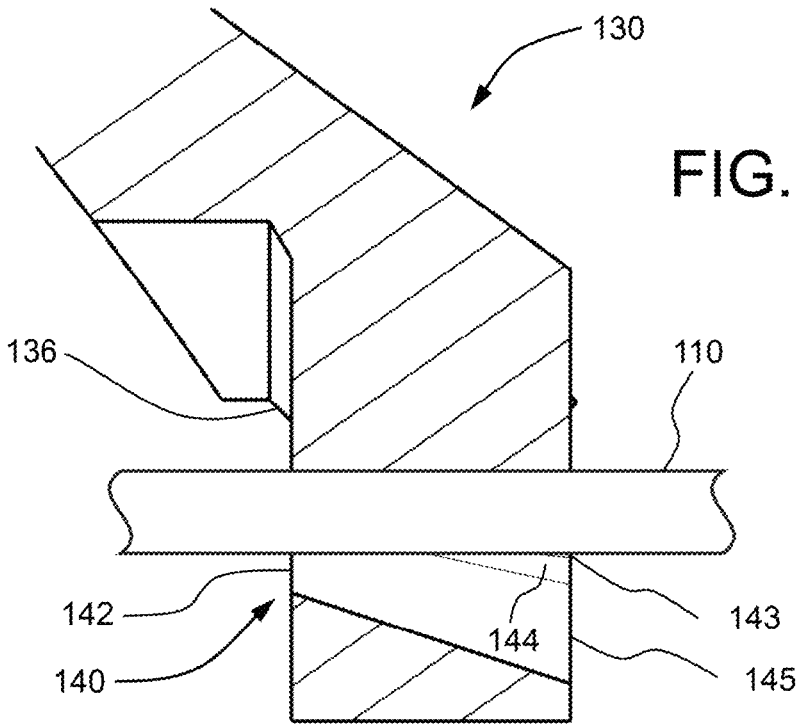
FIG. 14 is a cross-sectional side view of a leg of the exemplary preferred dual-purpose support of FIG. 11, a rail positioned through the length of the stop sub-channel of the stop-snap-slide channel.
Figure 15:
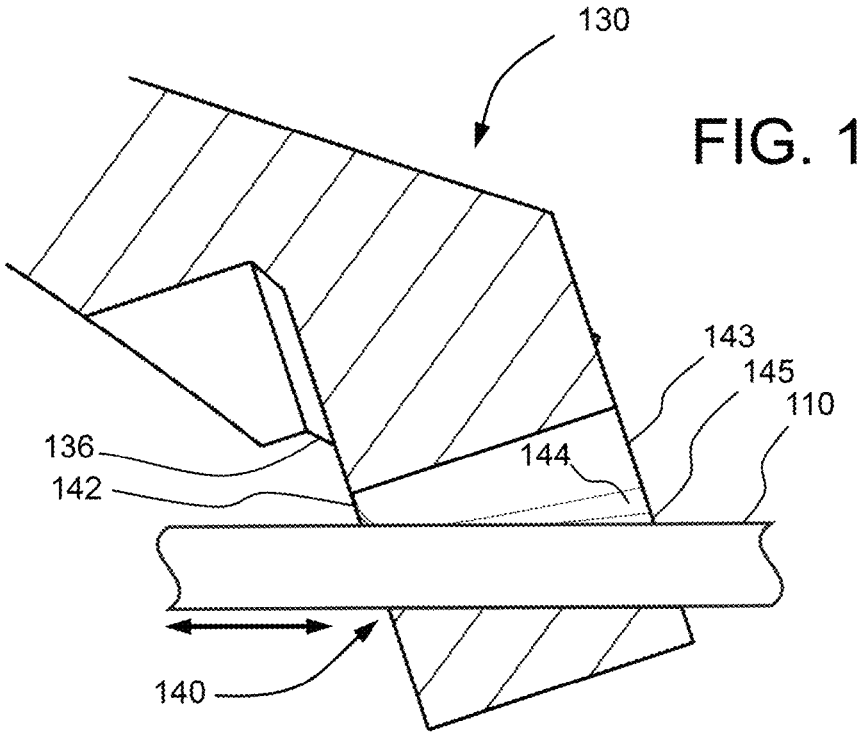
FIG. 15 is a cross-sectional side view of a leg of the exemplary preferred dual-purpose support of FIG. 11, a rail positioned through the length of the slide sub-channel of the stop-snap-slide channel.
Figure 16:
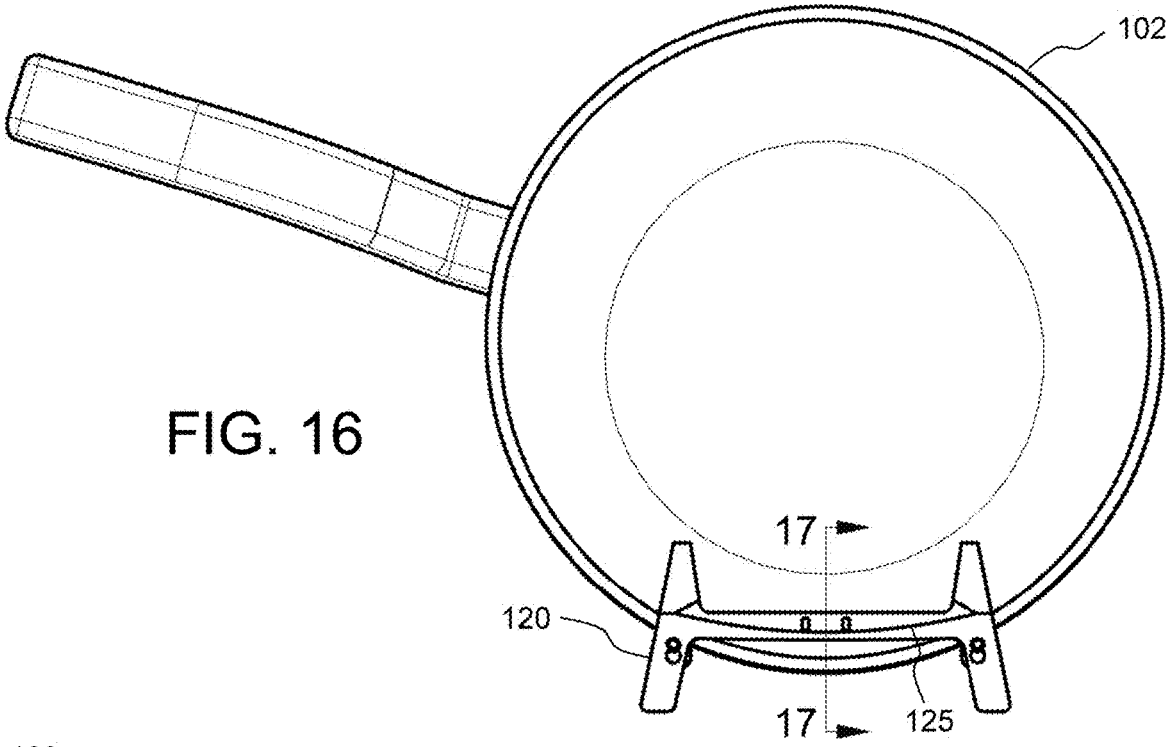
FIG. 16 is a rear view of the exemplary preferred storage rack, the storage rack having exemplary rackable items held therein.
Figure 17:
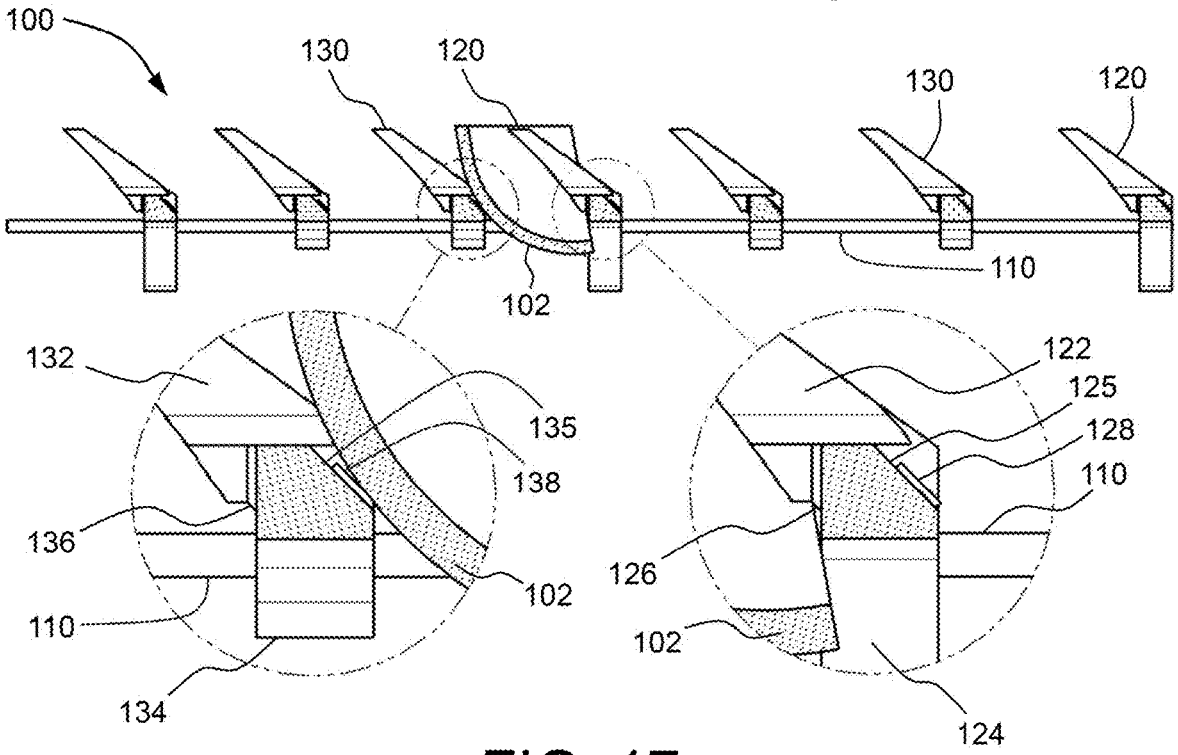
FIG. 17 is a cross-sectional side view of the exemplary preferred storage rack taken along line 17-17 of FIG. 16, a first enlarged detail showing an exemplary rackable item leaning against a spanning member (leaning brace) of the exemplary preferred dual-purpose support and a second enlarged detail showing a movement-limiting notch of the exemplary preferred dual-purpose support.
Figure 18:
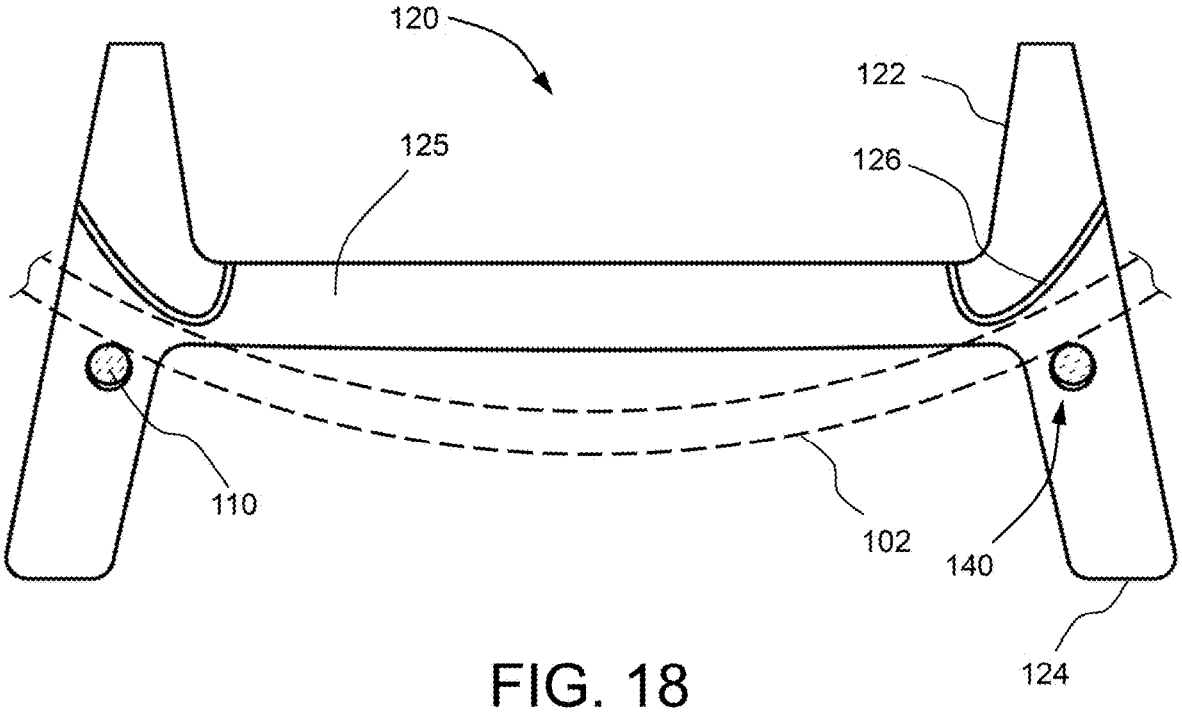
FIG. 18 is a partial cross-sectional view of the exemplary preferred storage rack holding an exemplary rackable item, the rim of the rackable item positioned between the rails and the movement-limiting notches of the exemplary preferred dual-purpose support.
Figure 19:
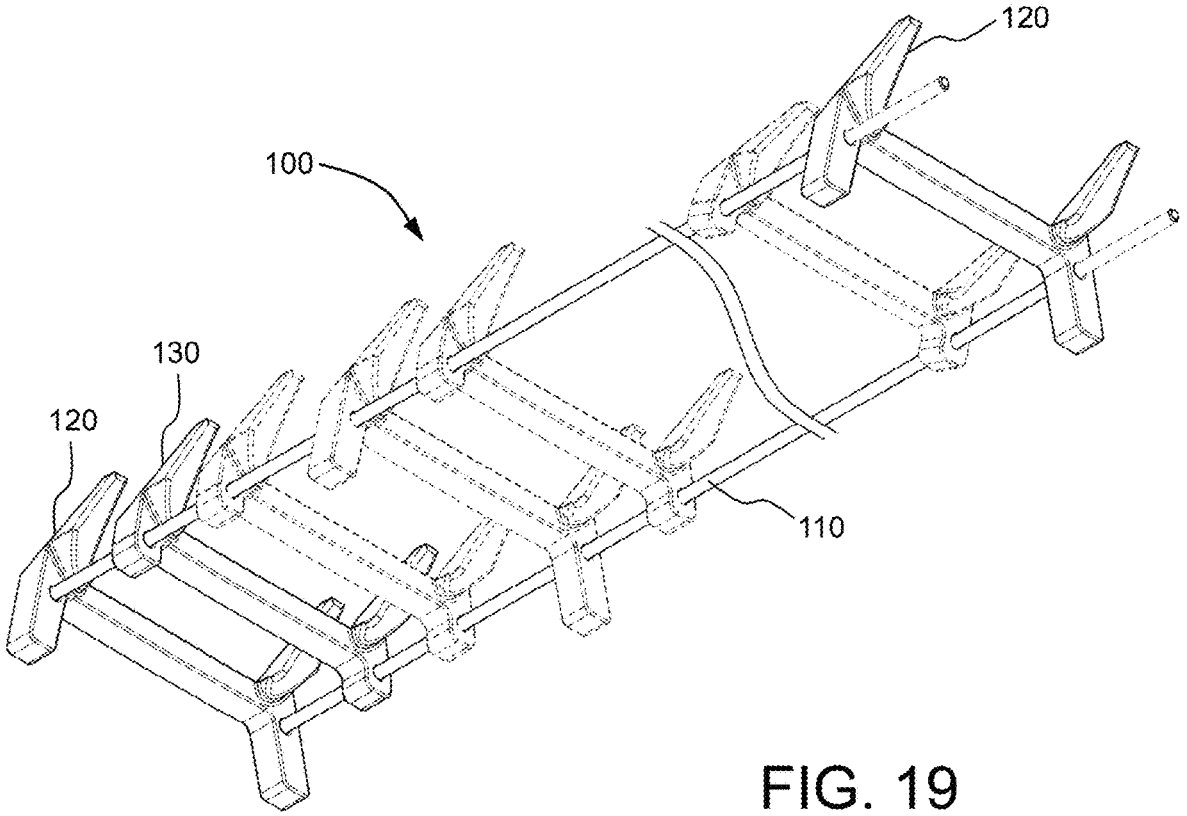
FIG. 19 is a front-side isometric view of an exemplary preferred storage rack looking upward.
Figure 20:
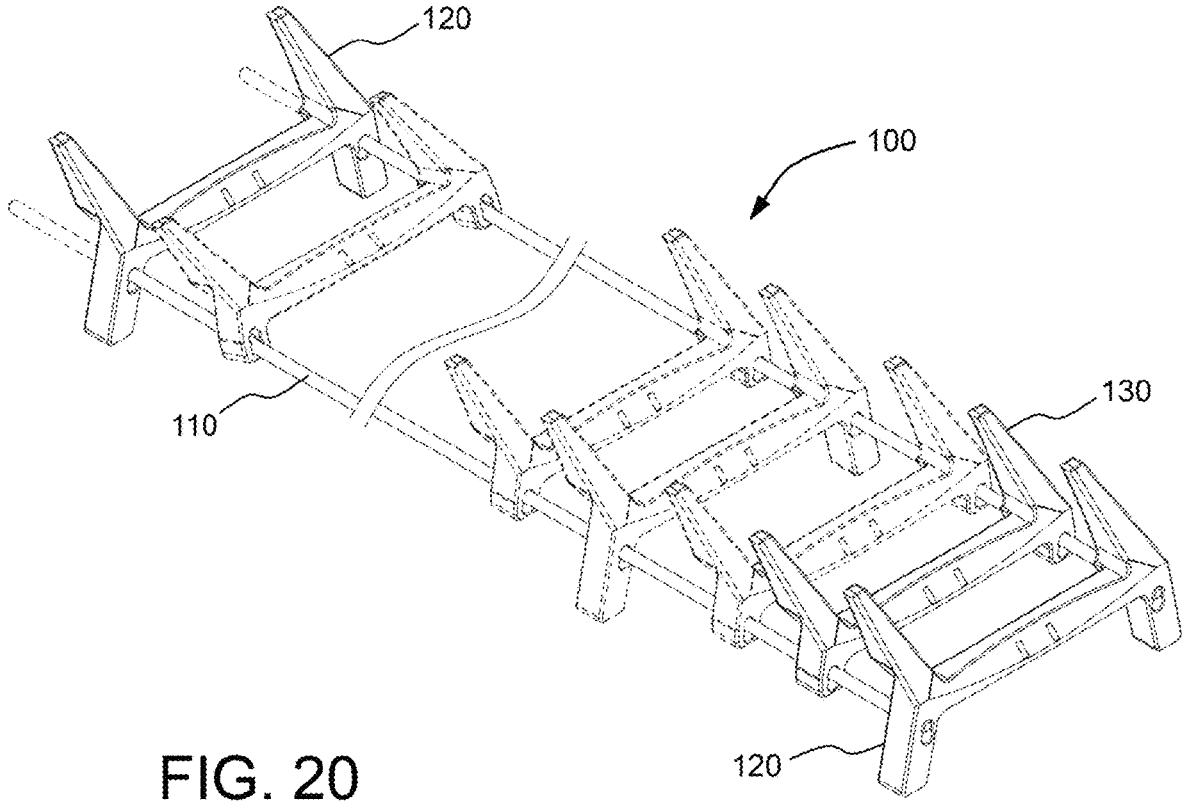
FIG. 20 is a rear-side isometric view of the exemplary preferred storage rack looking downward.
Figure 21:
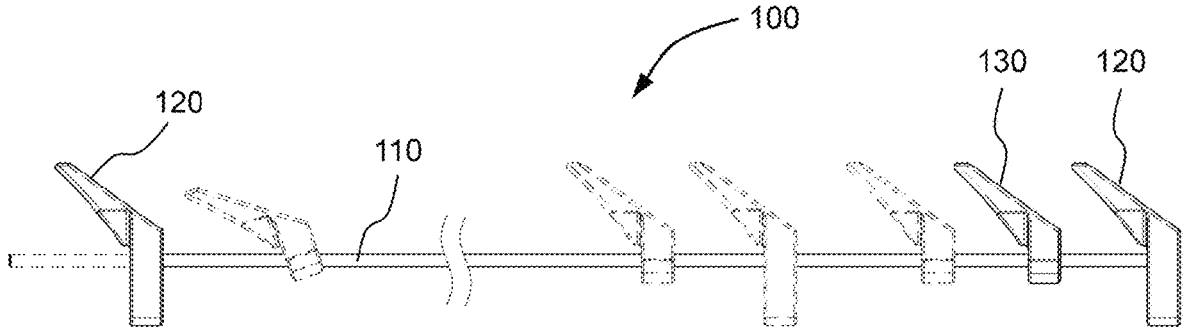
FIG. 21 is a first side view of the exemplary preferred storage rack.
Figure 22:
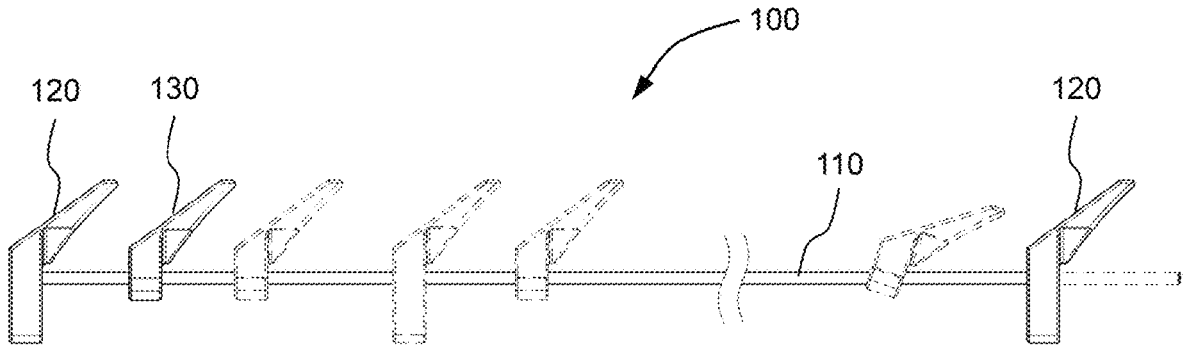
FIG. 22 is a second side view of the exemplary preferred storage rack.
Figure 23:
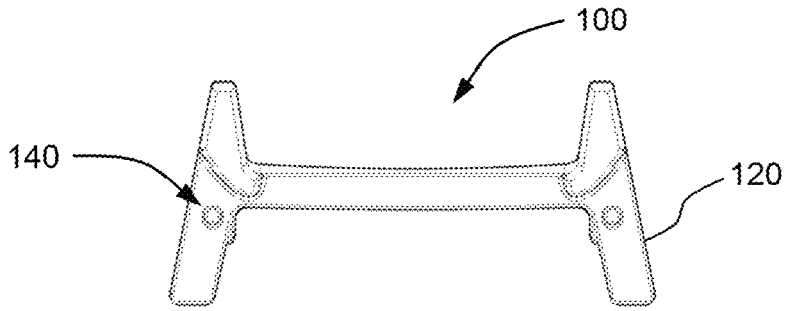
FIG. 23 is a front view of the exemplary preferred storage rack.
Figure 24:
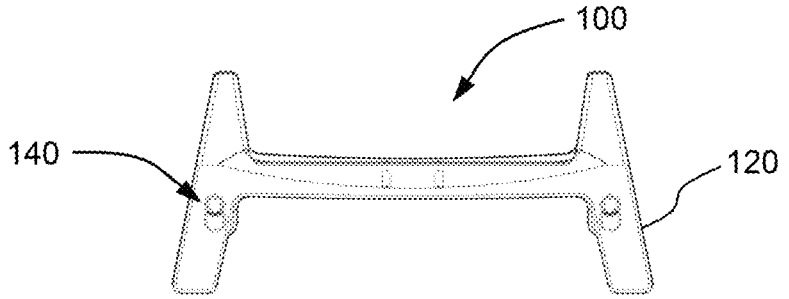
FIG. 24 is a rear view of the exemplary preferred storage rack.
Figure 25:
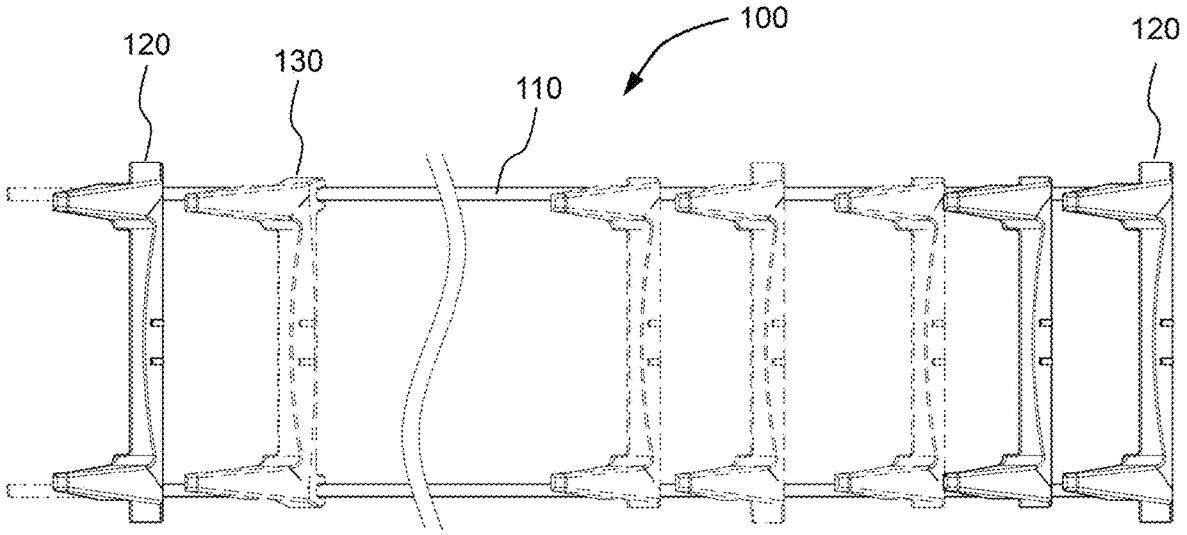
FIG. 25 is a top view of the exemplary preferred storage rack.
Figure 26:
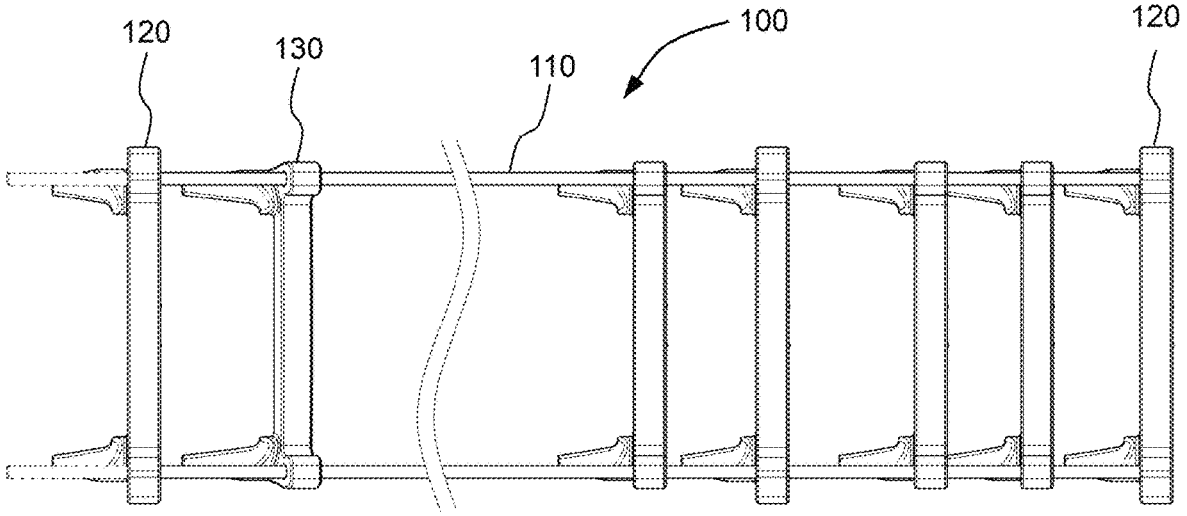
FIG. 26 is a bottom view of the exemplary preferred storage rack.
Figure 27:
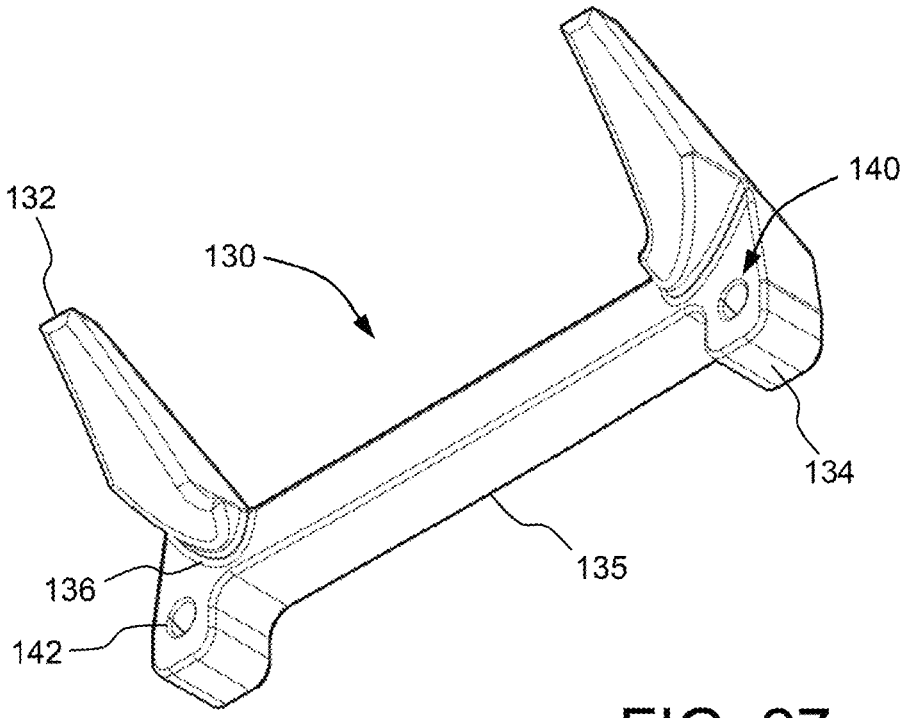
FIG. 27 is a front isometric view of an exemplary preferred dual-purpose support looking upward.
Figure 28:
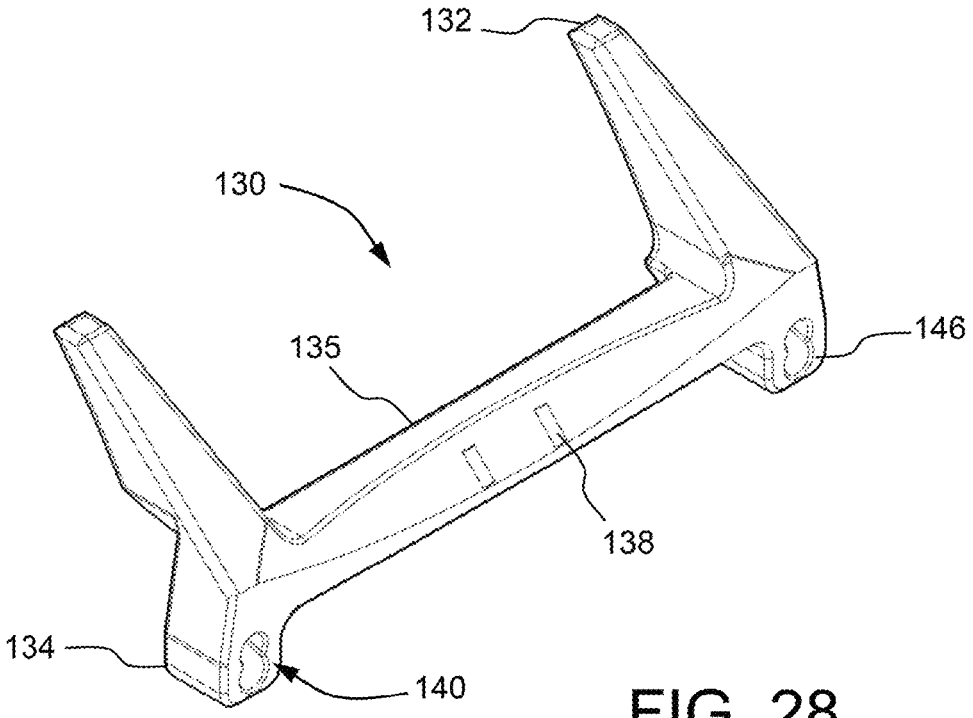
FIG. 28 is a rear isometric view of the exemplary preferred dual-purpose support looking downward.
Figure 29:
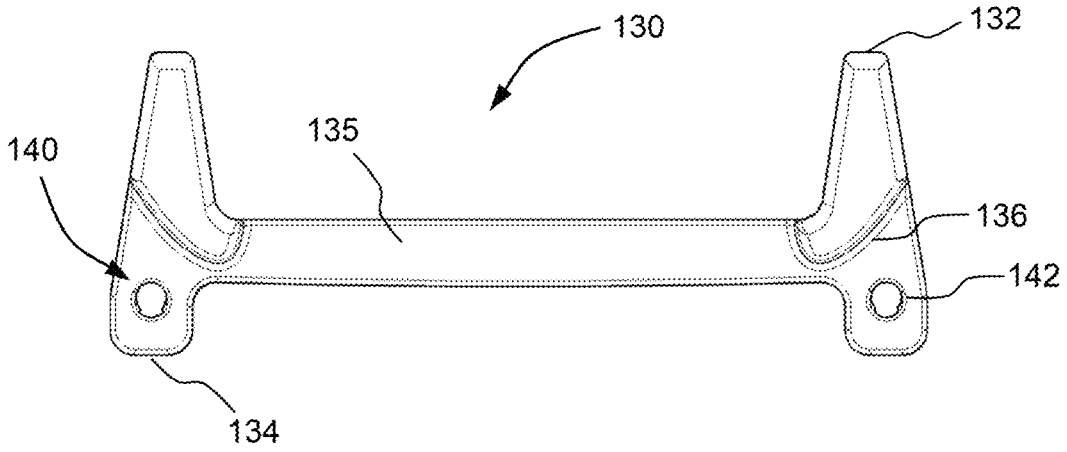
FIG. 29 is a front view of the exemplary preferred dual-purpose support.
Figure 30:
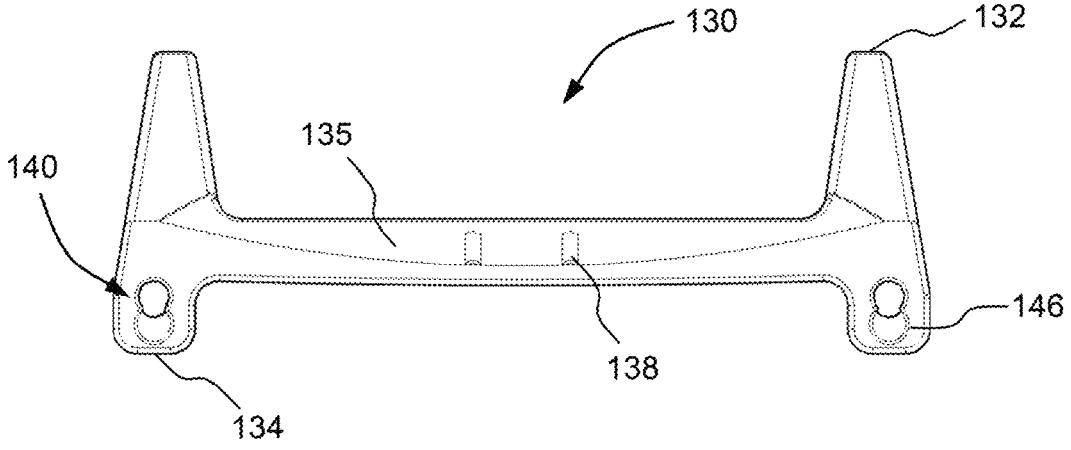
FIG. 30 is a rear view of the exemplary preferred dual-purpose support.
Figure 31:
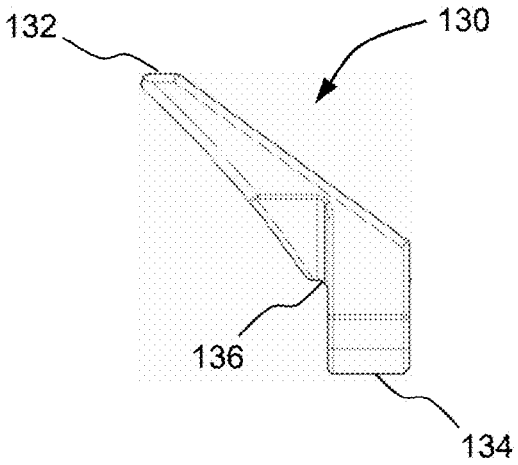
FIG. 31 is a first side view of the exemplary preferred dual-purpose support.
Figure 32:
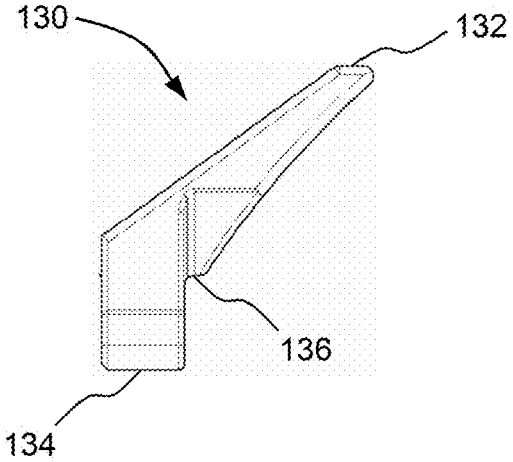
FIG. 32 is a second side view of the exemplary preferred dual-purpose support.
Figure 33:
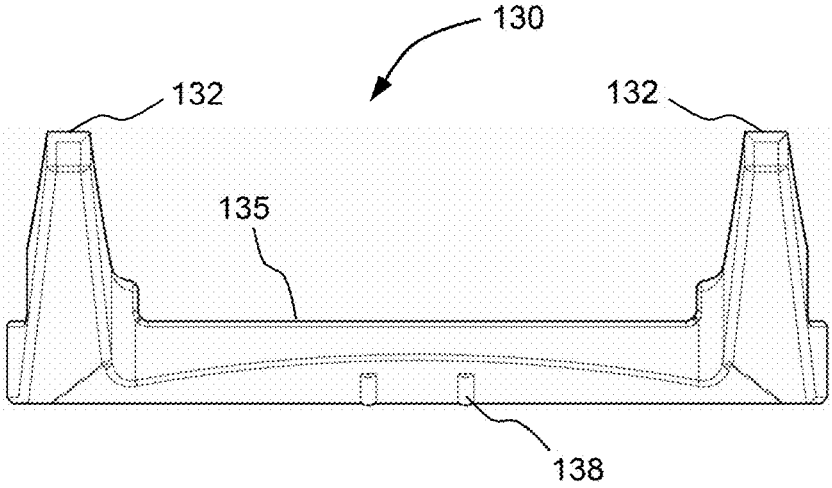
FIG. 33 is a top view of the exemplary preferred dual-purpose support.
Figure 34:
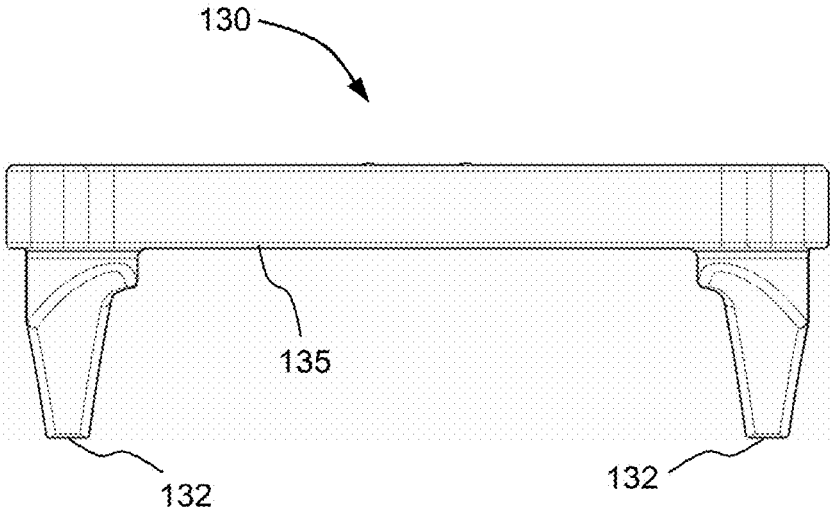
FIG. 34 is a bottom view of the exemplary preferred dual-purpose support.

FIGS. 10-18 show additional details of features of the exemplary preferred storage rack 100. FIGS. 10-15 show additional details of the mechanical structure of each stop-snap-slide channel 140 that facilitates the dual-purpose supports' 120, 130 interactions with the respective rail 110. FIGS. 16-18 show details of the mechanics of how the exemplary preferred storage rack 100 with dual-purpose supports 120, 130 holds a rackable item 102.

Figure 10:
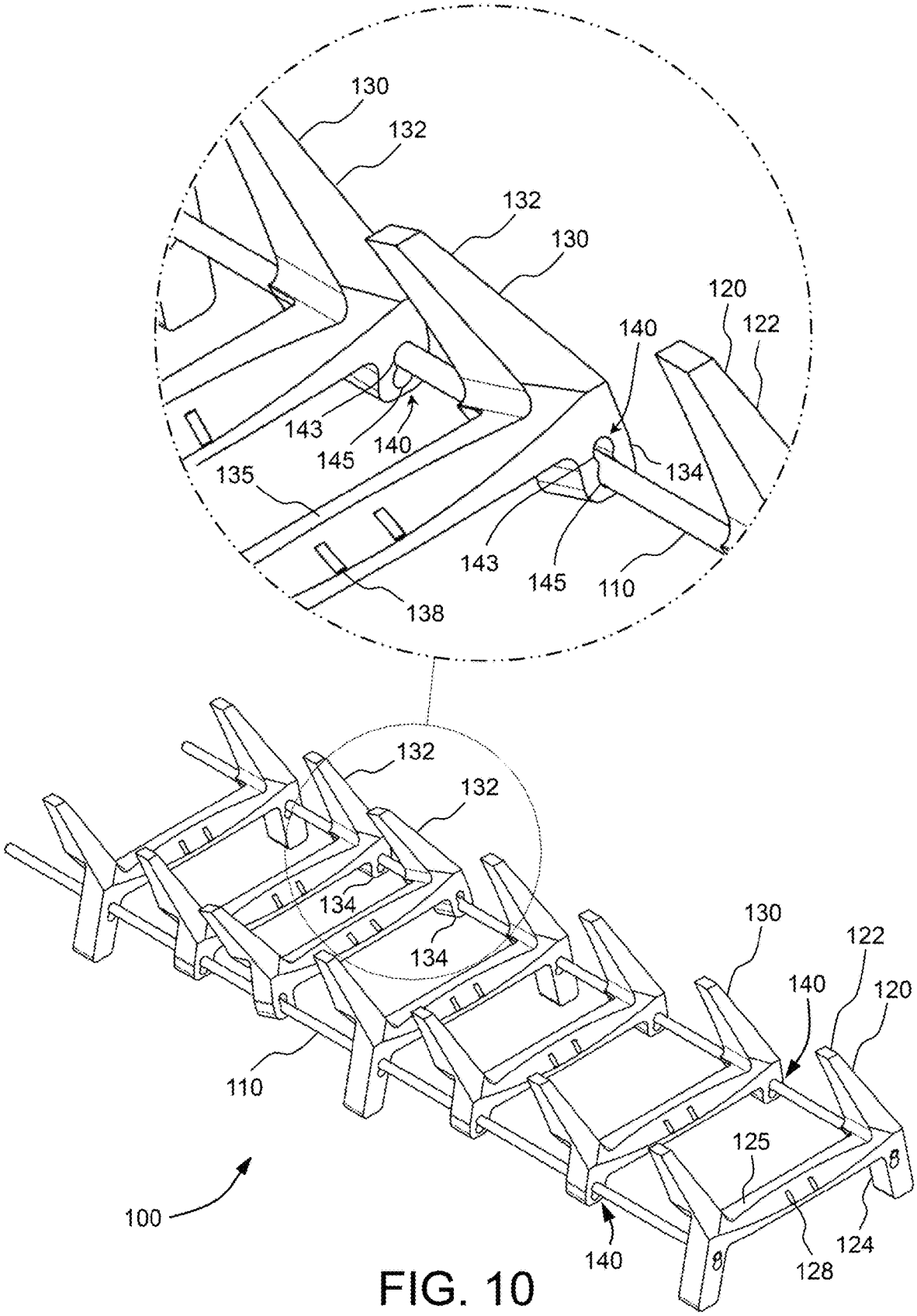
FIG. 10 is a rear-side perspective view (taken from the opposite side as FIGS. 6-9) of the exemplary preferred storage rack, all but one of the exemplary preferred dual-purpose supports being in a stop orientation and one of the exemplary preferred dual-purpose supports being in a slide orientation, and an enlarged detail showing one exemplary preferred dual-purpose support in a stop orientation and one exemplary preferred dual-purpose support in a slide orientation.

FIG. 10 shows the exemplary preferred storage rack 100 with all the exemplary preferred dual-purpose supports 120 and all but one of the exemplary preferred dual-purpose supports 130 being in a stop orientation such that they are held in place relative to the rail 210. The third from the left exemplary preferred dual-purpose support 130, however, is in a slide orientation (the different orientation can be seen, for example, by the different angle of this dual-purpose support 130 compared to the rest of the dual-purpose supports 130 in the stop orientation). An enlarged detail shows one side portion 132, 134 of an exemplary preferred dual-purpose support 130 (toward the left) being in a stop orientation (the rail 110 in the stop sub-channel 143), one side portion 132, 134 of an exemplary preferred dual-purpose support 130 (in the middle) being in a slide orientation (the rail 110 in the slide sub-channel 145), and one upper side portion 122 of an exemplary preferred dual-purpose support 120 (toward the right).

Figure 11:
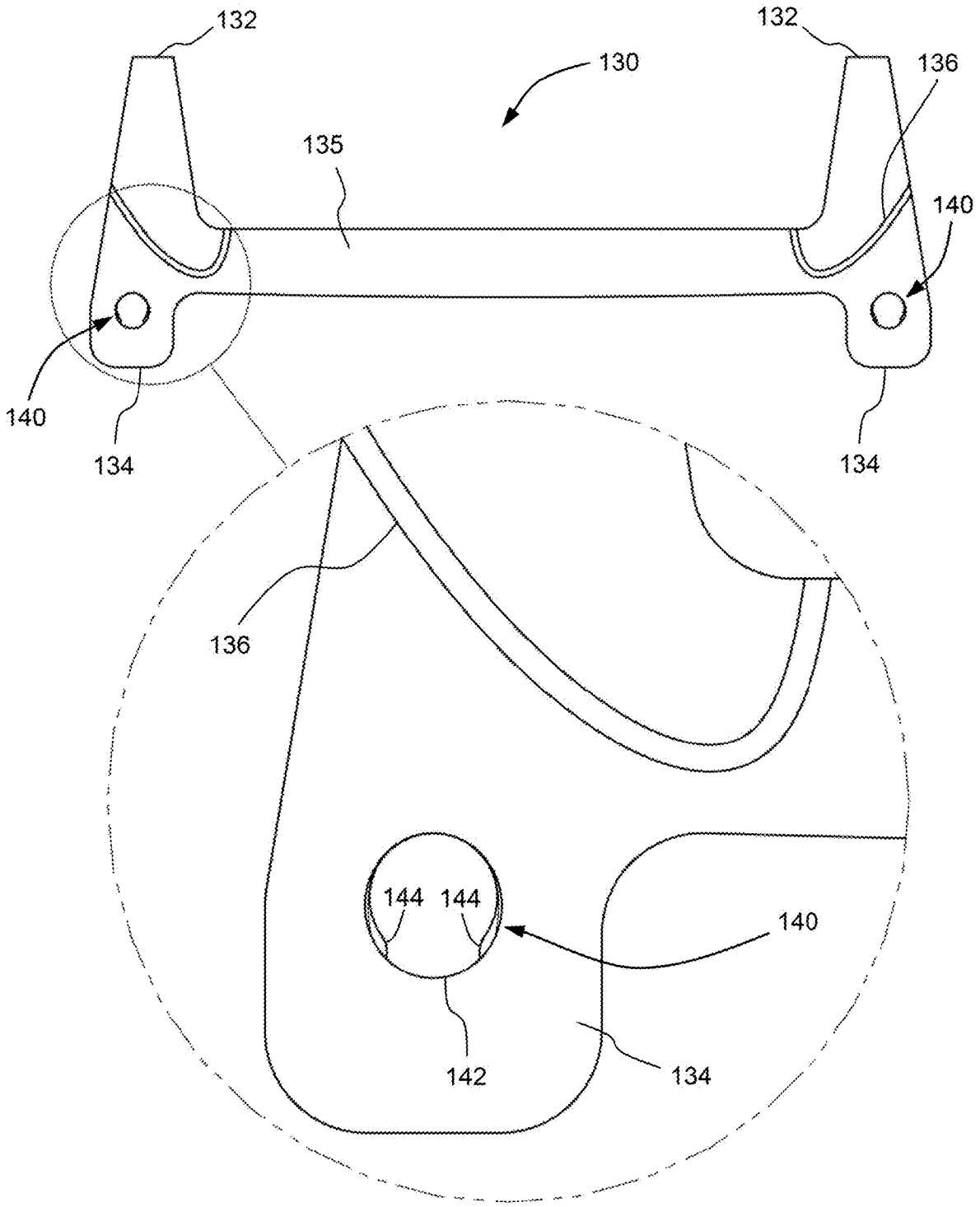
FIG. 11 is a front view of an exemplary preferred dual-purpose support, and an enlarged detail showing a first end of the stop-snap-slide channel in a leg of the exemplary preferred dual-purpose support.
Figure 12:
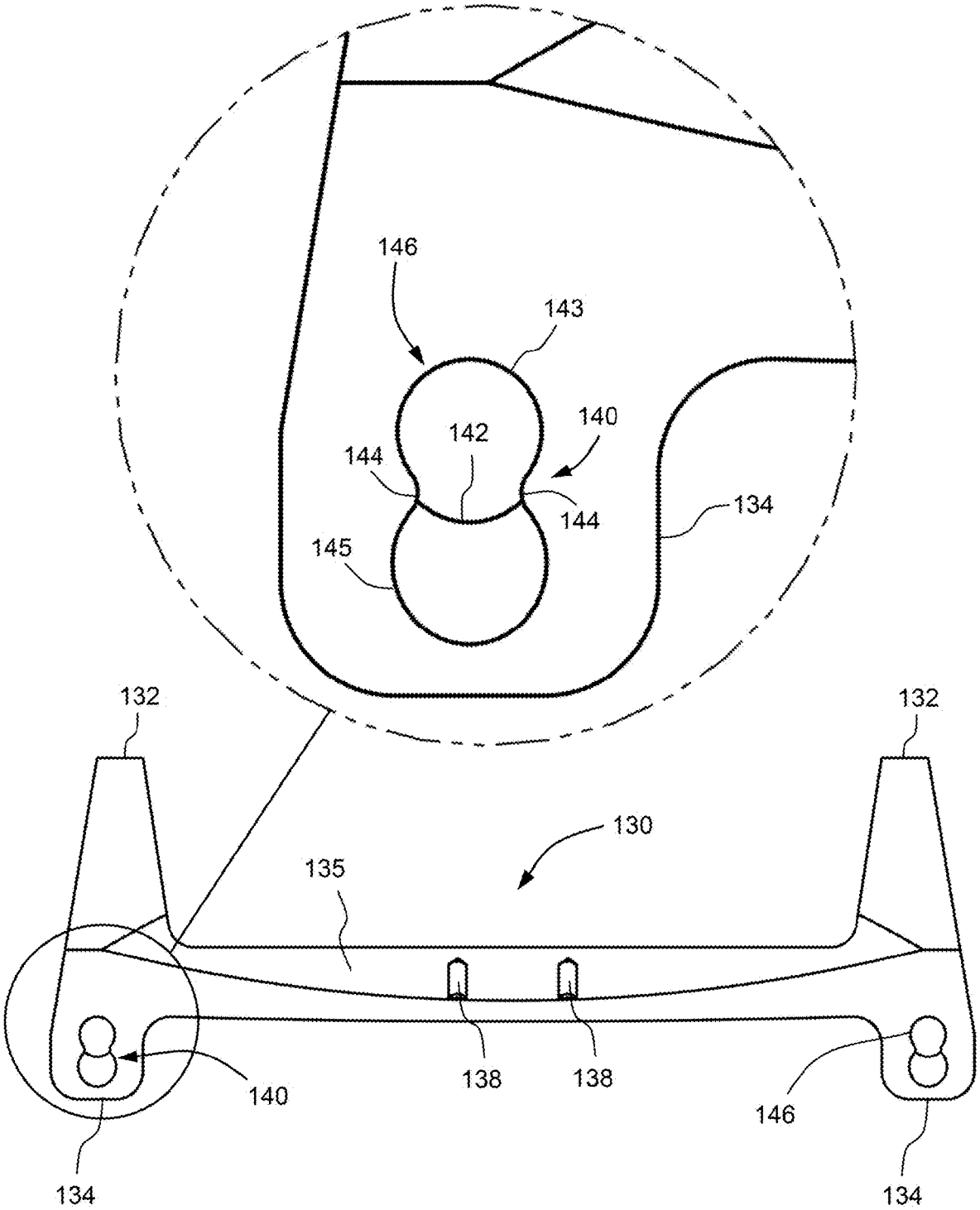
FIG. 12 is a rear view of the exemplary preferred dual-purpose support of FIG. 11, and an enlarged detail showing a second end of the stop-snap-slide channel in a leg of the exemplary preferred dual-purpose support.

As shown in FIGS. 11-12, the dual-purpose supports 130 have two side portions 132, 134. Each side portion has an upper side portion 132 and a lower side portion 134 (also referred to as a leg). A stop-snap-slide channel 140 is defined in each lower side portion 134. The side portions 132, 134 are separated by a spanning member 135 so that the side portions 132, 134 and spanning member 135 form a rough "H" shape. (As shown in FIGS. 17-18, the dual-purpose supports 120 have a similar structure, with upper side portions 122, elongated lower side portions 124 (also referred to as legs or elongated legs), and a spanning member 125 that together form a rough "H" shape.)

FIG. 11 shows a front view in which the upper side portions 132 are at an angle projecting toward the viewer. FIG. 11 includes an enlarged detail of the first end 142 of the stop-snap-slide channel 140. The enlarged detail shows the snap ridge 144 on both sides of the stop-snap-slide channel 140.

FIG. 12 shows a rear view in which the upper side portions 132 are at an angle projecting away from the viewer. From this view, the optional preferred bumpers 138 can be seen on the spanning member 135. FIG. 12 includes an enlarged detail of the second end 146 of the stop-snap-slide channel 140. The back side of the first end 142 of the stop-snap-slide channel 140 can also be seen. This figure shows the stop sub-channel 143 and the slide sub-channel 145 overlapping to a lesser extent to form a rough 8-shape. Where the sub-channels 143, 145 longitudinally overlap they form a snap ridge 144 on both sides of the stop-snap-slide channel 140.

Figure 13:
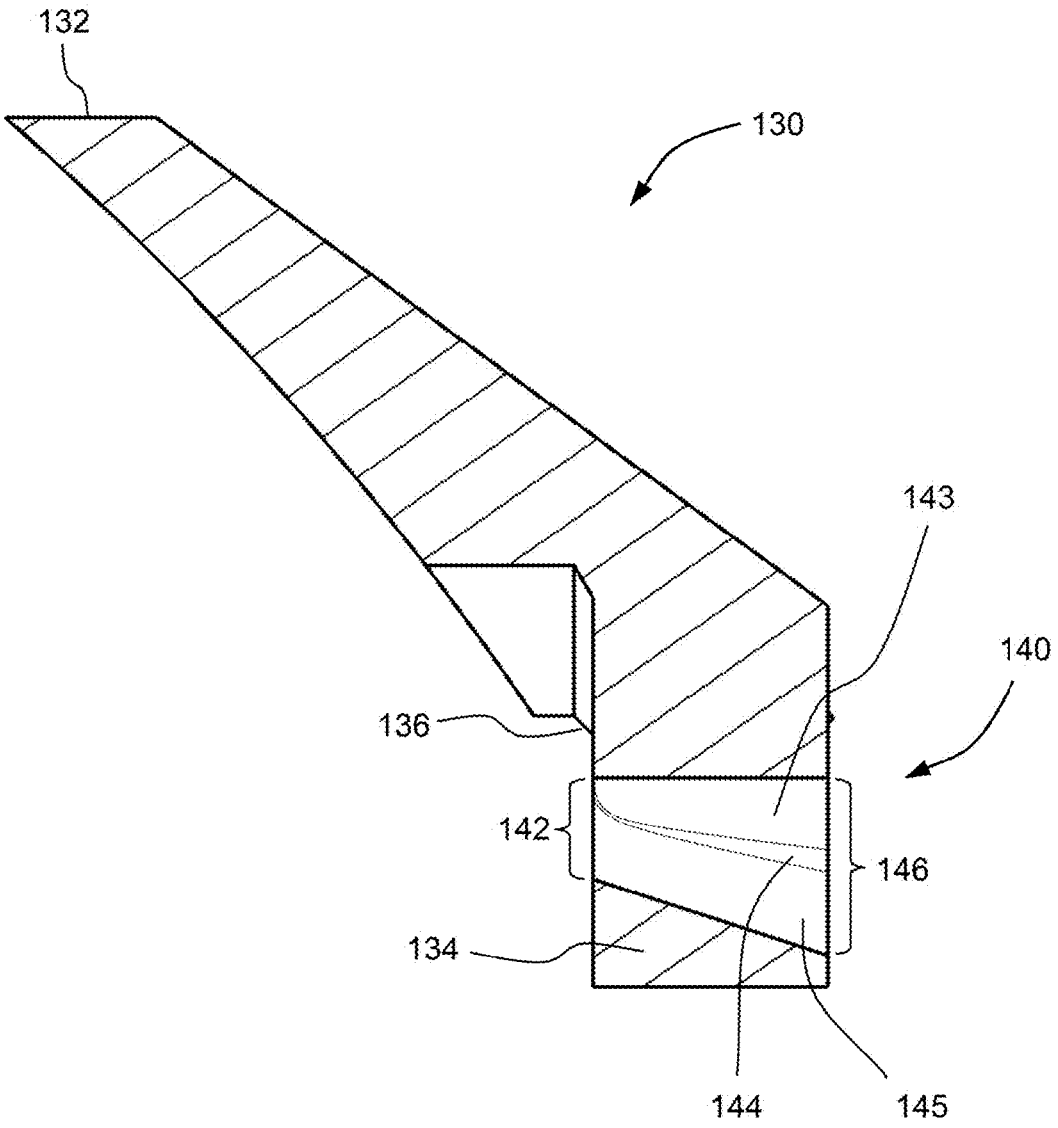
FIG. 13 is a cross-sectional side view of a leg of the exemplary preferred dual-purpose support of FIG. 11, the stop-snap-slide channel shown from the first end (left) to the second end (right).

FIG. 13 shows a cross-section of the lower side portion 134 of a dual-purpose support 130 and, in particular, a cross-section of the stop-snap-slide channel 140 from the first end 142 (left) to the second end 146 (right). This figure shows the stop sub-channel 143 and the slide sub-channel 145 partially overlapping each other. (The stop sub-channel 143 and the slide sub-channel 145 are also shown as intersecting at an angle (an "angled relationship") in which the sub-channels are not parallel to each other.) At the first end 142, the stop sub-channel 143 and the slide sub-channel 145 almost completely overlap. At the second end 146, the stop sub-channel 143 and the slide sub-channel 145 overlap to a lesser extent to form a rough 8-shape. Where the sub-channels 143, 145 longitudinally overlap, they form a snap ridge 144 on both sides (also see FIG. 12) of the stop-snap-slide channel 140. Defined between the snap ridges 144 is a passage between the stop sub-channel 143 and the slide sub-channel 145 that allows the rail 110 to pass therebetween. When the rail 110 passes through the passage, there may be an audible "snap" as it passes the snap ridges 144.

FIG. 14 shows a dual-purpose support 130 in the stop orientation with the rail 110 positioned through and being gripped by the length of the stop sub-channel 143. FIG. 15 shows the dual-purpose support 130 in the slide orientation with the rail 110 positioned through and in sliding-relationship to the length of the slide sub-channel 145. The dual-purpose support 130 transitions between the stop orientation (FIG. 14) and the slide orientation (FIG. 15) when a directional force is applied to push/pull the rail 110 past the snap ridges 144 and through the passage therebetween. Once the rail is in the slide orientation, the dual-purpose support 130 can move along the rail 110. The dual-purpose support 130 transitions between the slide orientation (FIG. 15) and the stop orientation (FIG. 14) when a directional force is applied to push/pull the rail 110 past the snap ridges 144 and through the passage therebetween. Once the rail is in the stop orientation, the dual-purpose support 130 is held in position relative to the rail 110.

FIGS. 16-18 show the exemplary preferred storage rack 100 with dual-purpose supports 120, 130 holding a rackable item (shown as cookware item 102) with a relatively deep concave shape (as compared to a lid 104, which has a relatively shallow concave shape). Specifically, these figures show the cookware item 102 held between the rear face of the spanning member 135 (the bottom of the cookware item 102 shown in FIG. 17 leaning on the bumper(s) 138) of the dual-purpose support 130 and the front face of the spanning member 125 (the rim of the cookware item 102 shown in FIGS. 17-18 sandwiched between the movement-limiting notch(es) 126 (above) and the rail(s) 110 (below)) of the dual-purpose support 120. These figures show that when the cookware item 102 is held between adjacent dual-purpose supports 120, 130, part of the cookware item 102 may extend below the rails 110 and/or at least part of the spanning member 125, 135.

More generally, the dual-purpose supports 120, 130 are used in pairs to hold rackable items 102, 104. There are several possible configurations for this:

- the front of a dual-purpose support 120, 130 holds the rim of the rackable item 102, 104 and the rear of a dual-purpose support 120, 130 holds the bottom of the rackable item 102, 104 as shown in FIGS. 1 (right three rackable items 102), 2 (right three rackable items 102), and 16-18;
- the front of a dual-purpose support 120, 130 holds the bottom of the rackable item 102, 104 and the rear of a dual-purpose support 120, 130 holds the rim of the rackable item 102, 104 as shown in FIGS. 1 (left three rackable items 104) and 2 (rackable item 104);
- the rear of a dual-purpose support 120, 130 holds the rim/bottom of the rackable item 102, 104 and the rear of a dual-purpose support 120, 130 holds the rim/bottom of the rackable item 102, 104 as shown in FIG. 1 (the left rackable item 102);
- the front of a dual-purpose support 120, 130 holds the rim/bottom of the rackable item 102, 104 and the front of a dual-purpose support 120, 130 holds the rim/bottom of the rackable item 102, 104 (not shown); and
- a single dual-purpose support 120, 130 works with a wall (or other type of barrier) to hold a rackable item 102, 104 (not shown).

Relatively deep rackable items 102 (e.g., pots or pans) are often held with the front of a dual-purpose support 120, 130 holding the rim (open portion or front) of the rackable item 102, and the rear of the adjacent dual-purpose support 120, 130 holding the bottom (closed portion or rear) of the rackable item 102. Relatively shallow rackable items 104 (e.g., a lid) are often held with the rear of a dual-purpose support 120, 130 holding the rim (open portion or front) of the rackable item 104, and the front of the adjacent dual-purpose support 120, 130 holding the bottom (closed portion or rear) of the rackable item 104. FIG. 2 shows an exception in which a relatively deep rackable item 102 (shown as a bowl) is held on both the rim and bottom (the open and closed portion) by the rear of two adjacent dual-purpose supports 120, 130.

FIGS. 19-26 show an exemplary preferred storage rack 100, including ornamental aspects thereof. FIGS. 27-34 show an exemplary preferred dual-purpose support 130, including ornamental aspects thereof.

FIG. 35-37 show exemplary preferred storage racks in alternative exemplary preferred configurations in a cabinet. As shown, a pair of rails 110 are positioned toward the top of the cabinet (about one-third of the way from the top) and a pair of rails 110 are positioned toward the bottom of the cabinet (about one-third of the way from the bottom). The ends of the rails 110 are shown as being embedded in the walls of the cabinet, but they could be otherwise associated (e.g., using clips or other mechanical structure). A plurality of supports 130, 150 are positioned along the length of each pair of rails 110. Because the supports 130, 150 are not resting on a surface, the elongated lower side portions 124 of the dual-purpose supports 120 are not necessary (but could be used). Accordingly, the dual-purpose supports 130 are used. In addition, dual-purpose supports 150 are used. Dual-purpose supports 150 are shown as similar to dual-purpose supports 130, except with shortened upper side portions 152. One advantage of the dual-purpose supports 150 is that, depending on the depths of the rackable items 102, 104, more rackable items may be held on a pair of rails 110. More specifically, each dual-purpose support 150 is shown as having two side portions 152, 154 (an upper side portion 152 and a lower side portion 154) that are separated by a spanning member 155 so that the side portions 152, 154 and spanning member 155 form a rough "H" shape. These figures show exemplary rackable items being held by exemplary preferred dual-purpose supports 130, 150. One rackable item (on the right side of the lower pair of rails 110) is held by a dual-purpose support 150 and the cabinet wall.

Figure 38:
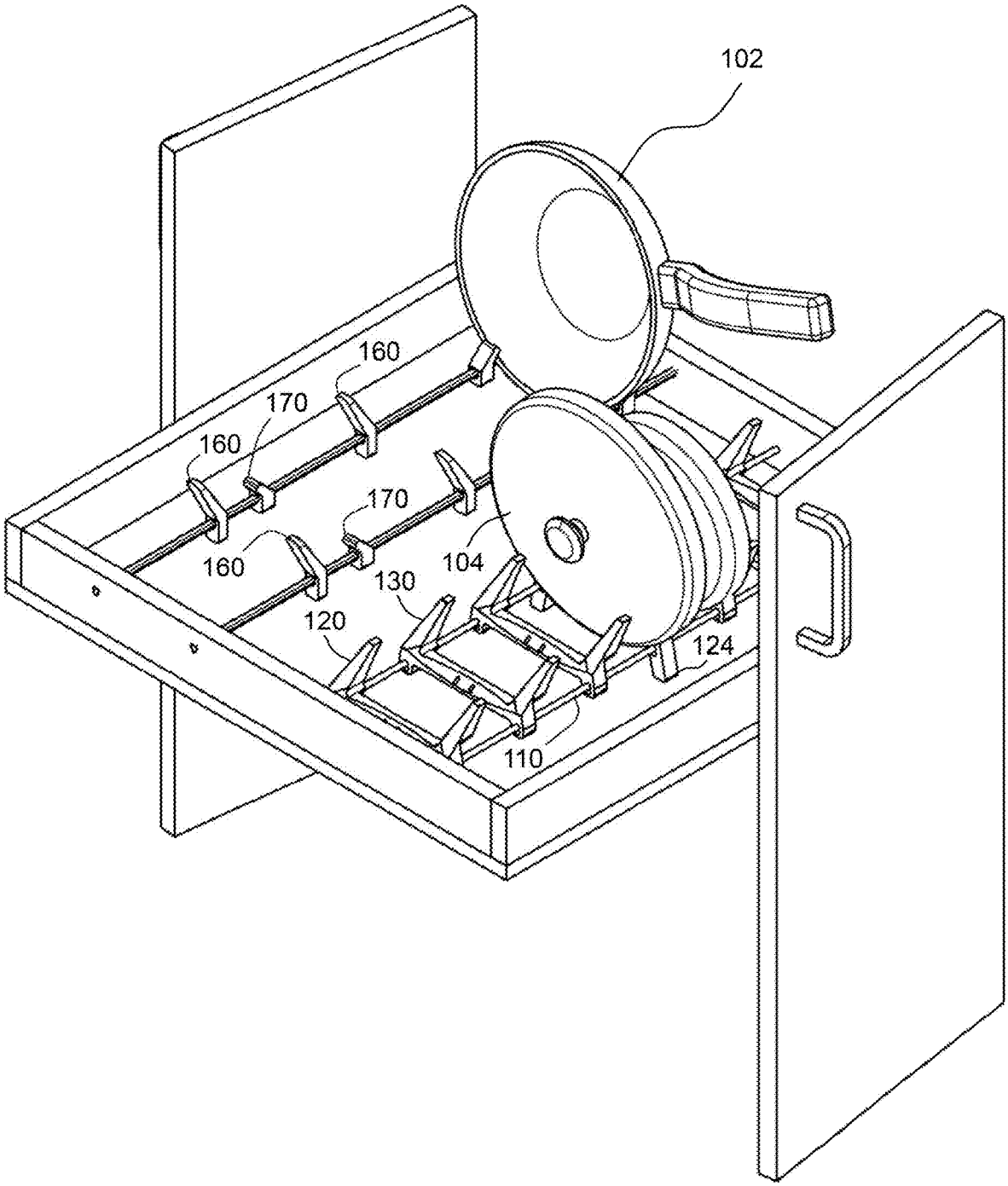
FIG. 38 is a perspective view of exemplary preferred storage racks in alternative exemplary preferred configurations in a drawer, exemplary rackable items being held by exemplary preferred dual-purpose supports.
Figure 39:
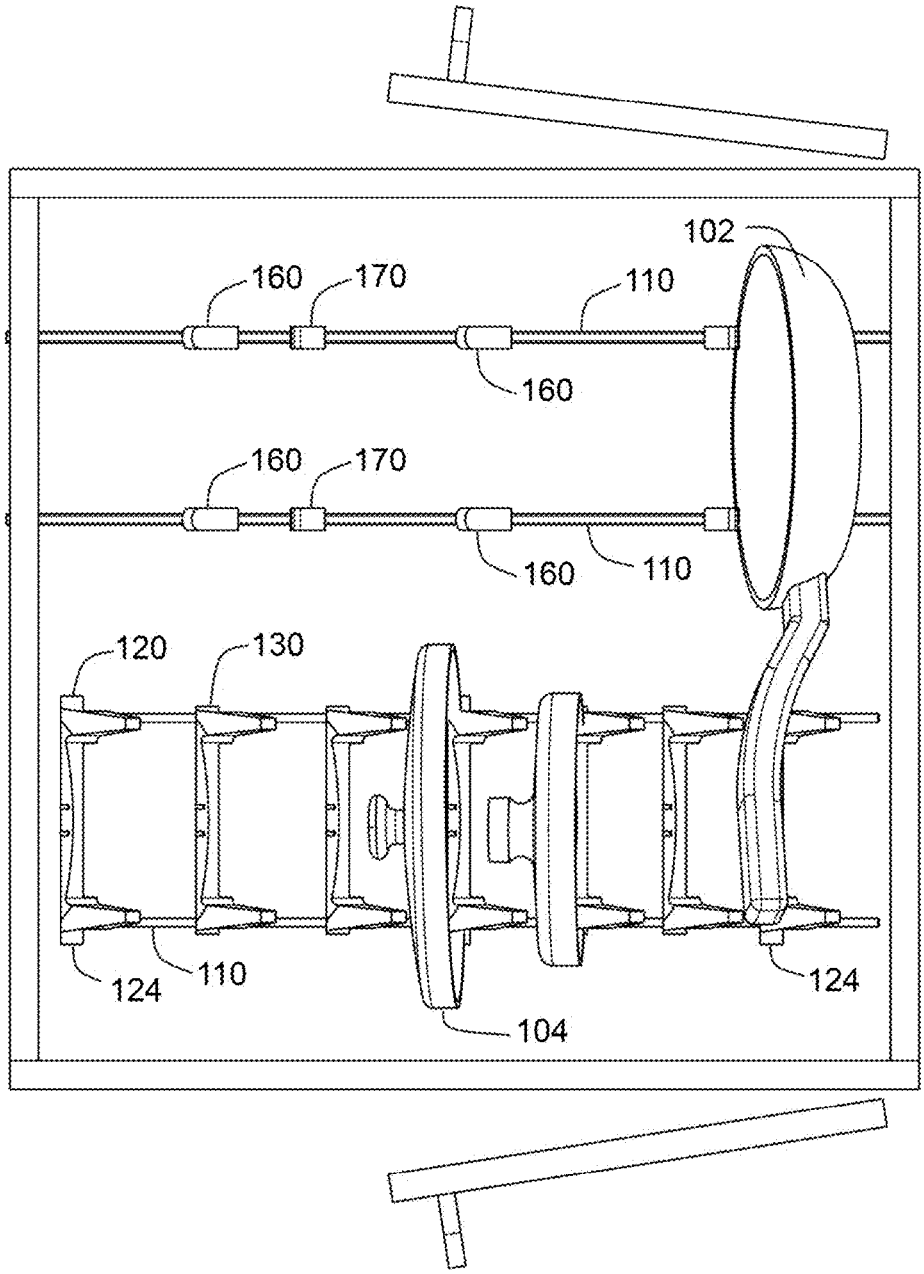
FIG. 39 is a top view of exemplary preferred storage racks in alternative exemplary preferred configurations in a drawer, exemplary rackable items being held by exemplary preferred supports.
Figure 40:
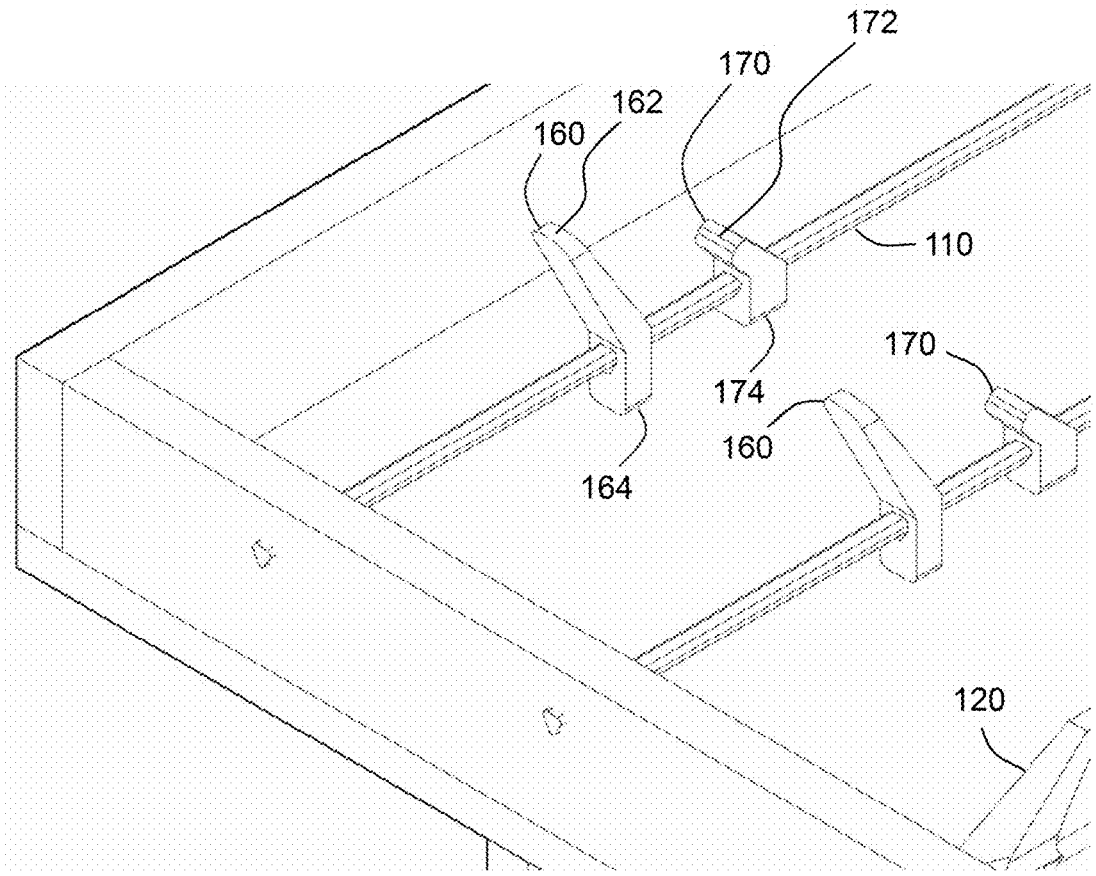
FIG. 40 is a detailed perspective view of exemplary preferred storage racks and exemplary preferred dual-purpose supports (non-spanning supports) in alternative exemplary preferred configurations in a drawer.

FIG. 38-40 show exemplary preferred storage racks in alternative exemplary preferred configurations in a drawer. In this exemplary configuration, there are two pairs of rails 110 (for a total of four rails). As shown, the first pair of rails 110 are connected to each other using a plurality of dual-purpose supports 120, 130. (This is at least similar to the configurations shown in FIGS. 1-2.) The elongated lower side portions 124 of the dual-purpose supports 120 are used to support the rails 110 above the floor (bottom) of the drawer. As shown, the second pair of rails 110 have ends that are shown as being embedded in the walls of the drawer, but they could be otherwise associated (e.g., using clips or other mechanical structure). A plurality of non-spanning supports 160, 170 are positioned along the length of the second pair of rails 110. The non-spanning supports 160, 170 have upper portions 162, 172 (FIG. 40) and lower portions 164, 174 (FIG. 40). The upper portions 172 (similar to the upper side portions 152, the upper portions 172 are relatively short) are shown as shorter than the upper portions 162. Because the non-spanning supports 160, 170 are not resting on a surface, elongated legs (lower portions) are not necessary (but elongated legs could be used). Unlike supports 120, 130, 150, the non-spanning supports 160, 170 do not include a spanning member. Instead, the non-spanning supports 160, 170 are used in pairs. From a use standpoint, the non-spanning supports allow for more flexibility (e.g., they can hold irregularly shaped cookware items. From a manufacturing standpoint, the absence of the spanning member can reduce material costs. The non-spanning supports 160, 170 are shown as being used with embedded rails, but could be used in a freestanding storage rack if at least two supports 120, 130 are used to join the rails.

Figure 49:
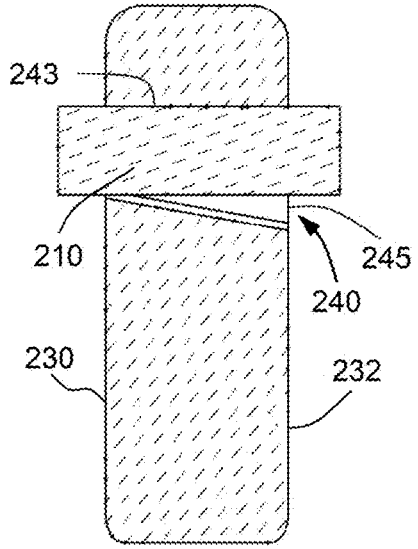
FIG. 49 is a cross-sectional side view of a leg of the exemplary preferred first hook support taken along line 49-49 of FIG. 42, a rail positioned through the length of the stop sub-channel of the stop-snap-slide channel.
Figure 50:
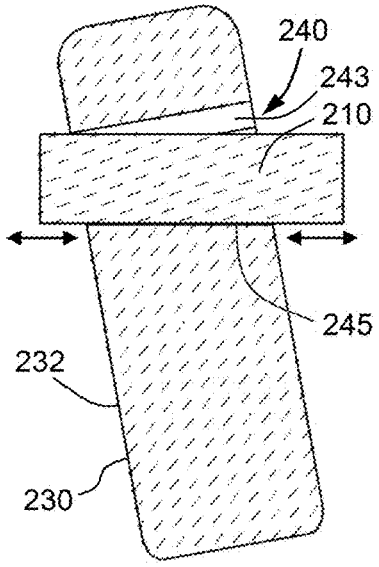
FIG. 50 is a cross-sectional side view of a leg of the exemplary preferred first hook support taken along line 50-50 of FIG. 42, a rail positioned through the length of the slide sub-channel of the stop-snap-slide channel.
Figure 51:
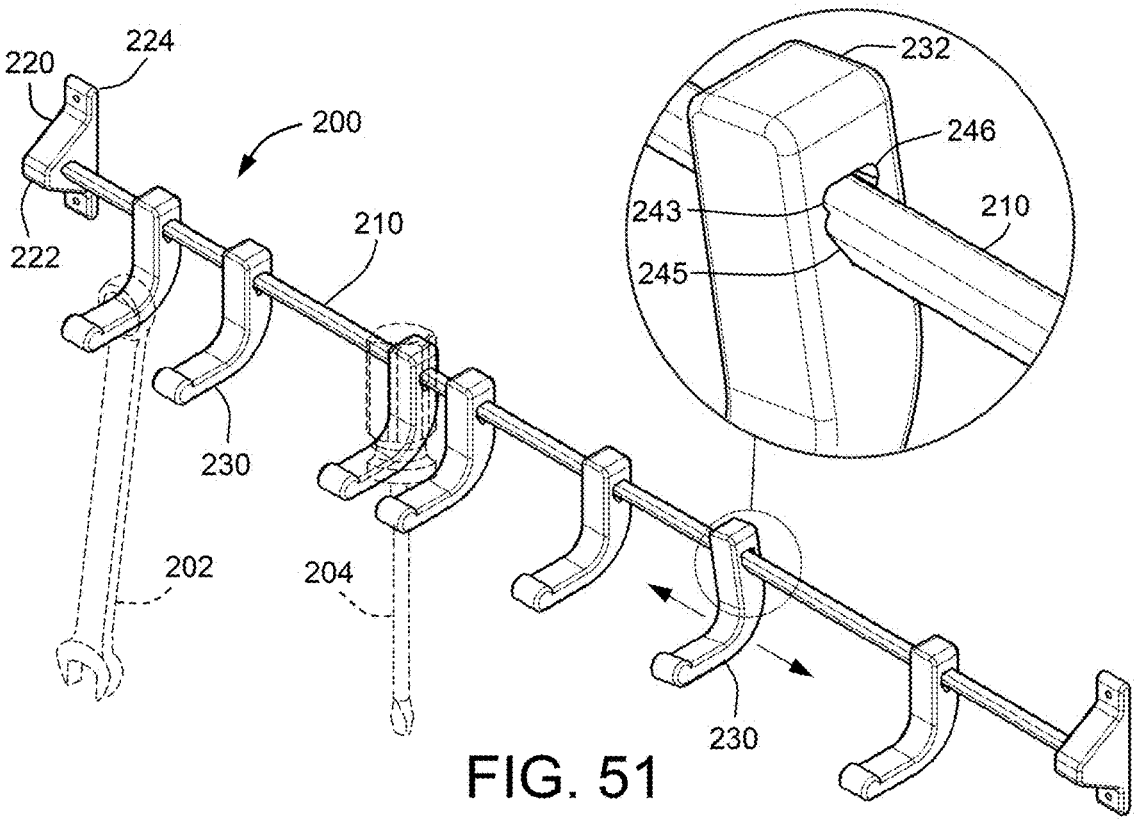
FIG. 51 is a perspective view of the exemplary preferred first hanging storage rack, all but one of the exemplary preferred first hook supports being in a stop orientation and one of the exemplary preferred first hook supports being in a slide orientation, and an enlarged detail showing the one exemplary preferred first hook support in a slide orientation.

FIGS. 41-51:

FIGS. 41-51 show an exemplary preferred first hanging storage rack 200 in various configurations as well as components thereof. The hanging storage rack 200 is shown with a single rail 210, rail end holders 220, and a plurality of hook supports 230 (shown as having an upper portion 232 at an angle relative to a lower portion 234). The hanging storage rack 200 may be used to hang rackable items that are shown as hangable items 202, 204 (FIG. 51).

The rail 210 of the shown hanging storage rack 200 is shown as having an at least substantially triangular cross-section. Alternative rails could have a circular cross-section at least similar to those shown in FIGS. 1-40. (And if the rails had a circular cross-section, the shape of the stop-snap-slide channel 240 would be at least similar to those shown in FIGS. 1-40.)

Figure 41:
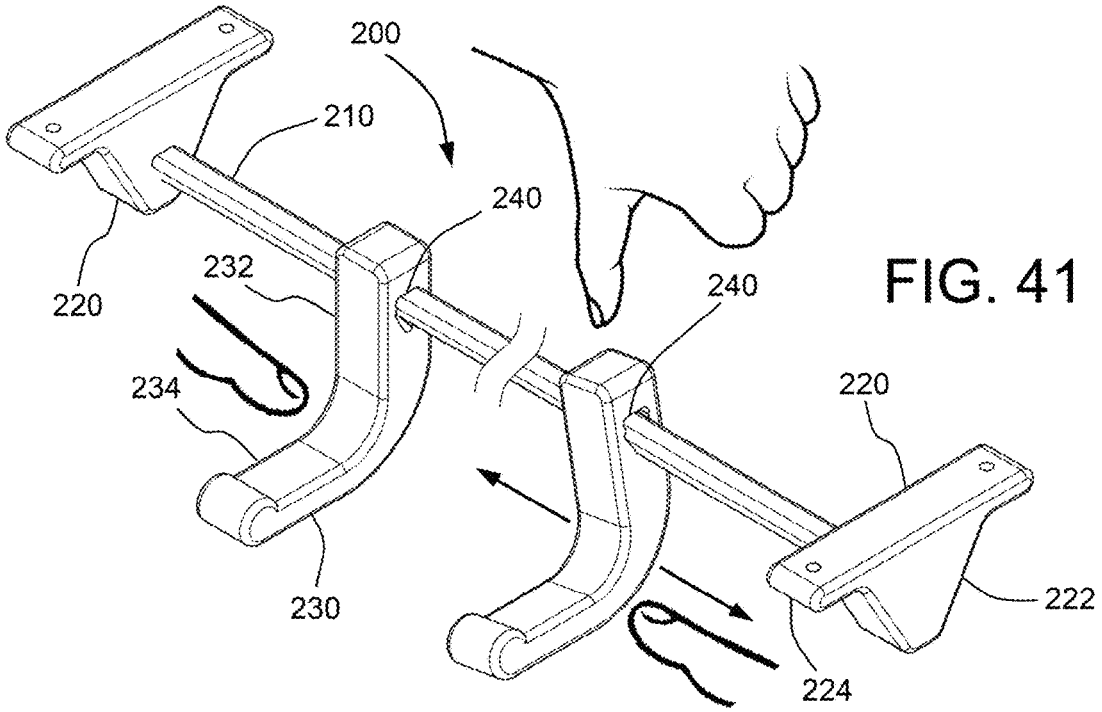
FIG. 41 is a perspective view of an exemplary preferred first hanging storage rack in an exemplary preferred configuration, exemplary preferred first hook supports are shown in the stop orientation (left hook support) and in the slide orientation (right hook support).

The rail 210 of the shown hanging storage rack 200 is shown as being secured at each end by a rail end holder 220. Each rail end holder 220 is shown as having a rail connector 222 and a base 224. Although shown as distinct, the rail connector and base may be indistinguishable (e.g., having a single shape without distinguishable parts such as a semicircle or a triangle). The rail end holder rail connector 222 is shown as having an aperture into which the rail 210 is positioned and secured. The aperture preferably has substantially the same cross-section as the rail 210. The ends of the rail 210 may be secured to the rail end holder 220 (including within the aperture) using adhesive or mechanical structure (e.g., clips). Alternative rail end holder rail connectors could include or be replaced with clips or other mechanical structure. The shown rail end holder base 224 is meant to be exemplary and is designed to mate with a hanging surface (e.g., a wall or ceiling). The rail end holder base 224 is shown with at least one aperture into which a connector (e.g., a screw) can be positioned to secure the rail end holder 220 to the hanging surface. Alternative rail end holder bases could be adapted for alternative hanging surfaces. For example, appropriate pegs, hooks, or locks could be used instead of the shown base if the hanging surface is a pegboard. Another example is that suction cups could be used to attach to smooth hanging surfaces. Still further, the rail end holders 220 can be oriented as shown in FIG. 41 to attach to horizontal hanging surfaces (e.g., the ceiling or under a shelf) or as shown in FIG. 51 to attach to vertical hanging surfaces (e.g., a wall). Other modifications could be made to attach to hanging surfaces in other positions (e.g., between two walls) relative to the rail 210. In addition, the ends of the rail 210 may be embedded directly in existing hanging surfaces (e.g., the walls of a building, cabinet (similar to FIGS. 35-37), or drawer (similar to FIGS. 38-40)) or attached to existing hanging surfaces, clips, or other mechanical structure.

Each shown exemplary preferred hook support 230 has an upper portion 232 (also referred to as a "leg") that is at an angle relative to a lower portion 234 (also referred to as a "foot" or "hook"). The shown angle is approximately 90 degrees, but smaller or larger angles could be used depending on the intended use. The lower portion 234 may have an end obstacle (e.g., a bump) to prevent rackable items from falling off the lower portion 234. The shown hook support 230 can be described as generally L-shaped, but alternative hook supports could have alternative shapes including, but not limited to, upside-down question marks (e.g., FIGS. 61-69), J-shapes (not shown), check marks (not shown), or other alternative shapes. Also, the depth of the lower portion 234 (or the height of the obstacle) could be adjusted based on the intended use (e.g., deeper lower portions could be provided for thicker rackable items). As shown in FIG. 51, the lower portion 234 can be inserted into an aperture of a hangable item 202 to suspend the hangable item 202 therefrom. As also shown in FIG. 51, two hook supports 230 can be positioned together to hold a hangable item 204 with an overhang. Although not shown, multiple hook supports 230 may be spaced such that elongate rackable items can be laid across the lower portions 234 of multiple hook supports 230. One or more specialty hook supports could be associated (e.g., integral or attachable) with baskets or containers for holding small items.

Figure 42:
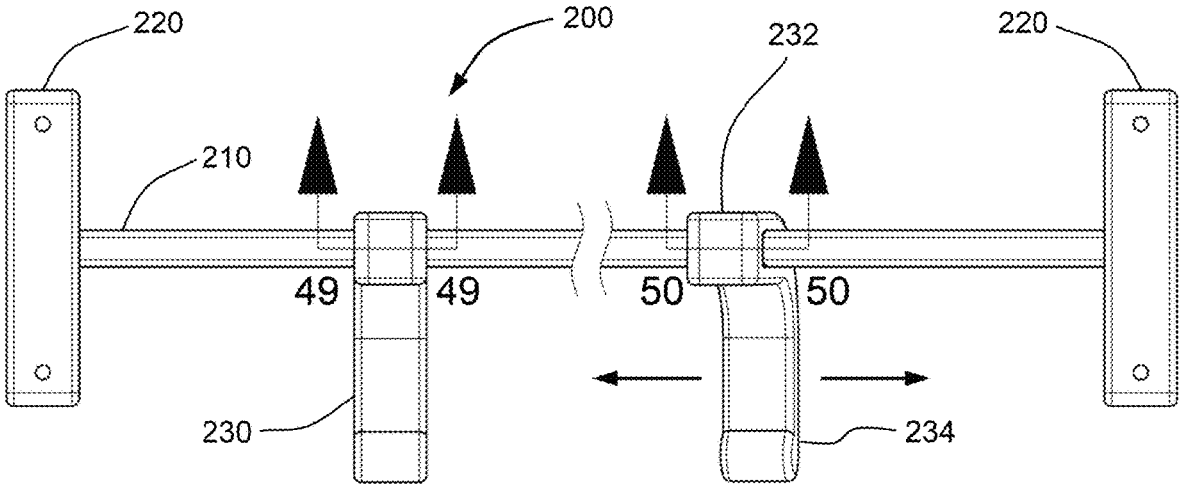
FIG. 42 is a top view of the exemplary preferred first hanging storage rack in an exemplary preferred configuration, exemplary preferred first hook supports are shown in the stop orientation (left hook support) and in the slide orientation (right hook support).
Figure 43:
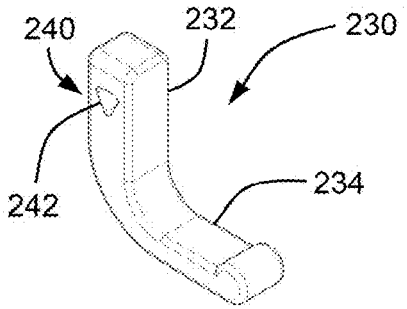
FIG. 43 is a perspective side view of the exemplary preferred first hook support showing a first end of the stop-snap-slide channel.
Figure 44:
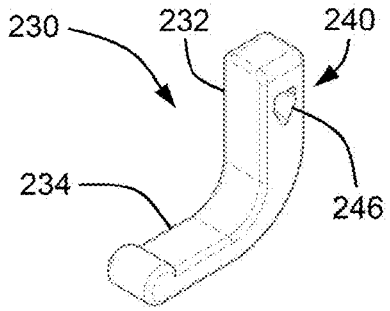
FIG. 44 is a perspective side view of the exemplary preferred first hook support showing a second end of the stop-snap-slide channel.
Figure 45:
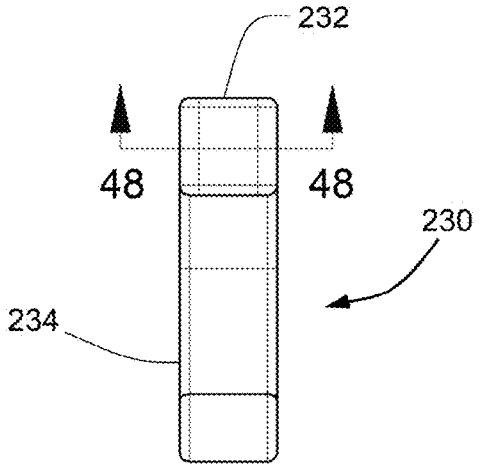
FIG. 45 is a top view of the exemplary preferred first hook support.
Figure 46:
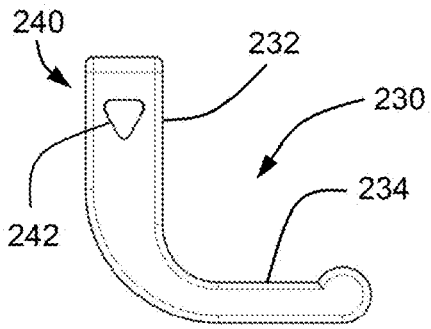
FIG. 46 is a side view of the exemplary preferred first hook support showing the first end of the stop-snap-slide channel.
Figure 47:
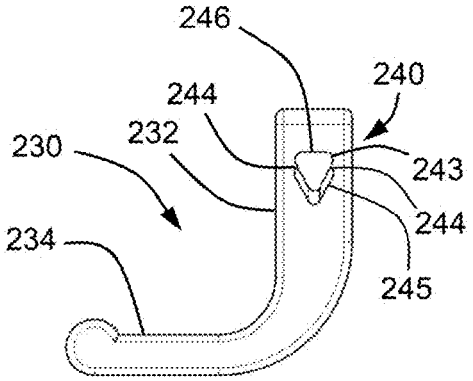
FIG. 47 is a side view of the exemplary preferred first hook support showing the second end of the stop-snap-slide channel.

FIGS. 41-42 and 51 show the exemplary preferred hanging storage rack 200 in various configurations. The differences between the shown configurations are meant to be exemplary as there are limitless configurations. The configurations may be dictated by the specific rackable items that are meant to be held in the hanging storage rack 200. Exemplary differences include, but are not limited to, different quantities of hook supports 230 and different spacing between the hook supports 230.

Figure 48:
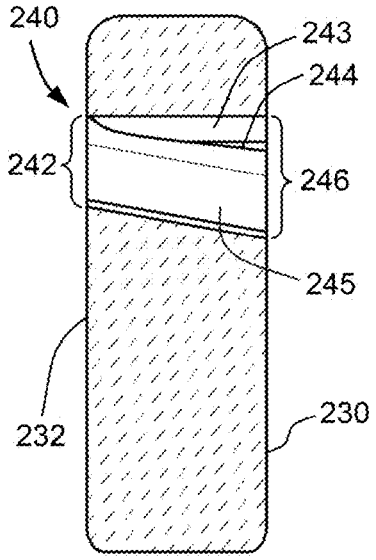
FIG. 48 is a cross-sectional side view of a leg of the exemplary preferred first hook support taken along line 48-48 of FIG. 45, the length of the stop-snap-slide channel shown from the first end (left) to the second end (right).

The shown hook supports 230 each have stop-snap-slide channels 240 through which the rail 210 is positioned. The stop-snap-slide channels 240 are shown as being defined in the upper portions 232 of the hook supports 230. As shown in FIGS. 48-50, the stop-snap-slide channels 240 include a stop sub-channel 243 and a slide sub-channel 245. Because the rail cross-section is substantially triangular, the cross-sections of the sub-channels 243, 245 are substantially triangular. As also shown in FIGS. 48-50, the stop sub-channel 243 and the slide sub-channel 245 at least partially longitudinally overlap and intersect at an angle. At the first end 242 (also shown in FIGS. 43 and 46), the stop sub-channel 243 almost completely overlaps with the slide sub-channel 245. At the second end 246 (also shown in FIGS. 44 and 47), the stop sub-channel 243 and the slide sub-channel 245 overlap to a lesser extent (shown in FIGS. 47 and 51 as two triangles offset from each other). Where the sub-channels 243, 245 longitudinally overlap they form a snap ridge 244 on both sides of the stop-snap-slide channel 240. Defined between the snap ridges 244 is a passage between the stop sub-channel 243 and the slide sub-channel 245 that allows the rail 210 to pass therebetween. When the rail 210 passes through the passage, there may be an audible "snap" as it passes the snap ridges 244.

The outer perimeter surface of the rail 210 and the inner perimeter surface of the stop sub-channel 243 are preferably partially nearly congruent such that when the rail 210 is positioned within the stop sub-channel 243 there is significant friction therebetween to prevent relative motion therebetween. As shown, the outer perimeter surface of the rail 210 and the inner perimeter surface of the slide sub-channel 245 are preferably partially nearly incongruent in that there is a gap therebetween to allow sliding therebetween. Put another way, using the stop-snap-slide channels 240, each hook support 230 can be held in position in relation to the rail 210 (when the rail 210 is in the stop sub-channel 243) or slide on the rail 210 (when the rail 210 is in the slide sub-channel 245).

In FIGS. 41-42, the left hook support 230 is in the stop orientation and the right hook support 230 is in the slide orientation. In the stop orientation, the rail 210 is positioned within the stop sub-channel 243 of the stop-snap-slide channel 240 as shown in FIG. 49. When the rail 210 is positioned within the stop sub-channel 243 there is significant friction therebetween to prevent relative motion therebetween. FIG. 41 shows a finger applying force to the left hook support 230 (shown in the stop orientation) that would be applied to transition it to the slide orientation. In the slide orientation (the right hook support 230 in FIG. 41), the rail 210 is positioned within the slide sub-channel 245 of the stop-snap-slide channel 240 as shown in FIG. 50. When the rail 210 is positioned within the slide sub-channel 245 the relative minimal friction therebetween allows relative sliding motion therebetween (shown by the arrows on both sides of the right hook support 230 in FIG. 41). FIG. 41 shows a finger applying force to the right hook support 230 (shown in the slide orientation) that would be applied to transition it to the stop orientation as well as a second hand that could be used to hold the hook support 230 in place. Depending on the configuration of the stop-snap-slide channels 240, the angles in which force is applied may need to be adjusted. In a manner similar to that shown in FIGS. 3-5, force is applied to a hook support 230 in a stop orientation to transition it to a slide orientation. Once in the slide orientation, the hook support 230 can slide along the rail 210 to a desired location. Force (and possibly a hold to prevent movement in relation to the rail 210) can then be applied to the hook support 230 in the slide orientation to transition it to the stop orientation. Desired locations of hook supports 230 may be determined based on the hangable items 202, 204 to be held on the hanging storage rack 200. It should be noted that in actual use the "force" (or pressure) may be applied differently than shown. For example, the "force" may be applied in reverse (e.g., instead of using a finger to push generally downward, the downward force may be applied from the opposite side by pulling generally downward). Also, depending on hand strength, more than one finger may be required to provide the requisite force. Finally, the angle of the force may depend on the shape of the stop-snap-slide channel, and there may be a tolerance to allow the angle of force to vary.

FIGS. 43-47 show an exemplary preferred hook support 230, including ornamental aspects thereof.

FIG. 51 shows the hanging storage rack 200 with a rail 210 attached to a vertical surface using rail end holders 220. All but one of the exemplary preferred hook supports 230 are shown as being in a stop orientation and one of the exemplary preferred hook supports 230 (the second from the right) is shown as being in a slide orientation. An enlarged detail shows the upper portion 232 of the hook support 230 in a slide orientation (positioned within the slide sub-channel 245). The hanging storage rack 200 is shown as supporting a hangable item 202 with an aperture by inserting the lower portion 234 of the hook support 230 into the aperture. The hanging storage rack 200 is shown as supporting a hangable item 204 with an overhang by positioning hook supports 230 together (e.g., by using two adjacent hook supports 230 as a pair), the hangable item 204 is positioned as shown with part of it between and below the lower portions 234 of the adjacent (e.g., paired) hook supports 230, the overhang supported by the lower portions 234 of the adjacent (e.g., paired) hook supports 230, and the part of the hangable item 204 above the overhang above the lower portions 234 of the adjacent (e.g., paired) hook supports 230. One or more elongate rackable items (not shown) may also be laid across the lower portions 234 of the three right hook supports 230.

FIGS. 52-55:

FIGS. 52-55 show an exemplary preferred second hanging storage rack 200' in an exemplary configuration as well as components thereof. The second hanging storage rack 200' is similar to the first hanging storage rack 200. However, whereas the first hanging storage rack's stop sub-channel 243 and the slide sub-channel 245 at least partially longitudinally overlap and intersect at an angle, the second hanging storage rack's stop sub-channel 243' and the slide sub-channel 245' at least partially longitudinally overlap and are parallel to each other.

FIGS. 52-55 show the hanging storage rack 200' with a single rail 210', rail end holders 220', and a plurality of hook supports 230' (shown as having an upper portion 232' at an angle relative to a lower portion 234'). The hanging storage rack 200' may be used to hang rackable items in a manner similar to the way the hangable items 202, 204 are hung in FIG. 51.

The rail 210' of the shown hanging storage rack 200' is shown as having an at least substantially triangular cross-section. Alternative rails could have alternative cross-sections.

Like the rail 210 of storage rack 200, the rail 210' of the shown hanging storage rack 200' is shown as being secured at each end by a rail end holder 220'. Each rail end holder 220' is shown as having a rail connector 222' and a base 224'. Although shown as distinct, the rail connector and base may be indistinguishable (e.g., having a single shape without distinguishable parts such as a semi-circle or a triangle). The rail end holder rail connector 222' is shown as having an aperture into which the rail 210' is positioned and secured. The aperture preferably has substantially the same cross-section as the rail 210. The ends of the rail 210' may be secured to the rail end holder 220' (including within the aperture) using adhesive or mechanical structure (e.g., clips). Alternative rail end holder rail connectors could include or be replaced with clips or other mechanical structure. The shown rail end holder base 224' is meant to be exemplary and is designed to mate with a hanging surface (e.g., a wall or ceiling). The rail end holder base 224' is shown with at least one aperture into which a connector (e.g., a screw) can be positioned to secure the rail end holder 220' to the hanging surface. Alternative rail end holder bases could be adapted for alternative hanging surfaces. For example, appropriate pegs, hooks, or locks could be used instead of the shown base if the hanging surface is a pegboard. Another example is that suction cups could be used to attach to smooth hanging surfaces. Still further, the rail end holders 220' can be oriented to attach to horizontal hanging surfaces (e.g., the ceiling or under a shelf) or to attach to vertical hanging surfaces (e.g., a wall). Other modifications could be made to attach to hanging surfaces in other positions (e.g., between two walls) relative to the rail 210'. In addition, the ends of the rail 210' may be embedded directly in existing hanging surfaces (e.g., the walls of a building, cabinet (similar to FIGS. 35-37), or drawer (similar to FIGS. 38-40)) or attached to existing hanging surfaces, clips, or other mechanical structure.

Like the hook supports 230 of storage rack 200, each shown exemplary preferred hook support 230' has an upper portion 232' (also referred to as a "leg") that is at an angle relative to a lower portion 234' (also referred to as a "foot" or "hook"). The shown angle is approximately 90 degrees, but smaller or larger angles could be used depending on the intended use. The lower portion 234' may have an end obstacle (e.g., a bump) to prevent rackable items from falling off the lower portion 234'. The shown hook support 230' can be described as generally L-shaped, but alternative hook supports could have alternative shapes including, but not limited to, upside-down question marks (e.g., FIGS. 61-69), J-shapes (not shown), check marks (not shown), or other alternative shapes. Also, the depth of the lower portion 234' (or the height of the obstacle) could be adjusted based on the intended use (e.g., deeper lower portions could be provided for thicker rackable items). Similar to hook supports 230 of storage rack 200, the lower portion 234' of the hook support 230' can be inserted into an aperture of a hangable item 202 to suspend the hangable item 202 therefrom, two adjacent (e.g., paired) hook supports 230' can be positioned together to hold a hangable item 204 with an overhang, and/or multiple hook supports 230' may be spaced such that elongate rackable items can be laid across the lower portions 234' of multiple hook supports 230'. Also, one or more specialty hook supports could be associated (e.g., integral or attachable) with baskets or containers for holding small items.

Like the configurations of the hanging storage rack 200, the shown configuration of hanging storage rack 200' are meant to be exemplary as there are limitless configurations. The configurations may be dictated by the specific rackable items that are meant to be held in the hanging storage rack 200'. Exemplary differences include, but are not limited to, different quantities of hook supports 230' and different spacing between the hook supports 230'.

The stop-snap-slide channels 240' are different from the stop-snap-slide channels 240. Specifically, whereas the first hanging storage rack's stop sub-channel 243 and the slide sub-channel 245 at least partially longitudinally overlap and intersect at an angle, the second hanging storage rack's stop sub-channel 243' and the slide sub-channel 245' at least partially longitudinally overlap and are parallel to each other (in a "parallel relationship"). This makes the cross-section of the stop-snap-slide channel 240' consistent through its length.

Figure 54:
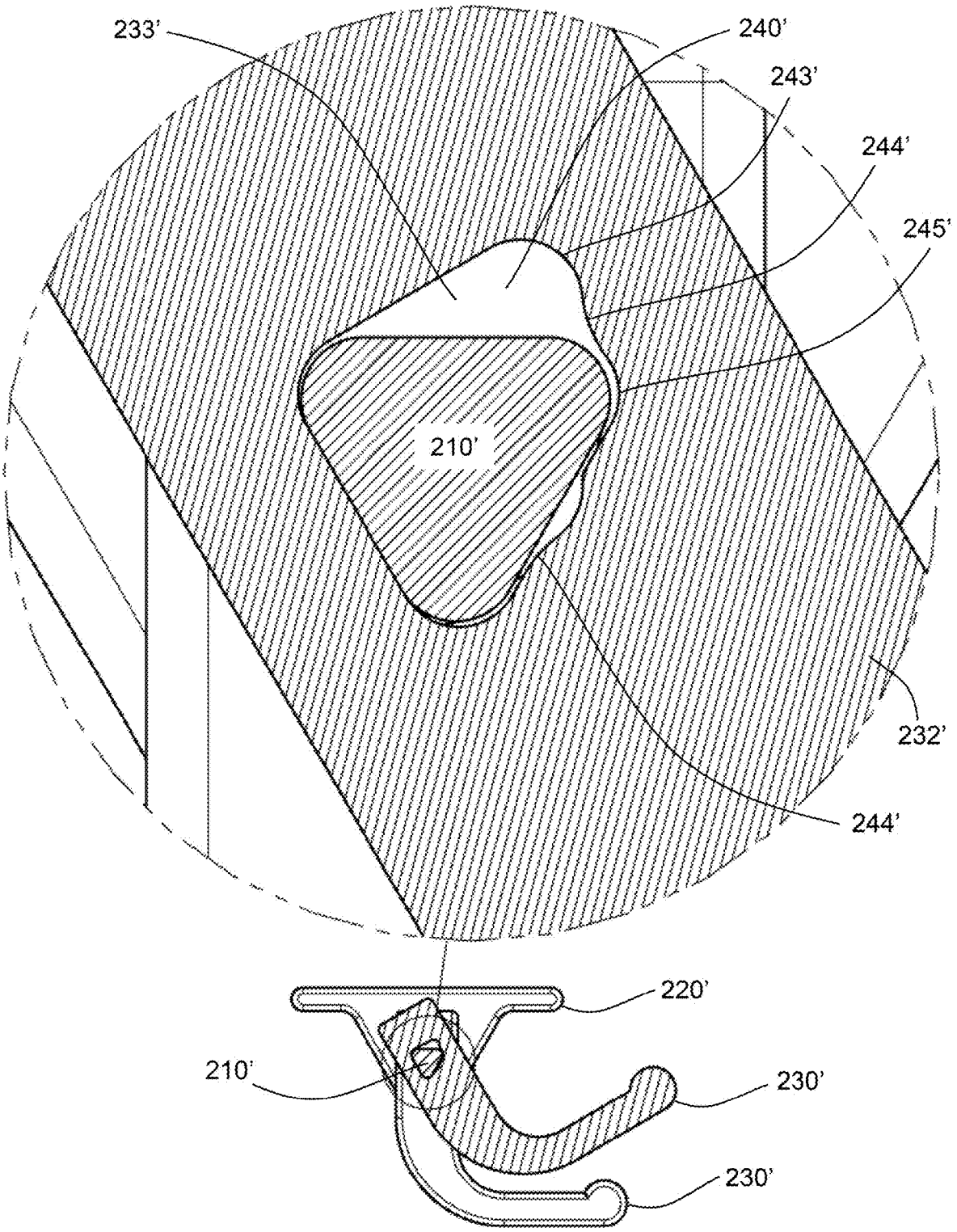
FIG. 54 is a cross-sectional view of a leg of the exemplary preferred second hook support taken along line 54-54 of FIG. 53, an enlarged detail showing a cross-section of the stop-snap-slide channel, a rail positioned in the slide sub-channel of the stop-snap-slide channel.
Figure 55:
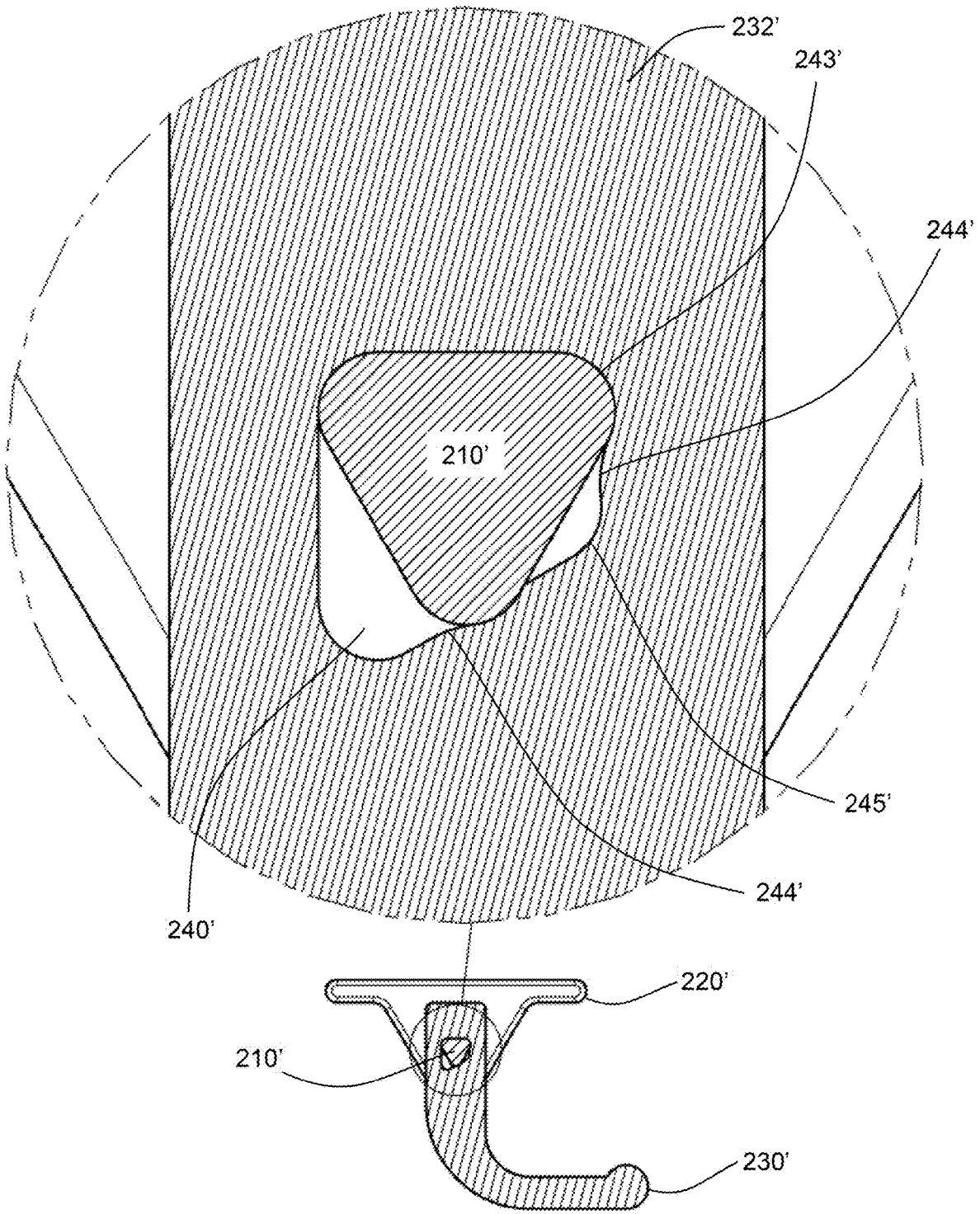
FIG. 55 is a cross-sectional view of a leg of the exemplary preferred second hook support taken along line 55-55 of FIG. 53, an enlarged detail showing a cross-section of the stop-snap-slide channel, a rail positioned in the stop sub-channel of the stop-snap-slide channel.

The shown hook supports 230' each have a stop-snap-slide channel 240' through which the rail 210' is positioned. The stop-snap-slide channels 240' are shown as being defined in the upper portions 232' of the hook supports 230'. As shown in FIGS. 54-55, the stop-snap-slide channels 240' include a stop sub-channel 243' and a slide sub-channel 245'. Because the rail cross-section is substantially triangular, the cross-sections of the sub-channels 243', 245' are substantially triangular. As also shown in FIGS. 54-55, the stop sub-channel 243' and the slide sub-channel 245' at least partially longitudinally overlap. Because the sub-channels 243', 245' are parallel to each other, the cross-section of the stop-snap-slide channel 240' is consistent through its length. Put another way, the first end of the stop-snap-slide channel 240' would be identical to the second end of the stop-snap-slide channel 240'. Where the sub-channels 243', 245' longitudinally overlap they form snap ridges 244'. There is a passage between the stop sub-channel 243' and the slide sub-channel 245' that allows the rail 210' to pass therethrough. When the rail 210' passes through the passage, there may be an audible "snap" as it passes the snap ridges 244'.

The outer perimeter surface of the rail 210' and the inner perimeter surface of the stop sub-channel 243' are preferably partially nearly congruent such that when the rail 210' is positioned within the stop sub-channel 243' there is significant friction therebetween to prevent relative motion therebetween. As shown, the outer perimeter surface of the rail 210' and the inner perimeter surface of the slide sub-channel 245' are preferably partially nearly incongruent in that there is a gap therebetween to allow sliding therebetween. Put another way, using the stop-snap-slide channels 240', each hook support 230' can be held in position in relation to the rail 210' (when the rail 210' is in the stop sub-channel 243') or slide on the rail 210' (when the rail 210' is in the slide sub-channel 245').

Figure 52:
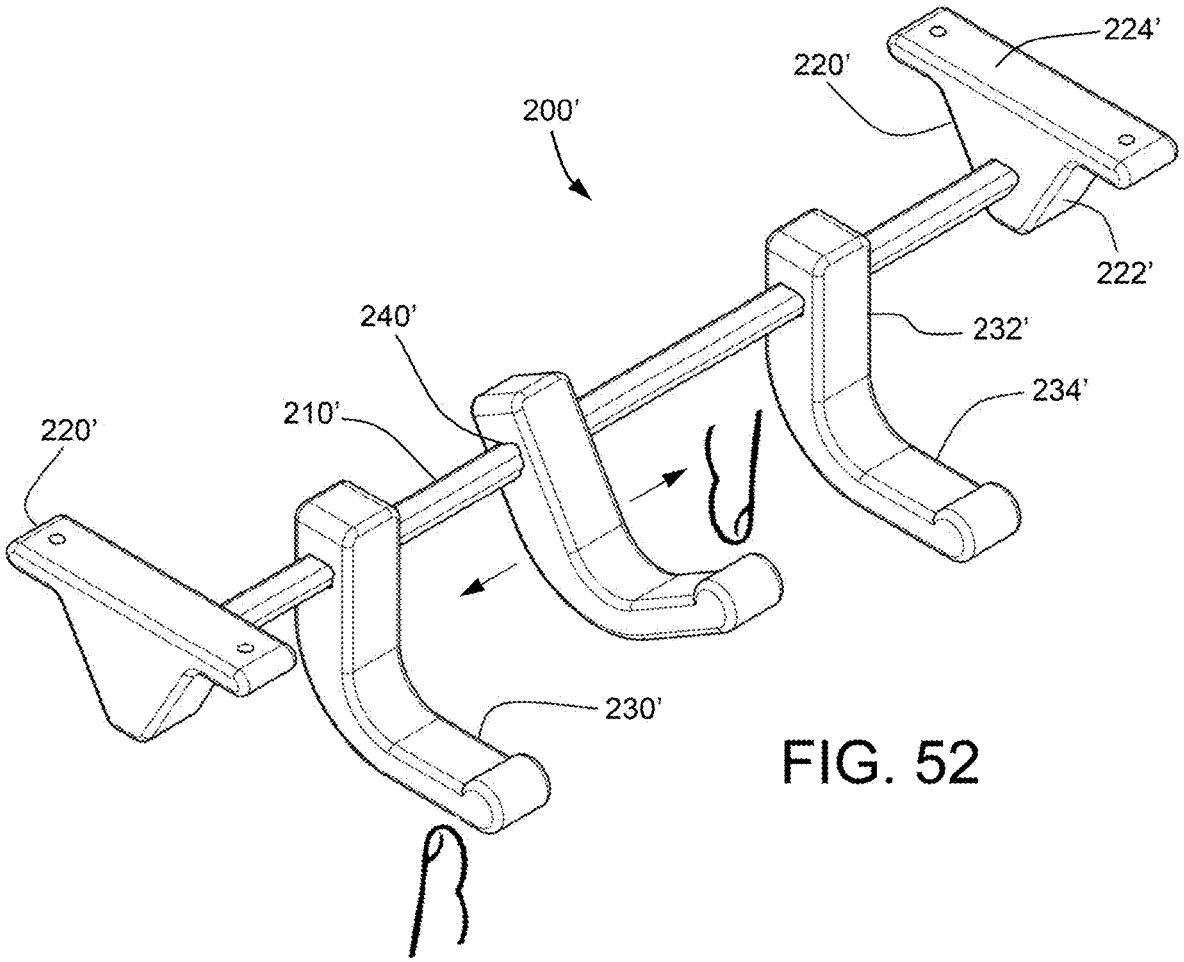
FIG. 52 is a perspective view of an exemplary preferred second hanging storage rack in an exemplary preferred configuration, exemplary preferred second hook supports are shown in the slide orientation (middle hook support) and in the stop orientation (left and right hook supports).
Figure 53:
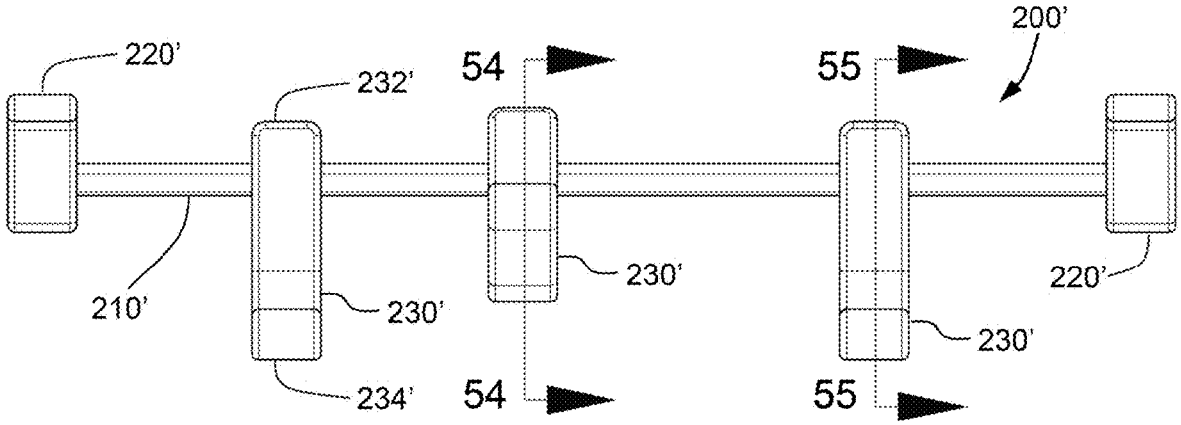
FIG. 53 is a front view of the exemplary preferred second hanging storage rack in an exemplary preferred configuration, exemplary preferred second hook supports are shown in the slide orientation (middle hook support) and in the stop orientation (left and right hook supports).

In FIGS. 52-53, the left and right hook supports 230' are in the stop orientation and the middle hook support 230' in the slide orientation. When the rail 210' is positioned within the stop sub-channel 243' there is significant friction therebetween to prevent relative motion therebetween as shown in FIG. 55. When the rail 210' is positioned within the slide sub-channel 245' there is minimal friction therebetween to allow relative motion (sliding) therebetween as shown in FIG. 54.

Applying directional pressure (directional force) to the lower portion 234' in a direction substantially parallel to the upper portion 232' (which is also both substantially perpendicular to the rail 210' and substantially perpendicular to the lower portion 234') causes the hook supports 230' to rotate around the rail 210' between the sub-channels 243', 245' (e.g., from the stop sub-channel 243' to the slide sub-channel 245', or from the slide sub-channel 245' to the stop sub-channel 243'). This can also be explained as applying relatively vertical (relatively upward or relatively downward) pressure (force) to the lower portion 234' of the hook support 230', which translates to an opposing rotational force between the hook support 230' and the rail 210' and causes the hook support 230' to change position. In a manner similar to that shown in FIGS. 3-5, directional force is applied to a hook support 230' in a stop orientation to transition it to a slide orientation. Once in the slide orientation, the hook support 230' can slide along the rail 210' to a desired location. Directional force can then be applied to the hook support 230' in the slide orientation to transition it to the stop orientation where the hook support 230' is substantially held in place. Desired locations of the hook supports 230' may be determined based on the hangable items 202, 204 to be held on the hanging storage rack 200'.

FIG. 52 shows a finger applying vertical (shown as upward) force to the left hook support 230' (shown in the stop orientation) that would be applied to transition it to the slide orientation (e.g., the position of the middle hook support 230"). In the slide orientation (the middle hook support 230' in FIG. 52), the rail 210' is positioned within the slide sub-channel 245' of the stop-snap-slide channel 240' as shown in FIG. 54. (The face 233' of the adjacent hook support 230' can be seen through the stop-snap-slide channel 240' in FIG. 54.) When the rail 210' is positioned within the slide sub-channel 245' the relative minimal friction therebetween allows relative sliding motion therebetween (shown by the arrows on both sides of the right hook support 230' in FIG. 52).

FIG. 52 also shows a finger applying vertical (shown as downward) force to the middle hook support 230' (shown in the slide orientation) that would be applied to transition it to the stop orientation (e.g., the position of the left or right hook supports 230"). In the stop orientation (the left and right hook supports 230' in FIG. 52), the rail 210' is positioned within the stop sub-channel 243' of the stop-snap-slide channel 240' as shown in FIG. 55. (The face (unlabeled) of the rail end holder 220' can be seen through the stop-snap-slide channel 240' in FIG. 55.)

It should be noted that in actual use the "force" (or pressure) may be applied differently than shown. For example, the "force" may be applied in reverse (e.g., instead of using a finger to push generally downward, the downward force may be applied from the opposite side by pulling generally downward). Also, depending on hand strength, more than one finger may be required to provide the requisite force. Finally, the angle of the force may depend on the shape of the stop-snap-slide channel, and there may be a tolerance to allow the angle of force to vary.

FIGS. 56-60:

FIGS. 56-60 show an exemplary preferred third hanging storage rack 200" in an exemplary configuration as well as components thereof. The third hanging storage rack 200" is similar to the first hanging storage rack 200 and second hanging storage rack 200'. However, whereas the first hanging storage rack's stop sub-channel 243 and the slide sub-channel 245 at least partially longitudinally overlap and intersect at an angle, like the second hanging storage rack 200', the third hanging storage rack's stop sub-channel 243" and the slide sub-channel 245" at least partially longitudinally overlap and are parallel to each other. Also, whereas each hook support 230' of the second hanging storage rack 200' toggles between two rotational positions (toggling between a stop orientation (with the rail 210' positioned within the stop sub-channel 243') and a slide orientation (with the rail 210' positioned within the slide sub-channel 245')), the hook support 230" of the third hanging storage rack 200" is able to rotate around the rail 210" and has six rotational positions.

FIGS. 56-60 show the hanging storage rack 200" with a single rail 210", rail end holders 220", and a plurality of hook supports 230" (each shown as having an upper portion 232" at an angle relative to a lower portion 234"). The hanging storage rack 200" may be used to hang rackable items in a manner similar to the way the hangable items 202, 204 are hung in FIG. 51.

The rail 210" of the shown hanging storage rack 200" is shown as having an at least substantially triangular cross-section. Alternative rails could have alternative cross-sections. For example, the cross-section could be at least substantially square, in which case the stop-snap-slide channels 240" would be two overlapping squares and there would be eight possible rotational positions of the hook supports.

Like the rail 210 of storage rack 200, the rail 210" of the shown hanging storage rack 200" is shown as being secured at each end by a rail end holder 220". Each rail end holder 220" is shown as having a rail connector 222" and a base 224". Although shown as distinct, the rail connector and base may be indistinguishable (e.g., having a single shape without distinguishable parts such as a semi-circle or a triangle). The rail end holder rail connector 222" is shown as having an aperture into which the rail 210" is positioned and secured. The aperture preferably has substantially the same cross-section as the rail 210. The ends of the rail 210" may be secured to the rail end holder 220" (including within the aperture) using adhesive or mechanical structure (e.g., clips). Alternative rail end holder rail connectors could include or be replaced with clips or other mechanical structure. The shown rail end holder base 224" is meant to be exemplary and is designed to mate with a hanging surface (e.g., a wall or ceiling). The rail end holder base 224" is shown with at least one aperture into which a connector (e.g., a screw) can be positioned to secure the rail end holder 220" to the hanging surface. Alternative rail end holder bases could be adapted for alternative hanging surfaces. For example, appropriate pegs, hooks, or locks could be used instead of the shown base if the hanging surface is a pegboard. Another example is that suction cups could be used to attach to smooth hanging surfaces. Still further, the rail end holders 220" can be oriented to attach to horizontal hanging surfaces (e.g., the ceiling or under a shelf) or to attach to vertical hanging surfaces (e.g., a wall). Other modifications could be made to attach to hanging surfaces in other positions (e.g., between two walls) relative to the rail 210". In addition, the ends of the rail 210" may be embedded directly in existing hanging surfaces (e.g., the walls of a building, cabinet (similar to FIG. 35-37), or drawer (similar to FIGS. 38-40)) or attached to existing hanging surfaces, clips, or other mechanical structure.

Like the hook supports 230 of storage rack 200, each shown exemplary preferred hook support 230" has an upper portion 232" (also referred to as a "leg") that is at an angle relative to a lower portion 234" (also referred to as a "foot" or "hook"). The shown angle is approximately 90 degrees, but smaller or larger angles could be used depending on the intended use. The lower portion 234" may have an end obstacle (e.g., a bump) to prevent rackable items from falling off the lower portion 234". The shown hook support 230" can be described as generally L-shaped, but alternative hook supports could have alternative shapes including, but not limited to, upside-down question marks (e.g., FIGS. 61-69), J-shapes (not shown), check marks (not shown), or other alternative shapes. Also, the depth of the lower portion 234" (or the height of the obstacle) could be adjusted based on the intended use (e.g., deeper lower portions could be provided for thicker rackable items). Similar to hook supports 230 of storage rack 200, the lower portion 234" of the hook support 230" can be inserted into an aperture of a hangable item 202 to suspend the hangable item 202 therefrom, two adjacent (e.g., paired) hook supports 230" can be positioned together to hold a hangable item 204 with an overhang, and/or multiple hook supports 230" may be spaced such that elongate rackable items can be laid across the lower portions 234" of multiple hook supports 230". Also, one or more specialty hook supports could be associated (e.g., integral or attachable) with baskets or containers for holding small items.

Like the configurations of the hanging storage rack 200, the shown configuration of hanging storage rack 200" are meant to be exemplary as there are limitless configurations. The configurations may be dictated by the specific rackable items that are meant to be held in the hanging storage rack 200". Exemplary differences include, but are not limited to, different quantities of hook supports 230" and different spacing between the hook supports 230".

The stop-snap-slide channels 240" are different than the stop-snap-slide channels 240. Specifically, whereas the first hanging storage rack's stop sub-channel 243 and the slide sub-channel 245 at least partially longitudinally overlap and intersect at an angle, the third hanging storage rack's stop sub-channel 243" and the slide sub-channel 245" at least partially longitudinally overlap and are parallel to each other. This makes the cross-section of the stop-snap-slide channel 240" consistent through its length.

Figure 58:
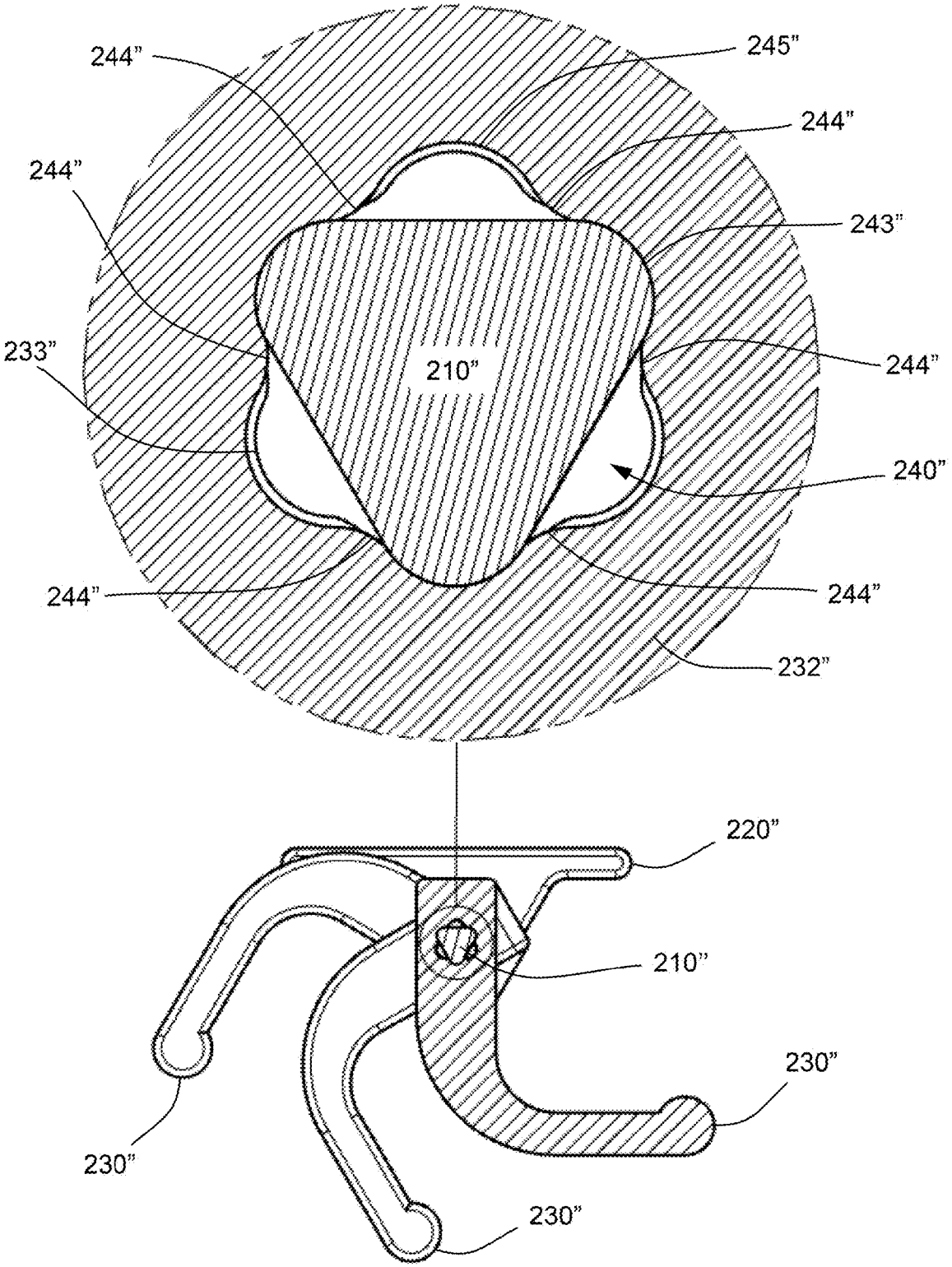
FIG. 58 is a cross-sectional view of a leg of the exemplary preferred third hook support taken along line 58-58 of FIG. 57, an enlarged detail showing a cross-section of the stop-snap-slide channel, a rail positioned in the stop sub-channel of the stop-snap-slide channel.
Figure 59:
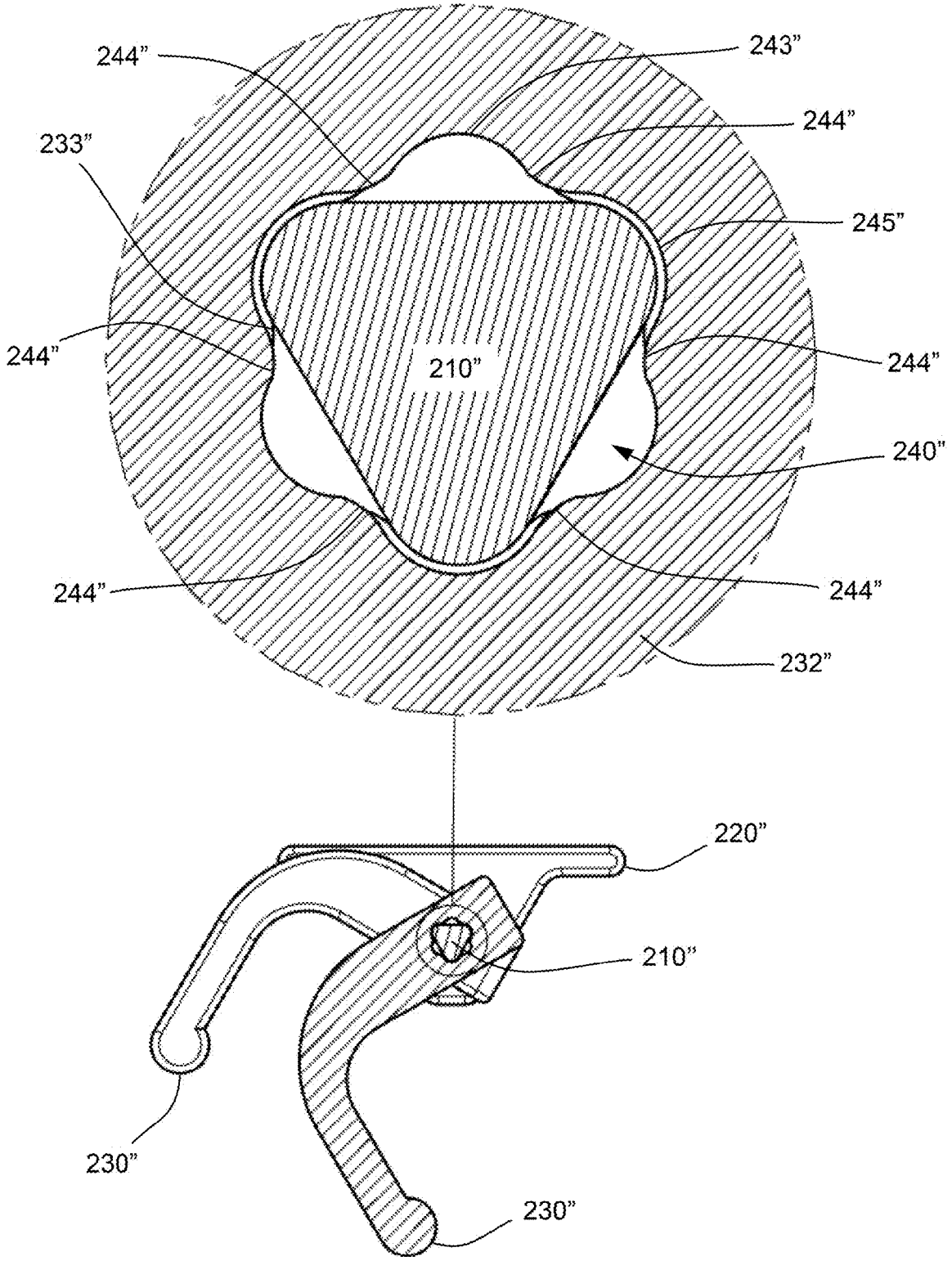
FIG. 59 is a cross-sectional view of a leg of the exemplary preferred third hook support taken along line 59-59 of FIG. 57, an enlarged detail showing a cross-section of the stop-snap-slide channel, a rail positioned in the slide sub-channel of the stop-snap-slide channel.
Figure 60:
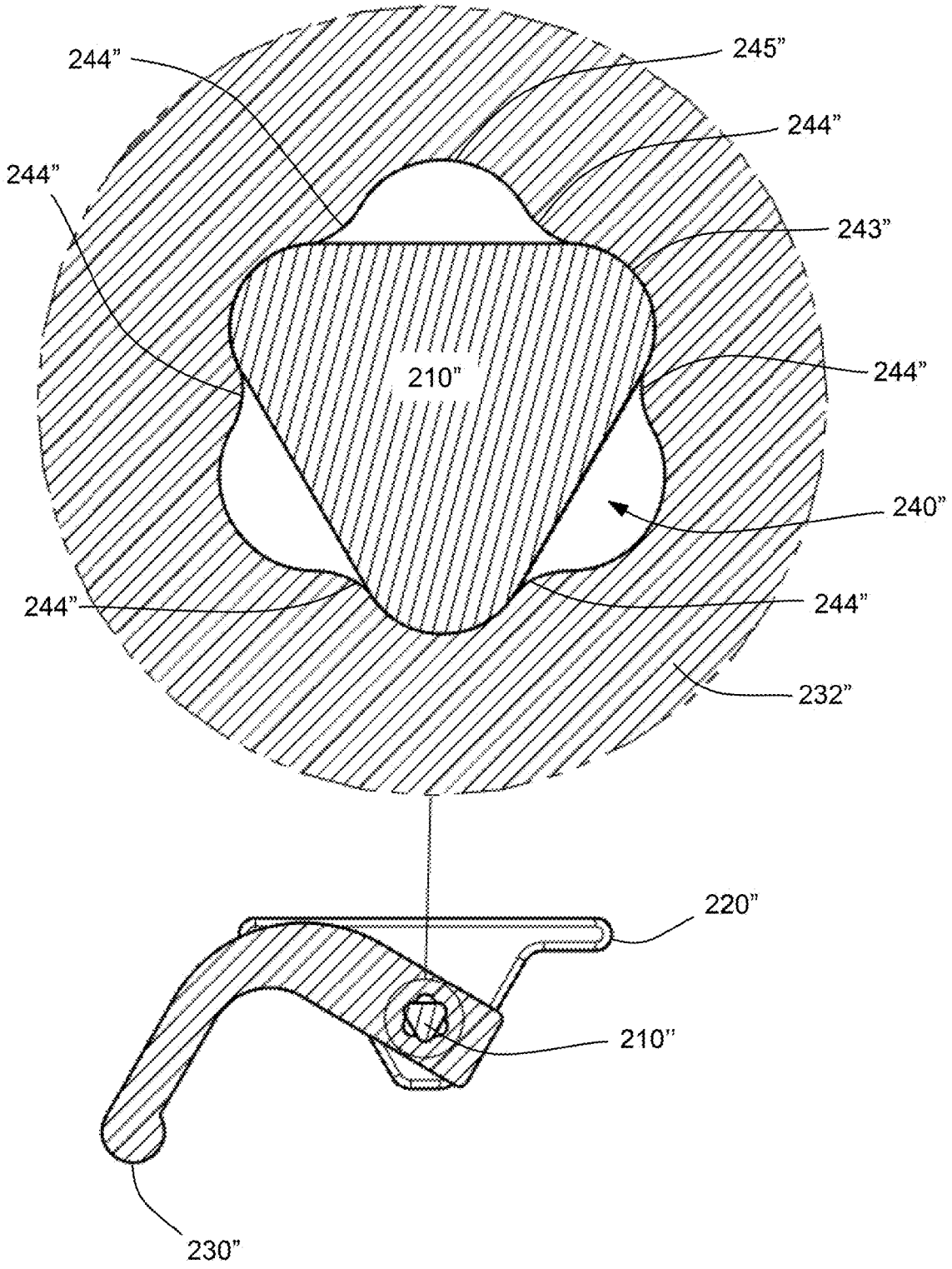
FIG. 60 is a cross-sectional view of a leg of the exemplary preferred third hook support taken along line 60-60 of FIG. 57, an enlarged detail showing a cross-section of the stop-snap-slide channel, a rail positioned in the stop sub-channel of the stop-snap-slide channel.
Figure 61:
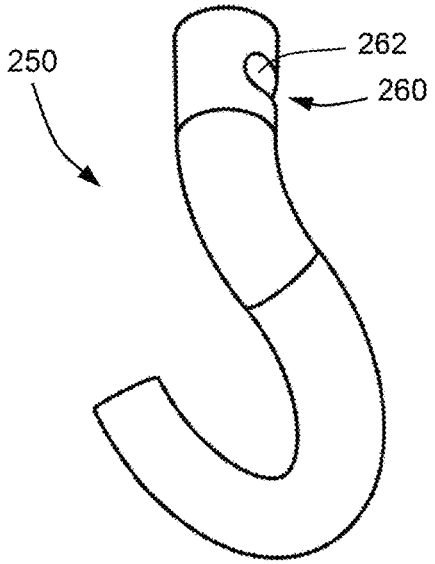
FIG. 61 is a perspective side view of an exemplary preferred fourth hook support showing a first end of the stop-snap-slide channel, the slide sub-channel having a rail access passageway.
Figure 62:
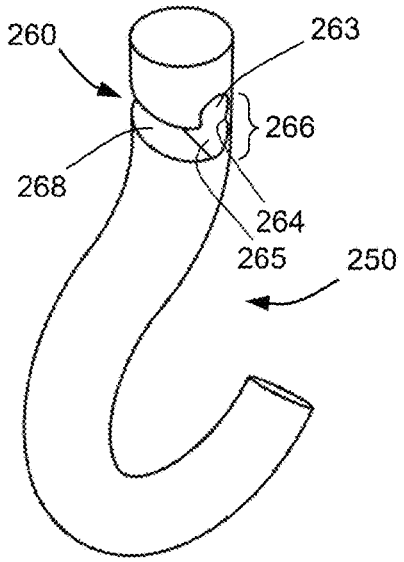
FIG. 62 is a perspective side view of the exemplary preferred fourth hook support showing a second end of the stop-snap-slide channel, the slide sub-channel having a rail access passageway.
Figure 63:
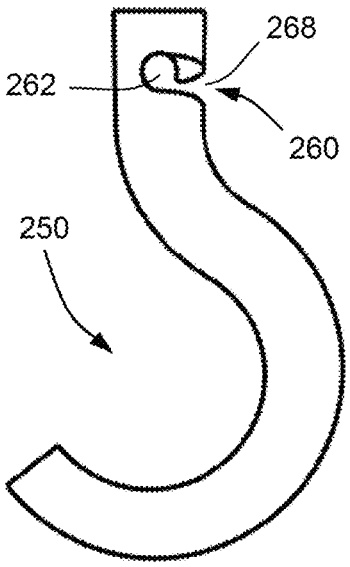
FIG. 63 is a side view of the exemplary preferred fourth hook support showing the first end of the stop-snap-slide channel, the slide sub-channel having a rail access passageway.
Figure 64:
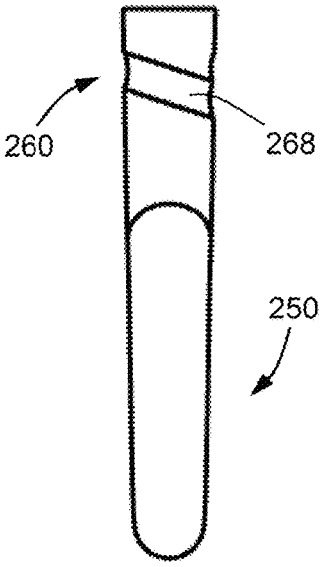
FIG. 64 is a rear view of the exemplary preferred fourth hook support, the slide sub-channel having a rail access passageway.
Figure 65:
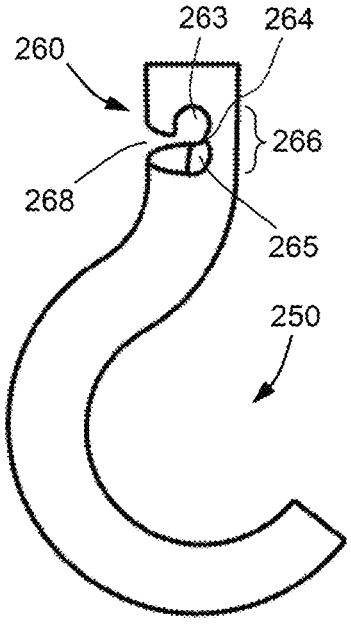
FIG. 65 is a side view of the exemplary preferred fourth hook support showing the second end of the stop-snap-slide channel, the slide sub-channel having a rail access passageway.

The shown hook supports 230" each have stop-snap-slide channels 240" through which the rail 210" is positioned. The stop-snap-slide channels 240" are shown as being defined in the upper portions 232" of the hook supports 230". As shown in FIGS. 58-60, the stop-snap-slide channels 240" include a stop sub-channel 243" and a slide sub-channel 245". Because the rail cross-section is substantially triangular, the cross-sections of the sub-channels 243", 245" are substantially triangular. As also shown in FIGS. 58-60, the stop sub-channel 243" and the slide sub-channel 245" at least partially longitudinally overlap. Because the sub-channels 243", 245" are parallel to each other, the cross-section of the stop-snap-slide channel 240" is consistent through its length. Put another way, the first end of the stop-snap-slide channel 240" would be identical to the second end of the stop-snap-slide channel 240". Where the sub-channels 243", 245" longitudinally overlap they form snap ridges 244". There is a passage between the stop sub-channel 243" and the slide sub-channel 245" that allows the rail 210" to pass therethrough. When the rail 210" passes through the passage, there may be an audible "snap" as it passes the snap ridges 244".

The outer perimeter surface of the rail 210" and the inner perimeter surface of the stop sub-channel 243" are preferably partially nearly congruent such that when the rail 210" is positioned within the stop sub-channel 243" there is significant friction therebetween to prevent relative motion therebetween. As shown, the outer perimeter surface of the rail 210" and the inner perimeter surface of the slide sub-channel 245" are preferably partially nearly incongruent in that there is a gap therebetween to allow sliding therebetween. Put another way, using the stop-snap-slide channels 240", each hook support 230" can be held in position in relation to the rail 210" (when the rail 210" is in the stop sub-channel 243") or slide on the rail 210" (when the rail 210" is in the slide sub-channel 245").

Figure 56:
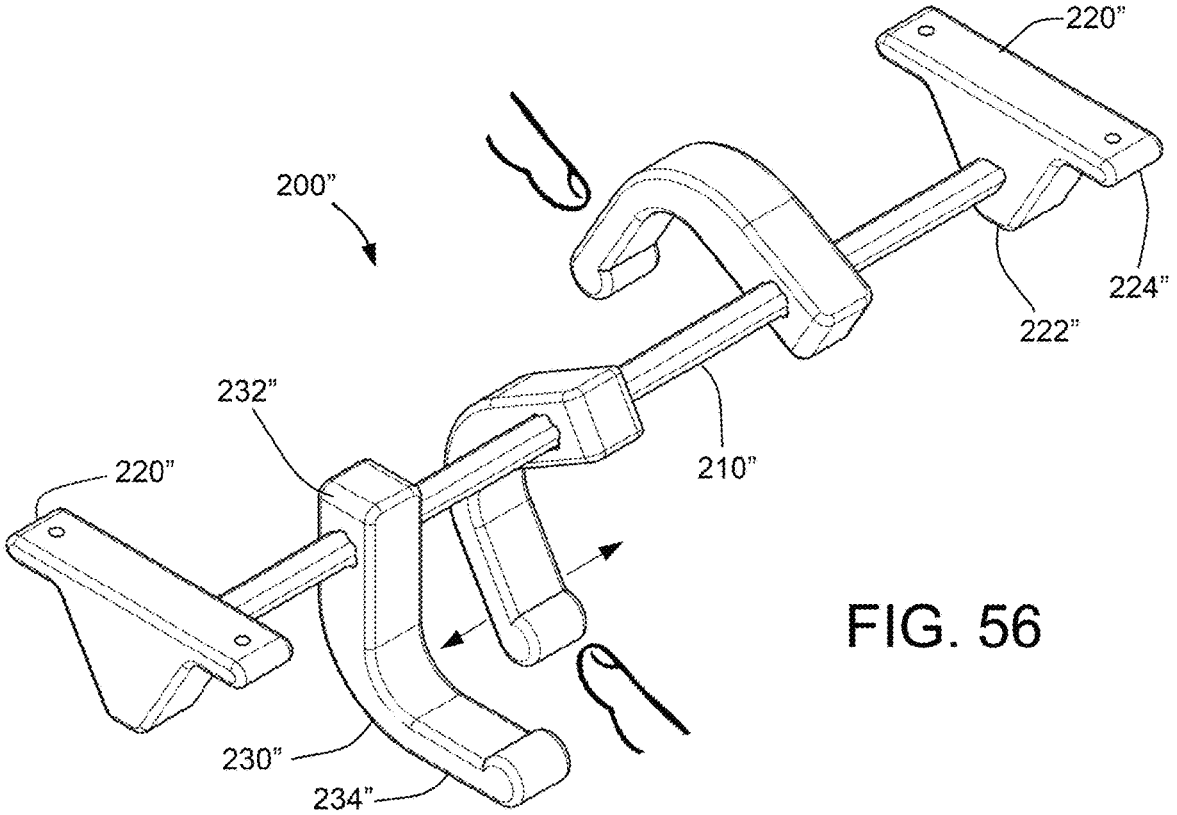
FIG. 56 is a perspective view of an exemplary preferred third hanging storage rack in an exemplary preferred configuration, exemplary preferred third hook supports are shown in the slide orientation (middle hook support) and in the stop orientation (the left hook support in a first stop orientation and right hook support in a second stop orientation).
Figure 57:
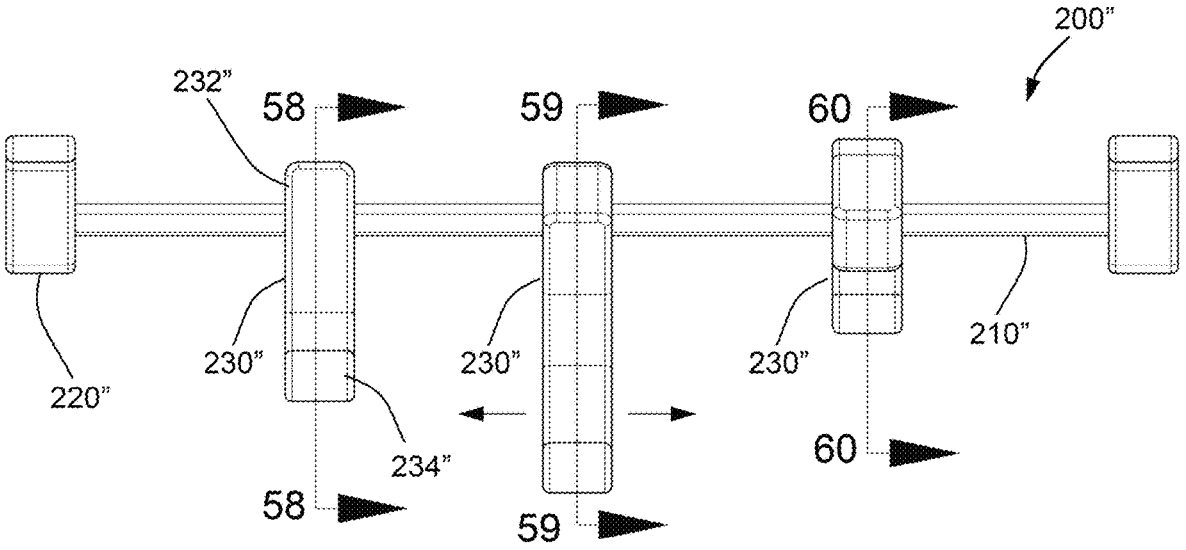
FIG. 57 is a front view of the exemplary preferred third hanging storage rack in an exemplary preferred configuration, exemplary preferred third hook supports are shown in the slide orientation (middle hook support) and in the stop orientation (the left hook support in a first stop orientation and right hook support in a second stop orientation).

Each hook support 230" of the shown third hanging storage rack has six rotational positions, three of which are in stop orientations and three of which are in slide orientations. The hook support 230" can be rotated around the rail 210" in either rotational direction (rotating forward or rotating backward) alternating between the stop orientations and the slide orientations. FIGS. 56-60 show three of the rotational positions; the other three would continue the rotation of the hook support 230" around the rail 210". FIGS. 56-57 show the left hook support 230" in a stop orientation (the rotational position could be referred to as a "use position"), the cross-section of which is shown in FIG. 58. FIGS. 56-57 show the middle hook support 230" in a slide orientation, the cross-section of which is shown in FIG. 59. FIGS. 56-57 show the right hook support 230" in a stop orientation (the rotational position could be referred to as an "out-of-the-way position"), the cross-section of which is shown in FIG. 60. When the rail 210" is positioned within the stop sub-channel 243" (e.g., FIGS. 58 and 60) there is significant friction therebetween to prevent relative motion therebetween. When the rail 210" is positioned within the slide sub-channels 245" (e.g., FIG. 59) there is minimal friction therebetween to allow relative motion (sliding) therebetween.

Applying directional pressure (directional force) to the lower portion 234" causes the hook supports 230" to rotate around the rail 210" between the sub-channels 243", 245" (e.g., alternating from a stop sub-channel 243" to a slide sub-channel 245", or alternating from a slide sub-channel 245" to a stop sub-channel 243"). This can also be explained as applying directional (angled upward or angled downward) pressure (force) to the lower portion 234" of the hook support 230", which translates to an opposing rotational force between the hook support 230" and the rail 210" and causes the hook support 230" to change rotational position. In a manner similar to that shown in FIGS. 3-5, pressure (force) is applied to a hook support 230" in a stop orientation to transition it to a slide orientation. Once in the slide orientation, the hook support 230" can slide along the rail 210" to a desired location. Force can then be applied to the hook support 230" in the slide orientation to transition it to a stop orientation where the hook support 230" is substantially held in place. Desired locations of the hook supports 230" may be determined based on the hangable items 202, 204 to be held on the hanging storage rack 200".

FIG. 56 shows a finger applying directional (shown as angled upward) force to the middle hook support 230" (shown in a slide orientation) that would be applied to transition it to a stop orientation. (Applying directional force in the opposite direction would transition the middle hook support 230" forward to a different stop orientation (e.g., the "use position" of the left hook support 230").) In the slide orientation, the rail 210" is positioned within the slide sub-channel 245" of the stop-snap-slide channel 240" as shown in FIG. 59. (The face 233" of the adjacent hook support 230" can be seen through the stop-snap-slide channel 240" in FIG. 59.) When the rail 210" is positioned within the slide sub-channel 245" the relative minimal friction therebetween allows relative sliding motion therebetween (shown by the arrows on both sides of the right hook support 230" in FIG. 56).

FIG. 56 also shows a finger applying directional (shown as angled downward) force to the right hook support 230" (shown in the stop orientation in the "out-of-the-way position") that would be applied to transition it to a slide orientation (e.g., the rotational position of the middle hook support 230"). (Applying directional force in the opposite direction would transition the right hook support 230" upward to a different slide orientation (not shown).) In the stop orientation, the rail 210" is positioned within the stop sub-channel 243" of the stop-snap-slide channel 240" as shown in FIG. 60. (The face (unlabeled) of the rail end holder 220" can be seen through the stop-snap-slide channel 240" in FIG. 60.)

It should be noted that in actual use the "force" (or pressure) may be applied differently than shown. For example, the "force" may be applied in reverse (e.g., instead of using a finger to push generally downward, the downward force may be applied from the opposite side by pulling generally downward). Also, depending on hand strength, more than one finger may be required to provide the requisite force. Finally, the angle of the force may depend on the shape of the stop-snap-slide channel, and there may be a tolerance to allow the angle of force to vary.

FIGS. 61-69:

The shown adjustable storage racks 100 (FIGS. 1-40), 200 (FIGS. 41-51), 200' (FIGS. 52-55), 200" (FIGS. 56-60), 300 (FIG. 70), 300' (FIG. 71) each have at least one rail 110, 210, 210', 210", 310 and at least one support 120, 130, 150, 160, 170, 230, 230', 230", 330. Each support has at least one stop-snap-slide channel 140, 240, 240', 240", 340. The stop-snap-slide channels 140, 240, 240', 240", 340 each have at least one stop sub-channel 143, 243, 243', 243", 343 partially overlapping with at least one slide sub-channel 145, 245, 245', 245", 345. Because the external periphery of the stop-snap-slide channels 140, 240, 240', 240", 340 are shown as being "solid" (no breaks), the supports 120, 130, 150, 160, 170, 230, 230', 230", 330 are attached to the rail(s)

110, 210, 210', 210", 310 by inserting an end of the rail into each stop-snap-slide channel 140, 240, 240', 240", 340 (and particularly the into the slide sub-channel 145, 245, 245', 245", 345), sliding the support(s) into place, and "snapping" them into the stop sub-channel 143, 243, 243', 243", 343.).

FIGS. 61-69 show a fourth hook support 250 that has a stop-snap-slide channel 260 with a rail access passageway 268 that allows the hook support 250 to be inserted at a mid-point along the rail 210. (The hook support 250 does not have to be added from the end of the rail 210 and slid into place.) The shown stop-snap-slide channel 260 has at least one stop sub-channel 263 partially overlapping with at least one slide sub-channel 265. Where the sub-channels 263, 265 longitudinally overlap they form a snap ridge 264 on both sides of the stop-snap-slide channel 260. (The stop sub-channel 263 and the slide sub-channel 265 are also shown as intersecting at an angle (an "angled relationship") in which the sub-channels are not parallel to each other.) At the first end 262, the stop sub-channel 263 and the slide sub-channel 265 almost completely overlap. At the second end 266, the stop sub-channel 263 and the slide sub-channel 265 overlap to a lesser extent to form a rough 8-shape. Where the sub-channels 263, 265 longitudinally overlap, they form a snap ridge 264 on both sides of the stop-snap-slide channel 260. Defined between the snap ridges 264 is a passage between the stop sub-channel 263 and the slide sub-channel 265 that allows the rail 210 to pass therebetween. When the rail 210 passes through the passage, there may be an audible "snap" as it passes the snap ridges 264.

The configuration of the stop-snap-slide channel 260 is at least substantially the same as the configuration (e.g., overlapping and intersecting) of the stop-snap-slide channel 140 of FIGS. 1-40, the stop-snap-slide channel 240 of FIGS. 41-51, and the stop-snap-slide channel 240' of FIGS. 52-55. The slide orientation and snap orientation of the hook support 250 would function in substantially the same manner as they function with the stop-snap-slide channels 140, 240, 240'.

Unlike stop-snap-slide channels with a "solid" (no breaks) external periphery, FIGS. 61-69 show a hook support 250 that has a stop-snap-slide channel 260 with a rail access passageway 268 that allows the hook support 250 to be inserted at a mid-point along the rail 210. As shown, preferably the rail access passageway 268 provides access to the slide sub-channel 265. Although shown as a relatively straight short passage, the rail access passageways may have alternative shapes. For example, rail access passageways may be angled (e.g., at a diagonal), longer, cornered (e.g., zigzagged or having a right angle), curved (e.g., wavy), and/or having other alternative shapes.

Figure 66:
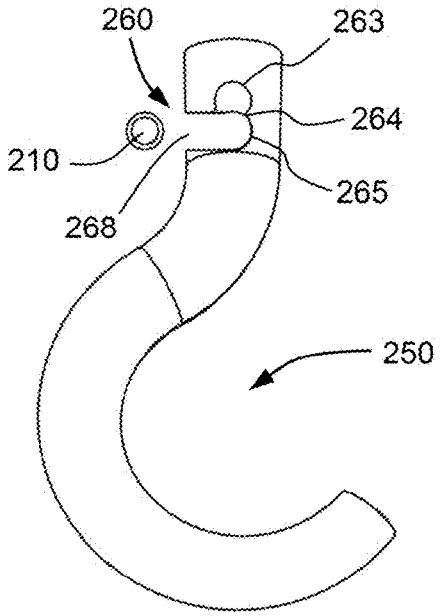
FIG. 66 is a side view of the exemplary preferred fourth hook support showing the second end of the stop-snap-slide channel and a rail outside the stop-snap-slide channel.
Figure 67:
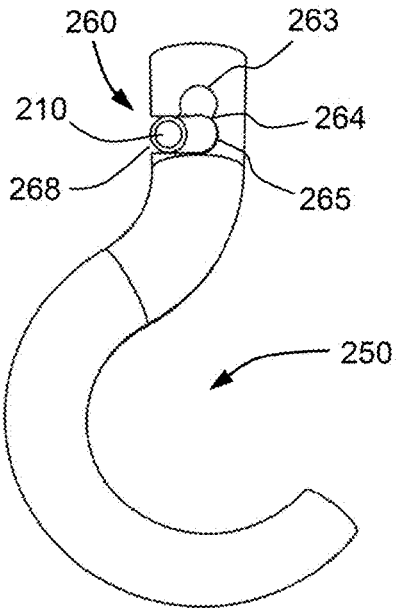
FIG. 67 is a side view of the exemplary preferred fourth hook support showing the second end of the stop-snap-slide channel and the rail entering the rail access passageway.
Figure 68:
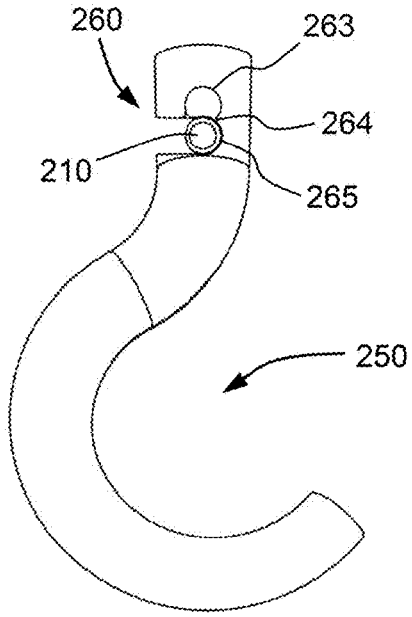
FIG. 68 is a side view of the exemplary preferred fourth hook support showing the second end of the stop-snap-slide channel and the rail positioned in the slide sub-channel.
Figure 69:
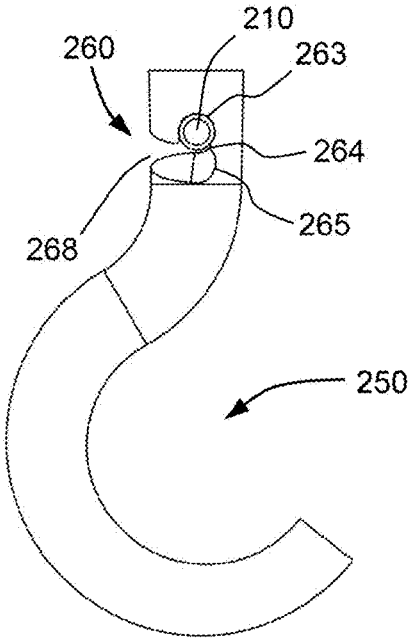
FIG. 69 is a side view of the exemplary preferred fourth hook support showing the second end of the stop-snap-slide channel and the rail positioned in the stop sub-channel.

FIGS. 66-69 show the interaction between a rail 210 and a stop-snap-slide channel 260 of the hook support 250. FIG. 66 shows the rail 210 outside the stop-snap-slide channel 260 of the hook support 250. FIG. 67 shows the rail 210 entering the rail access passageway 268. FIG. 68 shows the rail 210 positioned within the slide sub-channel 263. In this slide orientation, the hook support 250 can be slid along the rail 210 to a desired position. FIG. 69 shows the rail 210 positioned within the stop sub-channel 265. In this stop orientation, the hook support 250 can be held in place relative to the rail 210 in a desired position.

As mentioned, the stop-snap-slide channels 140, 240 are shown as being "solid" (no breaks). These stop-snap-slide channels 140, 240 could, however, have a slide sub-channel 145, 245 with a rail access passageway similar to the rail access passageway 268 (and variations thereof disclosed herein). Adding such a rail access passageway to a slide sub-channel 145, 245 would allow the support 120, 130, 150, 160, 170, 230 to be inserted at a mid-point along the rail. For supports 120, 130, 150 having multiple stop-snap-slide channels 140, each slide sub-channel 145 would have a rail access passageway. Although the shown configuration of the stop-snap-slide channel 260 of FIGS. 61-69 has a stop sub-channel 263 that partially overlaps with and is in an angled relationship with a slide sub-channel 265 (similar to the configurations of the stop-snap-slide channels of FIGS. 1-40 and FIGS. 41-51), a rail access passageway could be added to the slide sub-channels 245', 245", 345 of FIGS. 52-55, FIGS. 56-60, and FIGS. 70-71 (although the plugs would most likely need to be positioned at least near the edge of the shelves).

Although not shown, rail access passageways may have a door or lock that at least partially blocks the rail access passageway. The purpose of the door or lock would be to make it more difficult for the rail to escape the stop-snap-slide channel.

Variations:

FIG. 70 shows an adjustable shelf storage rack 300 that has two vertical rails 310 and a plurality of exemplary preferred horizontal shelf supports 330. The shelf supports 330 may be used to hold exemplary rackable items 302 (items that can be placed on the shelves 330). Each rail 310 is positioned within a stop-snap-slide channel 340 of the shelf supports 330. The shelf supports 330 are adjustably positionable (slidable upward and downward as shown by the arrows) on the rails 310. Like the stop-snap-slide channel 140 of FIGS. 1-40, the stop-snap-slide channel 340 preferably has a stop sub-channel and a slide sub-channel that overlap and intersect to form a snap ridge on both sides of the stop-snap-slide channel 340. The top and bottom shelf supports 330 are in a stop orientation (the rail 310 in the stop sub-channel) and the middle shelf support 330 is in a slide orientation (the rail 310 in the slide sub-channel). An upward "force" (or pressure) is applied to the shelf supports 330 to transition them from a stop orientation to a slide orientation. In the slide orientation, the shelf supports 330 can be slid upwards or downwards. When a shelf support 330 is in the desired position, a downward force (and possibly a hold to prevent movement in relation to the rail 310) is applied to the shelf support 330 to transition it from the slide orientation to the stop orientation.

One of the reasons that the shelf supports 330 are included herein is to show that the supports contemplated may be of many different forms (not just different sizes and shapes) depending on the intended purpose of the adjustable storage rack. Other supports may be concave (e.g., boxes or baskets), straight (e.g., pegs), elongate (e.g., a towel rack or a curtain rod), or other forms known or yet to be discovered. Non-limiting examples of these alternative forms include, but are not limited to:

- vertical rails with adjustable box-shaped supports to function as an inbox;
- a vertical rail with adjustable basket-shaped supports for holding fruit;
- a plurality of parallel vertical and/or horizontal rails, each rail having at least one adjustable peg support that can be positioned in a manner similar to pegs on a peg board for holding tools;
- at least one horizontal rail, each rail having at least one adjustable vertical border wall support that can be used to divide a drawer, shelf, box, or other container into distinct sections;

vertical rails with at least one adjustable rail support spanning therebetween that can be used to hang towels at different heights (e.g., for adults and children); and a vertical rail on each side of a window, an adjustable rail support spanning therebetween that can be used as a curtain rod to allow the curtain to be raised or lowered to provide privacy, shade, or access to a view as needed.

It should be noted that alternative stop-snap-slide channel systems could be defined in components other than "supports." For example, a seat of a vehicle (e.g., a car) with stop-snap-slide channel defined on the bottom thereof can be associated with one or more rails on the floor of the car so that the seat can be secured in place (stopped) or slid into alternative positions. Another example is that one or more adjustable lids with stop-snap-slide channels defined in tabs extending from the edges and/or bottom thereof can be associated with rails associated with the upper side edges of a container (e.g., a pet carrier or a picnic basket) so that the lid(s) close in the stop position and slide to allow access to the container.

While the stop-snap-slide channels have been shown as being formed in (integral with) the shown supports, FIG. 71 shows a system 300' with distinct "plugs" 350' that can be associated with a component 330' (shown as a portion of a shelf support). As shown, a plug 350' may be associated with a "plug bore" 332' of a support 330'. Using a non-integral plug 350' may make manufacturing easier and/or possible. For example, creating a stop-snap-slide channel in particularly large supports may be technically difficult. Also, using a non-integral plug 350' allows supports to be made from materials (e.g., wood, glass, or particularly hard or inflexible materials) that might otherwise be difficult to manufacture with a stop-snap-slide channel 340'. FIG. 71 shows one plug 350' (right) rotated to show a bottom surface of the plug 350', one plug 350' (middle) positioned above a plug bore 332', and one plug 350' (left) embedded in the shelf support 330'.

The shown plug 350' (having a top 352' and a bottom 356') is designed to mate with (e.g., fit in) a bore 332' of the support 330'. (The shapes of the plug 350' and bore 332' are meant to be exemplary and could be adapted for an intended purpose.) The plug 350' may be secured within the bore 332' using, for example, adhesive, friction fit, gravity, and/or mechanical devices (e.g., screws). The shown plug 350' has a stop-snap-slide channel 340' therethrough. The shown stop-snap-slide channel 340' has a first end 342' associated with the plug top 352' and a second end 346' associated with the plug bottom 356'. The stop-snap-slide channel 340' has a stop sub-channel 343' and a slide sub-channel 345' that partially overlap and intersect at an angle (in an "angled relationship") in which the sub-channels are not parallel to each other. At the first end 342', the stop sub-channel 343' and the slide sub-channel 345' almost completely overlap. At the second end 346', the stop sub-channel 343' and the slide sub-channel 345' overlap to a lesser extent to form a rough 8-shape. Where the sub-channels 343', 345' longitudinally overlap, they form a snap ridge 344' on both sides of the stop-snap-slide channel 340'. Defined between the snap ridges 344' is a passage between the stop sub-channel 343' and the slide sub-channel 345' that allows a rail to pass therebetween. When the rail passes through the passage, there may be an audible "snap" as it passes the snap ridges 344'. The shown stop-snap-slide channel 340' is at least similar to the stop-snap-slide channel 140 shown in FIGS. 1-40, but other stop-snap-slide channels (e.g., stop-snap-slide channels 240, 240', 240", 260) could be used depending on the intended purpose.

The shown storage racks are meant to be exemplary and variations are contemplated. For example, different quantities and types of supports may be used. An example of this might be replacing one or more support(s) 120, 130 with alternative support(s) 150, 160, 170. Another variation is that the cross-sectional shape of the rails and the corresponding sub-channels may be varied from the specific shapes shown in the various examples. For example, versions shown with a circular cross-sectional shape may be implemented with a triangular cross-sectional shape, and versions shown with a triangular cross-sectional shape may be implemented with a circular cross-sectional shape.

The materials for the storage racks and components thereof would be chosen based on their intended purpose. The materials are preferably sturdy and durable enough for their intended purpose. Storage racks to be used with kitchenware are preferably constructed from material that is food grade, sterilizable, and both scratch resistant and unlikely to scratch the stored pots and pans (or their coatings). Storage racks to be used with medical instruments are preferably constructed from material that is sterilizable and antibacterial. Storage racks to be used with electronic equipment instruments are preferably constructed from material that has antistatic properties. Storage racks to be used for product display (e.g., jewelry stores) are preferably constructed from material that is clear (e.g., glass). Storage racks to be used for home displays (e.g., book shelves or entertainment units) are preferably constructed from material that is aesthetically pleasing (e.g., wood). Exemplary materials include, but are not limited to, plastics, metals, wood, and tempered glass.

In general, rails would be made from sturdy materials (e.g., metals or hard plastics) and would have a relatively smooth exterior surface to allow the supports to slide thereon. One preferred kitchenware storage rack may use rails constructed from stainless steel (e.g., Grainger Stainless-Steel-Rod-303). Alternative preferred rails could be made from other metals, plastics, wood, or other materials that have the necessary stiffness, strength, and corrosion resistance for their intended purpose. For intended purposes requiring more gripping, alternative rails may use surface roughness and/or static frictional force. A rough rail exterior surface has more "high points" or asperities that can interlock with the slide sub-channel interior surface, leading to greater static friction. Depending on the material from which the rail is constructed, surface roughness may be accomplished by, for example, etching (e.g., acid etching, laser etching, or chemical etching), abrasive machining (e.g., knurling, sanding, grinding, or abrasive blasting), or textured coatings (e.g., coating with built-in textures or non-permanent adhesives), The material from which the supports are constructed would generally depend on the intended purpose of the storage rack. In general, however, the supports would be made from sturdy materials (e.g., metals or hard plastics), but there would be some "give" to the material to allow the snap ridges to flex enough to allow the rail to pass therebetween (in the passage defined between the snap ridges) as it moves between the sub-channels. (As set forth above, if a plug is used, a wider variety of materials and construction methods may be used to create the supports.) Preferably at least the slide sub-channel would have a relatively smooth interior surface to allow the rail to slide within it. Supports made from certain materials (e.g., acrylonitrile butadiene styrene (ABS)) may be produced by 3D printing. One preferred kitchenware storage rack may have supports constructed from ABS such as Matterhackers 175 mm-abs-filament-black-1-kg. For intended purposes requiring more gripping, alternative slide sub-channels may use surface roughness and/or static frictional force. A rough slide sub-channel interior surface has more "high points" or asperities that can interlock with the rail exterior surface, leading to greater static friction. Depending on the material from which the support is constructed, surface roughness may be accomplished by, for example, etching (e.g., acid etching, laser etching, or chemical etching), abrasive machining (e.g., knurling, sanding, grinding, or abrasive blasting), or textured coatings (e.g., coating with built-in textures or non-permanent adhesives), It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not. The shown inventions, examples, and embodiments are preferred, but are not meant to be limiting unless specifically claimed, in which case they may limit the scope of that particular claim.

It is to be understood that for methods or procedures disclosed herein that include one or more steps, actions, and/or functions for achieving the described actions and results, the methods' steps, actions, and/or functions may be interchanged with one another without departing from the scope of the present invention. In other words, unless a specific order of steps, actions, and/or functions is required for proper or operative operation of the methods or procedures, the order and/or use of specific steps, actions, and/or functions may be modified without departing from the scope of the present invention.

All references (including, but not limited to, foreign and/or domestic publications, patents, and patent applications) cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention that, as a matter of language, might be said to fall therebetween.

What is claimed is:

1. A stop-snap-slide channel system comprising:

(a) at least one rail;

(b) at least one component; and (c) each at least one component having at least one stop-snap-slide channel defined therein, each stop-snap-slide channel comprising:

(i) at least one stop sub-channel;

(ii) at least one slide sub-channel, wherein said at least one stop sub-channel partially overlaps said at least one slide sub-channel;

(iii) at least one snap ridge extending into each stop-snap-slide channel and partially dividing said at least one stop sub-channel from said at least one slide sub-channel; and (iv) a passage from said at least one stop sub-channel to said at least one slide sub-channel, said passage allowing said at least one rail to pass between said at least one stop sub-channel and said at least one slide sub-channel.

2. The system of claim 1, each said at least one component being held in position in relation to said at least one rail when said at least one rail is positioned within said at least one stop sub-channel, each said at least one component being slidable in relation to said at least one rail when said at least one rail is positioned within said at least one slide sub-channel.

3. The system of claim 1, further comprising:

(a) each said at least one rail having an outer perimeter surface;

(b) each at least one stop sub-channel having an inner perimeter surface, said inner perimeter surface of said at least one stop sub-channel being partially nearly congruent with said outer perimeter surface of said at least one rail; and (c) each at least one slide sub-channel having an inner perimeter surface, said inner perimeter surface of said at least one slide sub-channel being partially nearly incongruent with said outer perimeter surface of said at least one rail.

4. The system of claim 1, said passage being defined between two snap ridges.

5. The system of claim 1, said at least one rail being a plurality of rails.

6. The system of claim 1, said at least one component being a plurality of components.

7. The system of claim 1, said at least one component being a component selected from the group consisting of:

(a) at least one support;

(b) at least one plug;

(c) at least one dual-purpose support;

(d) at least one non-spanning support;

(e) at least one hook support; and (f) at least one shelf support.

8. The system of claim 1, said at least one slide sub-channel having a rail access passageway.

9. The system of claim 1, wherein said at least one stop sub-channel and said at least one slide sub-channel have an angled relationship.

10. The system of claim 1, wherein said at least one stop sub-channel and said at least one slide sub-channel have a parallel relationship.

11. An adjustable storage rack comprising:

(a) at least one rail;

(b) at least one support, each support having at least one stop-snap-slide channel;

(c) each stop-snap-slide channel having at least one stop sub-channel and at least one slide sub-channel, said at least one stop sub-channel partially overlapping said at least one slide sub-channel;

(d) at least one snap ridge extending into each stop-snap-slide channel and partially dividing said at least one stop sub-channel from said at least one slide sub-channel; and (e) a passage from said at least one stop sub-channel to said at least one slide sub-channel, said passage allowing said at least one rail to pass between said at least one stop sub-channel and said at least one slide sub-channel.

12. The adjustable storage rack of claim 11, each said at least one support being held in position in relation to said at least one rail when said at least one rail is positioned within said at least one stop sub-channel, each said at least one support being slidable in relation to said at least one rail when said at least one rail is positioned within said at least one slide sub-channel.

13. The adjustable storage rack of claim 11, further comprising:

(a) each said at least one rail having an outer perimeter surface;

(b) each at least one stop sub-channel having an inner perimeter surface, said inner perimeter surface of said at least one stop sub-channel being partially nearly congruent with said outer perimeter surface of said at least one rail; and (c) each at least one slide sub-channel having an inner perimeter surface, said inner perimeter surface of said at least one slide sub-channel being partially nearly incongruent with said outer perimeter surface of said at least one rail.

14. The adjustable storage rack of claim 11, said passage being defined between two snap ridges.

15. The adjustable storage rack of claim 11, said at least one rail being a plurality of rails.

16. The adjustable storage rack of claim 11, said at least one support being a plurality of supports.

17. The adjustable storage rack of claim 11, said at least one support being a support selected from the group consisting of:

(a) at least one plug;

(b) at least one dual-purpose support;

(c) at least one non-spanning support;

(d) at least one hook support; and (e) at least one shelf support.

18. The adjustable storage rack of claim 11, said at least one slide sub-channel having a rail access passageway.

19. The adjustable storage rack of claim 11, wherein said at least one stop sub-channel and said at least one slide sub-channel have an angled relationship.

20. The adjustable storage rack of claim 11, wherein said at least one stop sub-channel and said at least one slide sub-channel have a parallel relationship.

* * * * *